US010323446B2

(12) United States Patent
Liang et al.

(10) Patent No.: US 10,323,446 B2
(45) Date of Patent: Jun. 18, 2019

(54) INTEGRATED SASH LOCK AND TILT LATCH COMBINATION WITH IMPROVED INTERCONNECTION CAPABILITY THEREBETWEEN

(71) Applicants: Luke Liang, So. Plainfield, NJ (US); Tong Liang, Guangzhou (CN); David Chen, Guangzhou (CN)

(72) Inventors: Luke Liang, So. Plainfield, NJ (US); Tong Liang, Guangzhou (CN); David Chen, Guangzhou (CN)

(73) Assignee: Vision Industries Group, Inc., So. Plainfield, NJ (US)

( * ) Notice: Subject to any disclaimer, the term of this patent is extended or adjusted under 35 U.S.C. 154(b) by 155 days.

(21) Appl. No.: 14/278,226

(22) Filed: May 15, 2014

(65) Prior Publication Data

US 2015/0330121 A1 Nov. 19, 2015
US 2017/0002590 A9 Jan. 5, 2017

Related U.S. Application Data

(63) Continuation-in-part of application No. 14/198,986, filed on Mar. 6, 2014, now Pat. No. 10,119,310.

(51) Int. Cl.
*E05C 3/04* (2006.01)
*E05C 1/08* (2006.01)
(Continued)

(52) U.S. Cl.
CPC ..... *E05C 3/046* (2013.01); *E05B 9/08* (2013.01); *E05B 63/0056* (2013.01); *E05C 1/08* (2013.01);
(Continued)

(58) Field of Classification Search
CPC ... E05C 1/08; E05C 1/16; E05C 3/046; E05C 2007/007; E05C 3/045; E05C 1/12;
(Continued)

(56) References Cited

U.S. PATENT DOCUMENTS 1,463,866 A 8/1823 Bourbeau
2,621,951 A 12/1852 Ostacal
(Continued)

FOREIGN PATENT DOCUMENTS

GB 0341207 1/1931
GB 2026594 2/1980
(Continued)

OTHER PUBLICATIONS

US 2,892,789 A, 10/1954, Rivard (withdrawn)

*Primary Examiner* — Christine M Mills
(74) *Attorney, Agent, or Firm* — Thomas A. O'Rourke; Bodner + O'Rourke, LLP

(57) ABSTRACT

A combination sash lock and tilt latch secures a sash window that is slidable and tiltable with respect to a master window frame. The fastener includes a lock assembly and latch assembly. The lock assembly is releasably mounted upon the sash window meeting rail without screws, using legs received within corresponding openings in the rail. The lock assembly is releasably secured thereto by a spring causing engagement between the legs and rail openings. The lock assembly includes a pivotable cam to releasably engage a keeper on the master frame, and a pivotable arm extending into the meeting rail. The latch assembly includes biasing means and a latch member with a plurality of openings, each configured to receive the post of the lock assembly, within the meeting rail, with the lock assembly installed thereon in any one of a plurality of positions corresponding to said openings in said latch member.

26 Claims, 43 Drawing Sheets

(51) Int. Cl.

| | |
|---|---|
| ***E05C 1/16*** | (2006.01) |
| ***E05B 63/00*** | (2006.01) |
| ***E05C 1/12*** | (2006.01) |
| ***E05B 9/08*** | (2006.01) |
| *E05C 7/00* | (2006.01) |

(52) U.S. Cl.
CPC ..... *E05C 1/12* (2013.01); *E05C 1/16* (2013.01); *E05C 3/045* (2013.01); *E05C 2007/007* (2013.01); *Y10T 292/0969* (2015.04); *Y10T 292/0977* (2015.04)

(58) Field of Classification Search
CPC .. E05B 9/08; E05B 63/0056; Y10T 292/0969; Y10T 292/0977; Y10S 292/20; Y10S 292/47; Y10S 292/63; Y10S 292/53; Y10S 292/64
USPC ..... 292/240–242, 163, 175, DIG. 20, 292/DIG. 47, DIG. 63, DIG. 53, DIG. 64
See application file for complete search history.

(56) References Cited

U.S. PATENT DOCUMENTS

| | | | |
|---|---|---|---|
| 36,524 | A | 9/1862 | Minor |
| 51,222 | A | 11/1865 | Ridell |
| 108,778 | A | 11/1870 | Gorman |
| 115,781 | A | 6/1871 | Steele |
| 126,872 | A | 5/1872 | Buckman |
| 148,857 | A | 3/1874 | Smith |
| 166,842 | A | 8/1875 | Berryman |
| 168,842 | A | 8/1875 | Berryman |
| 178,360 | A | 6/1876 | Cooper |
| 192,614 | A | 7/1877 | Andrews |
| 192,919 | A | 7/1877 | Hoyt |
| 201,146 | A | 3/1878 | Adler |
| 215,125 | A | 5/1879 | Hunter |
| 226,033 | A | 3/1880 | Burns |
| 230,476 | A | 7/1880 | Green |
| 234,387 | A | 11/1880 | Burgess |
| 284,993 | A | 9/1883 | Abele |
| 314,350 | A | 3/1885 | Smith |
| 316,285 | A | 4/1885 | McKeen |
| 331,005 | A | 11/1885 | Sahr |
| 336,302 | A | 2/1886 | Dudgeon |
| 346,788 | A | 8/1886 | Teufel |
| 350,678 | A | 10/1886 | Hussey |
| 353,287 | A | 11/1886 | Chumard |
| 369,885 | A | 9/1887 | Shaw |
| 375,656 | A | 12/1887 | Shaw |
| 376,252 | A | 1/1888 | McIntyre |
| 379,910 | A | 3/1888 | Rosentreter |
| 410,728 | A | 9/1889 | Brown |
| 417,868 | A | 12/1889 | Janes |
| 423,761 | A | 3/1890 | Hasenpflug |
| 452,723 | A | 5/1891 | Schmalhausen |
| 480,148 | A | 8/1892 | Theby |
| 493,159 | A | 3/1893 | Gibson |
| 509,941 | A | 12/1893 | Perry |
| 512,593 | A | 1/1894 | Webster |
| 520,754 | A | 5/1894 | Burmeister |
| 526,118 | A | 9/1894 | Sharp |
| 528,656 | A | 11/1894 | Burmeister |
| 530,078 | A | 12/1894 | Ammerman |
| 534,185 | A | 2/1895 | Winchester |
| 634,185 | A | 2/1895 | Winchester |
| 537,258 | A | 4/1895 | Wilcox |
| 539,030 | A | 5/1895 | Bitner |
| 551,181 | A | 12/1895 | Dillon |
| 551,242 | A | 12/1895 | Wallace |
| 554,448 | A | 2/1896 | Kell |
| 564,426 | A | 7/1896 | Hubbard |
| 587,424 | A | 8/1897 | Bonine |
| 590,225 | A | 9/1897 | Hill |
| 653,458 | A | 7/1900 | Paquette |
| 683,928 | A | 10/1901 | Geraghty |
| 688,491 | A | 12/1901 | Sigler |
| 695,736 | A | 3/1902 | Kendrick |
| 699,696 | A | 5/1902 | Mellen |
| 708,406 | A | 9/1902 | Robison |
| 714,343 | A | 11/1902 | Wellman |
| 718,007 | A | 1/1903 | Linn |
| 719,981 | A | 2/1903 | Adams |
| 722,162 | A | 3/1903 | St. Louis |
| 724,466 | A | 4/1903 | Hannan |
| 743,716 | A | 11/1903 | Hadka |
| 744,755 | A | 11/1903 | Hasenpflug |
| 745,888 | A | 12/1903 | McElwee |
| 756,453 | A | 4/1904 | Arens |
| 756,559 | A | 4/1904 | Arens |
| 757,249 | A | 4/1904 | Barnard |
| 759,642 | A | 5/1904 | Sparks |
| 764,493 | A | 7/1904 | Noseworthy |
| 769,386 | A | 9/1904 | Johnson |
| 769,767 | A | 9/1904 | Phelps |
| 774,536 | A | 11/1904 | Saunders |
| 775,602 | A | 11/1904 | Heamshaw |
| 800,043 | A | 9/1905 | Witte |
| 804,994 | A | 11/1905 | Andrews |
| 815,537 | A | 3/1906 | Kissinger |
| 833,900 | A | 10/1906 | Sigler |
| 837,811 | A | 12/1906 | Ebbeson |
| 840,427 | A | 1/1907 | Brister |
| 865,090 | A | 9/1907 | Eddy |
| 866,073 | A | 9/1907 | Saunders |
| 878,206 | A | 2/1908 | Johnson |
| 878,208 | A | 2/1908 | Johnson |
| 881,658 | A | 3/1908 | Bowman |
| 886,108 | A | 4/1908 | Allen |
| 887,690 | A | 5/1908 | Pearce |
| 922,894 | A | 5/1908 | Heid |
| 897,719 | A | 9/1908 | Daubaignan |
| 900,079 | A | 10/1908 | Bittorf |
| 910,850 | A | 1/1909 | Petrie |
| 926,899 | A | 7/1909 | Roy |
| 928,408 | A | 7/1909 | Taube |
| 948,628 | A | 2/1910 | Jefferis |
| 959,150 | A | 5/1910 | Morris |
| 96,063 | A | 8/1910 | Tooihaker |
| 966,063 | A | 8/1910 | Toothaker |
| 976,777 | A | 11/1910 | Brown |
| 980,131 | A | 12/1910 | Shean |
| 998,642 | A | 7/1911 | Shean |
| 1,003,386 | A | 9/1911 | Welker |
| 1,006,211 | A | 10/1911 | Hermon |
| 1,020,454 | A | 3/1912 | Seidenbecker |
| 1,041,803 | A | 10/1912 | Kilbum |
| 1,051,913 | A | 2/1913 | Rowley |
| 1,051,918 | A | 2/1913 | Rowley |
| 1,059,999 | A | 4/1913 | James |
| 1,069,079 | A | 7/1913 | Voight |
| 1,077,487 | A | 11/1913 | Miller |
| 1,080,172 | A | 12/1913 | Rusk |
| 1,100,820 | A | 6/1914 | Edwards |
| 1,121,228 | A | 12/1914 | Burkhart |
| 1,122,026 | A | 12/1914 | O'Rourke |
| 1,127,835 | A | 2/1915 | Westlund |
| 1,133,217 | A | 3/1915 | Barton |
| 1,141,437 | A | 6/1915 | Unterlender |
| 1,148,712 | A | 8/1915 | Overland |
| 1,163,086 | A | 12/1915 | Harper |
| 1,173,129 | A | 2/1916 | Tallaferro |
| 1,177,637 | A | 4/1916 | Lane |
| 1,177,838 | A | 4/1916 | Wilkinson |
| 1,207,989 | A | 12/1916 | O'Rourke |
| 1,232,683 | A | 7/1917 | Hollis |
| 1,243,115 | A | 10/1917 | Shur |
| 1,247,182 | A | 11/1917 | Tuekmantel |
| 1,253,810 | A | 1/1918 | Gianninoto |
| 1,261,274 | A | 4/1918 | Newsam |
| 1,269,467 | A | 6/1918 | Winters |
| 1,270,740 | A | 6/1918 | Keyes |
| 1,272,900 | A | 7/1918 | Berman |
| 1,279,353 | A | 9/1918 | Kelley |

(56) References Cited

U.S. PATENT DOCUMENTS 1,311,052 A 7/1919 Danforth
1,322,677 A 11/1919 Ditlefsen
1,338,250 A 4/1920 Parkes
1,338,416 A 4/1920 Bellinger
1,339,362 A 5/1920 L'Heureux
1,341,234 A 5/1920 Horton
1,350,698 A 8/1920 Boedtcher
1,387,302 A 8/1921 Page
1,388,272 A 8/1921 Lawrence
1,393,628 A 10/1921 Leichter
1,398,174 A 11/1921 Carlson
1,399,897 A 12/1921 Singer
1,412,154 A 4/1922 Wollesen
1,439,585 A 12/1922 Trost
1,461,467 A 7/1923 Stuart
1,470,951 A * 10/1923 Andersen ..... E05B 15/10 292/137
1,485,382 A 3/1924 Foley
1,490,874 A 4/1924 Webb
1,516,995 A 11/1924 Trigueiro
1,550,532 A 8/1925 French
1,552,690 A 9/1925 Frantz
1,587,037 A 6/1926 Rudolph
1,601,051 A 9/1926 Wilten
1,605,717 A 11/1926 Gregg
1,609,031 A 3/1927 Ostrosky
1,619,031 A 3/1927 Ostrosky
1,622,742 A 3/1927 Shipman
1,658,818 A 1/1928 Dillon
1,692,579 A 11/1928 Schrader
1,704,946 A 3/1929 Lindgren
1,712,792 A 5/1929 Hansen
1,715,957 A 6/1929 Stein
1,724,637 A 8/1929 Bergstrom
1,750,715 A 3/1930 Jeffers
1,794,171 A 2/1931 Grutel
1,812,288 A 6/1931 Drapeau
1,819,824 A 8/1931 McAllister
1,864,253 A 6/1932 McIntyre
1,659,274 A 7/1932 Phillips
1,869,274 A 7/1932 Phillips
1,891,940 A 12/1932 McAllister
1,900,936 A 3/1933 Hunger
1,901,974 A 3/1933 Macy
1,922,062 A 8/1933 Sullivan
1,960,034 A 5/1934 Stewart
1,964,114 A 6/1934 Gerlach
2,095,057 A 10/1937 Corrado
2,122,661 A 7/1938 Rightmyer
2,126,995 A 8/1938 Kingdon
2,136,408 A 11/1938 Bedeil
2,158,260 A 5/1939 Stillman
2,202,561 A 5/1940 Lahiere
2,272,145 A 2/1942 Anderson
2,326,084 A 8/1943 Westroce
2,369,584 A 2/1945 Lundholm
2,452,521 A 10/1948 Johson
2,480,016 A 8/1949 Granberg
2,480,988 A 9/1949 Walton
2,500,349 A 3/1950 Menns
2,500,849 A 3/1950 Menns
2,503,370 A 4/1950 Zanona
2,523,559 A 9/1950 Couture
2,527,278 A 10/1950 Schemansky
2,537,736 A 1/1951 Carlson
2,560,274 A 7/1951 Cantelo
2,590,624 A 3/1952 James
2,599,196 A 6/1952 Peremi
2,605,125 A 7/1952 Emerson
2,612,398 A 9/1952 Miller
2,613,526 A 10/1952 Holmsten
2,645,515 A 7/1953 Thomas
2,648,967 A 8/1953 Holmsten
2,670,982 A 3/1954 Banham
2,758,862 A 8/1956 Encier
2,766,492 A 10/1956 Day
2,739,815 A 4/1957 Lickteig
2,789,851 A 4/1957 Lickteig
2,818,919 A 1/1958 Sylvan
2,848,258 A 8/1958 Granberg
2,855,772 A 10/1958 Hillgren
2,884,276 A 4/1959 Baptist
2,941,832 A 6/1960 Grossman
3,027,188 A 3/1962 Eichstadt
3,135,542 A 6/1964 Wilkenson
3,187,526 A 6/1965 Moler
3,267,613 A 8/1966 McQuiston
3,288,510 A 11/1966 Gough
3,352,586 A 11/1967 Hakanson
3,362,710 A 1/1968 Burns
3,362,740 A 1/1968 Burns
3,422,575 A 1/1969 Armstrong
3,438,153 A 4/1969 Lemme
3,599,452 A 8/1971 Maruyama
3,600,019 A 8/1971 Toyota
3,642,315 A 2/1972 Alpem
3,645,573 A 2/1972 Strang
3,683,652 A 8/1972 Halopoff
3,706,467 A 12/1972 Martin
3,762,750 A 10/1973 Orr
3,811,718 A 5/1974 Bates
3,841,674 A * 10/1974 Bisbing ..... E05B 5/00 292/175
3,907,348 A 9/1975 Bates
3,919,808 A 11/1975 Simmons
3,927,906 A 12/1975 Mieras
4,054,308 A 10/1977 Prohaska
4,059,298 A 11/1977 van Klompenburg
4,063,766 A 12/1977 Granberg
4,068,871 A 1/1978 Mercer
4,095,827 A 6/1978 Stavenau
4,095,829 A 6/1978 Van Klompenburg
4,102,546 A 7/1978 Costello
4,151,682 A 5/1979 Schmidt
4,165,894 A 8/1979 Wojciechowski
4,223,930 A 9/1980 Costello
4,227,345 A 10/1980 Durham
4,235,465 A 11/1980 Costello
4,253,688 A 3/1981 Hosooka
4,261,602 A 4/1981 Anderson
4,274,666 A 6/1981 Peck
4,293,154 A 10/1981 Cassells
4,303,264 A 12/1981 Uehara
4,305,612 A 12/1981 Hunt
4,392,329 A 7/1983 Suzuki
4,429,910 A 2/1984 Anderson
4,470,277 A 9/1984 Uyeda
4,475,311 A 10/1984 Gibson
4,525,952 A 7/1985 Cunningham
4,580,366 A 4/1986 Hardy
4,587,759 A 5/1986 Gray
4,621,847 A 11/1986 Paulson
4,624,073 A 11/1986 Randall
4,639,021 A 1/1987 Hope
4,643,005 A 2/1987 Logas
4,736,972 A 4/1988 Mosch
4,801,164 A 1/1989 Mosch
4,813,725 A 3/1989 Mosch
4,824,154 A 4/1989 Simpson
4,827,685 A 5/1989 Schmidt
4,893,849 A 1/1990 Schlack
4,922,658 A 5/1990 Coddens
4,949,506 A 8/1990 Durham
4,961,286 A 10/1990 Bezubic
4,991,886 A 2/1991 Nolte
5,042,855 A 8/1991 Bennett
5,072,464 A 12/1991 Draheim
5,076,015 A 12/1991 Manzalini
5,087,087 A 2/1992 Vetter
5,087,088 A 2/1992 Milam
5,090,750 A 2/1992 Lindqvist
5,090,754 A 2/1992 Thompson
5,110,165 A 5/1992 Piltingsrud

(56) References Cited

U.S. PATENT DOCUMENTS 5,118,145 A * 6/1992 Tucker ..... E05C 9/02 292/158
5,127,685 A 7/1992 Dallaire
5,139,291 A 8/1992 Schultz
5,143,412 A 9/1992 Lindqvist
5,161,839 A 11/1992 Piltingsrud
5,165,737 A 11/1992 Riegelman
5,183,310 A 2/1993 Shaughnessy
5,219,193 A 6/1993 Piltingsrud
5,244,238 A 9/1993 Lindqvist
5,248,174 A 9/1993 Matz
5,274,955 A 1/1994 Dallaire
5,341,752 A 8/1994 Hambleton
5,398,447 A 3/1995 Morse
5,437,484 A 8/1995 Yamada
5,448,857 A 9/1995 Stormo
5,452,925 A 9/1995 Huang
5,454,609 A 10/1995 Slocomb
5,560,149 A 10/1996 Lafevre
5,582,445 A 12/1996 Olsen
RE35,463 E 2/1997 Vetter
5,636,475 A 6/1997 Nidelkoff
5,688,000 A 11/1997 Dolman
5,715,631 A 2/1998 Kailian
5,741,032 A 4/1998 Chaput
5,778,602 A 7/1998 Johnson
5,791,700 A 8/1998 Biro
5,829,196 A 11/1998 Maier
5,839,767 A 11/1998 Piltingsrud
5,873,199 A 2/1999 Meunier et al.
5,901,499 A 5/1999 Delaske
5,901,501 A 5/1999 Fountaine
5,911,763 A 6/1999 Quesada
5,927,768 A * 7/1999 Dallmann ..... E05C 9/02 292/139
5,970,656 A 10/1999 Maier
5,992,907 A 11/1999 Sheldon
6,000,735 A 12/1999 Jourdenais
6,052,948 A * 4/2000 Spitzley ..... E05B 79/06 49/460
6,086,121 A 7/2000 Buckland
6,116,665 A 9/2000 Subliskey
6,135,510 A 10/2000 Diginosa
6,139,071 A 10/2000 Hopper
6,142,541 A 11/2000 Rotondi
6,155,615 A 12/2000 Schultz
6,161,335 A 12/2000 Beard et al.
6,176,041 B1 1/2001 Roberts
6,178,696 B1 1/2001 Liang
6,183,024 B1 2/2001 Schultz
6,209,931 B1 4/2001 Von Stoutenborough
6,217,087 B1 4/2001 Fuller
6,230,443 B1 * 5/2001 Schultz ..... E05D 15/22 49/181
6,257,303 B1 7/2001 Coubray et al.
6,279,266 B1 8/2001 Searcy
6,349,576 B2 2/2002 Subliskey
6,364,375 B1 4/2002 Szapucki
6,422,287 B1 7/2002 Wilke
6,546,671 B2 4/2003 Mitchell
6,565,133 B1 5/2003 Timothy
6,588,150 B1 7/2003 Wong
6,592,155 B1 7/2003 Lemley
6,607,221 B1 8/2003 Elliott
6,631,931 B2 10/2003 Magnusson
6,634,683 B1 10/2003 Brannan
6,817,142 B2 11/2004 Marshik
6,832,792 B2 * 12/2004 Polowinczak ..... E05C 1/10 292/145
6,848,728 B2 2/2005 Rotondi
6,871,885 B2 3/2005 Goldenberg
6,871,886 B2 3/2005 Coleman
6,877,784 B2 4/2005 Kelley
6,925,753 B1 8/2005 Pettit
6,925,758 B2 8/2005 Pettit
6,957,513 B2 * 10/2005 Pettit ..... E05B 5/003 292/141
6,983,963 B2 1/2006 Eslick
7,000,957 B2 2/2006 Lawrence
7,013,603 B2 3/2006 Eenigenburg
7,063,361 B1 6/2006 Lawrence
7,070,211 B2 7/2006 Polowinczak
7,070,215 B2 7/2006 Kelley
7,100,951 B2 9/2006 Jien
7,147,255 B2 12/2006 Goldenberg
7,159,908 B2 1/2007 Liang
7,296,831 B2 11/2007 Generowicz
7,322,620 B1 1/2008 Lawrence
7,407,199 B2 8/2008 Richardson
7,452,014 B2 * 11/2008 Vetter ..... E05B 17/0025 292/302
7,481,470 B2 1/2009 Eenigenburg
7,490,873 B1 * 2/2009 Ricke ..... E05B 65/0876 292/5
7,510,221 B2 3/2009 Eenigenburg
7,607,262 B2 10/2009 Pettit
7,665,775 B1 2/2010 Miller
7,922,223 B2 4/2011 Lawrence
7,976,077 B2 * 7/2011 Flory ..... E05B 53/003 292/241
8,020,904 B2 * 9/2011 Flory ..... E05B 63/14 292/241
8,205,919 B2 6/2012 Flory
8,205,920 B2 6/2012 Flory
8,272,164 B2 * 9/2012 Albrecht ..... E05B 17/2034 292/DIG. 20
8,550,507 B2 10/2013 Barton
8,726,572 B2 5/2014 Derham
8,789,857 B2 * 7/2014 Liang ..... E05B 17/2019 292/111
8,789,862 B2 7/2014 Liang
8,844,985 B2 * 9/2014 Liang ..... E05C 3/046 292/163
8,955,255 B2 * 2/2015 DeBoer ..... E05B 53/003 49/176
9,140,033 B2 9/2015 Wolf
2004/0168370 A1 * 9/2004 Pettit ..... E05B 5/003 49/185
2006/0192391 A1 * 8/2006 Pettit ..... E05C 9/046 292/5
2006/0244270 A1 11/2006 Rotondi
2007/0205615 A1 9/2007 Eenigenburg
2008/0022728 A1 * 1/2008 Flory ..... E05B 63/14 70/90
2008/0169658 A1 7/2008 Wolf
2010/0132263 A1 * 6/2010 Flory ..... E05B 65/0841 49/395
2010/0199726 A1 8/2010 Varney
2010/0218425 A1 9/2010 Nolte
2010/0263415 A1 10/2010 Ruspil
2012/0284993 A1 * 11/2012 Liang ..... E05C 3/046 29/453
2013/0214545 A1 * 8/2013 Wolf ..... E05C 3/046 292/241
2013/0283694 A1 * 10/2013 DeBoer ..... E05B 53/003 49/186
2013/0283695 A1 10/2013 Hollermann
2015/0252596 A1 * 9/2015 Liang ..... E05C 1/08 292/163
2015/0252600 A1 * 9/2015 Liang ..... E05C 21/00 292/169
2015/0376920 A1 * 12/2015 Subliskey ..... E05C 3/12 49/506
2016/0076282 A1 3/2016 Wolf

FOREIGN PATENT DOCUMENTS

GB 2 286 627 8/1995
GB 2286627 8/1995
GB 2 461 079 12/2009
GB 2 461 107 12/2009

(56) References Cited

FOREIGN PATENT DOCUMENTS

| | | |
|---|---|---|
| GB | 2 461 108 | 12/2009 |
| GB | 2461079 | 12/2009 |
| GB | 2461107 | 12/2009 |
| GB | 2461108 | 12/2009 |

* cited by examiner

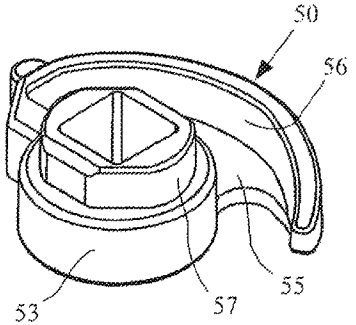
FIG. 17
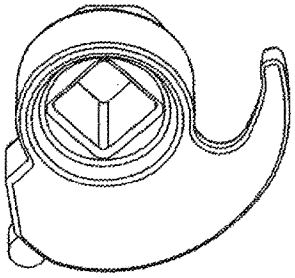
FIG. 18
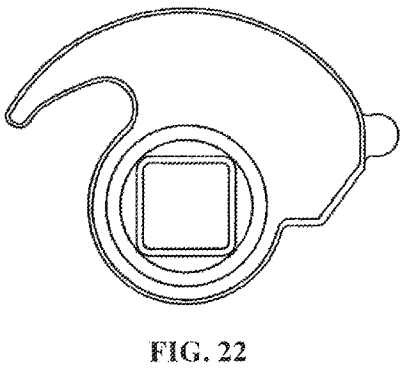
FIG. 22
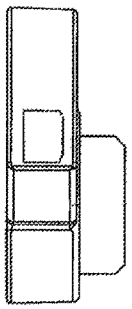
FIG. 20
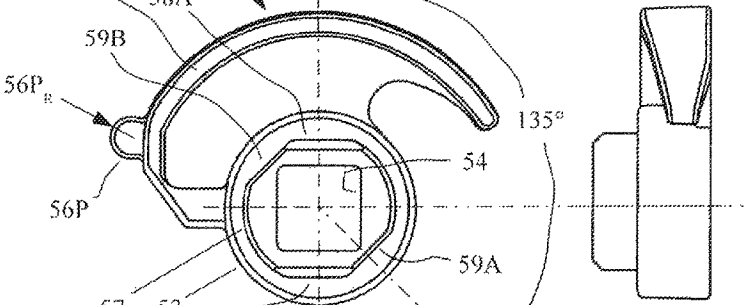
FIG. 19
FIG. 21
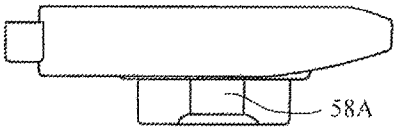
FIG. 23
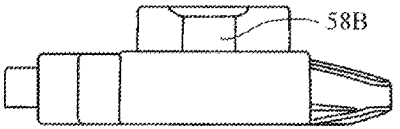
FIG. 24

266B
266A
254E
254A
254A 252
255N
255
253
251
254A

256'
257'
255'
256F
255N
257F
256
256R
257
250
255
254A

254E

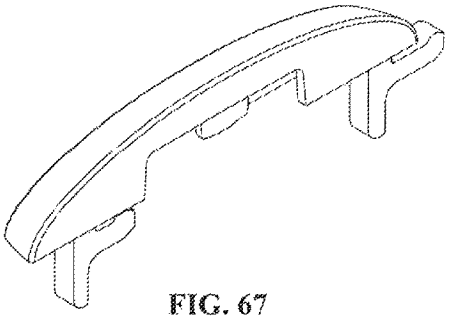
FIG. 67
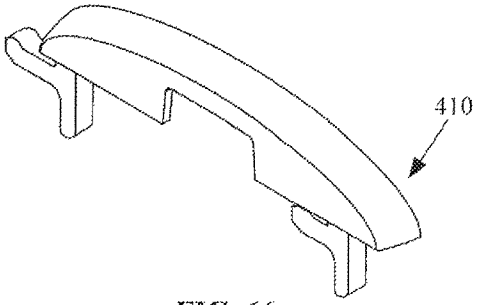
FIG. 66
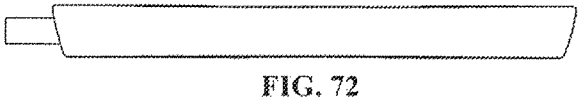
FIG. 72
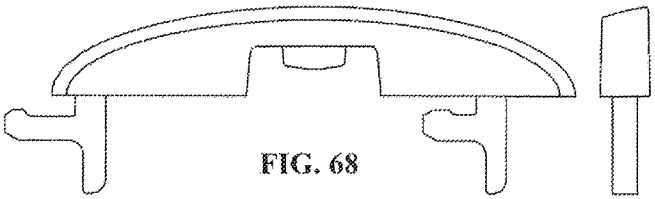
FIG. 68
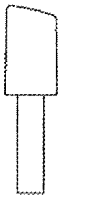
FIG. 69
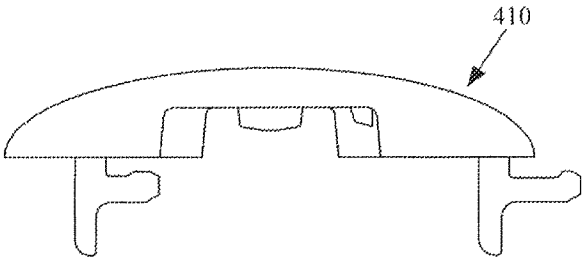
FIG. 71
FIG. 70
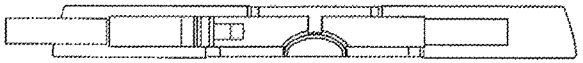
FIG. 73

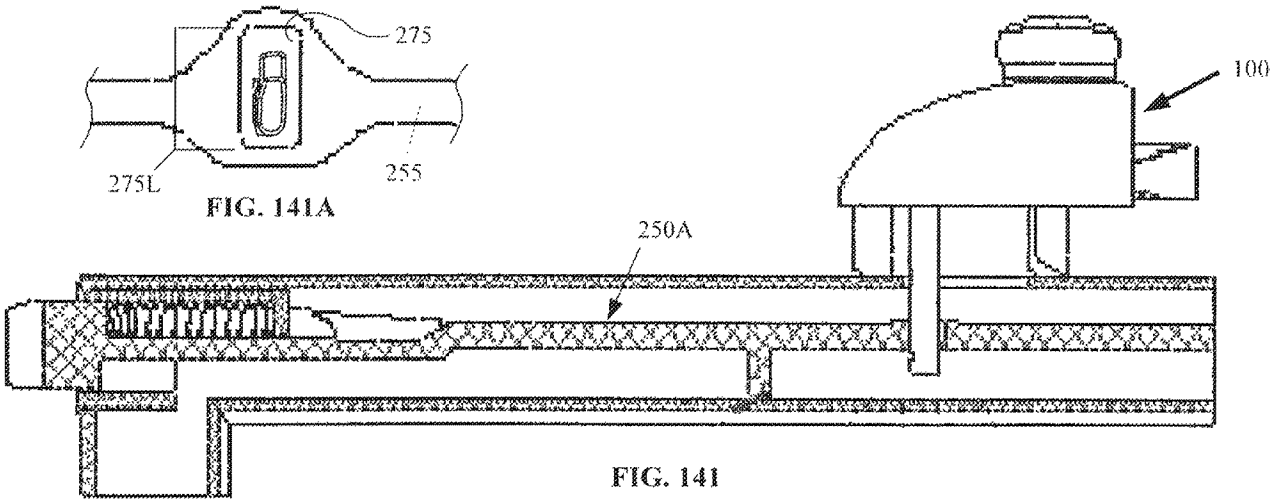
FIG. 141
FIG. 141A
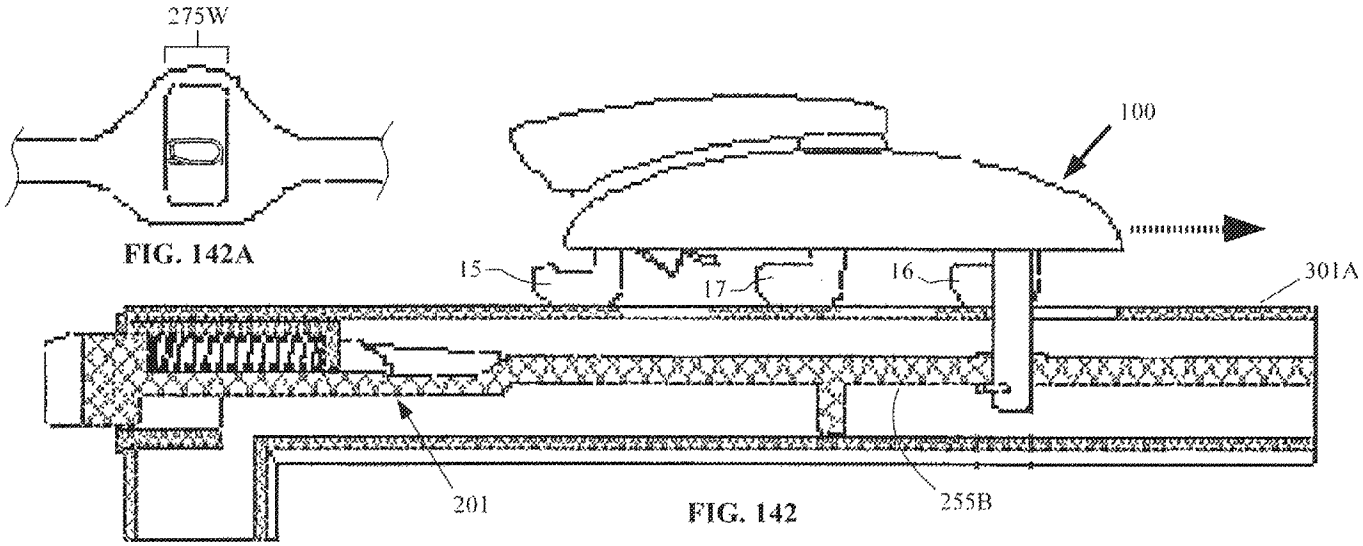
FIG. 142
FIG. 142A

INTEGRATED SASH LOCK AND TILT LATCH COMBINATION WITH IMPROVED INTERCONNECTION CAPABILITY THEREBETWEEN

CROSS REFERENCE TO RELATED APPLICATIONS

This application is a continuation-in-part of U.S. patent application Ser. No. 14/198,986, filed on Mar. 6, 2014, the disclosures of which are incorporated herein by reference.

FIELD OF THE INVENTION

The present invention relates to improvements in locks and tilt latches for slidable sash windows, and more particularly to improvements to an integral sash lock/tilt latch combination.

BACKGROUND OF THE INVENTION

Single hung and double hung sliding sash windows are commonly used today in the construction of residential and commercial buildings. Sash locks are typically mounted to the meeting rail of the bottom sash window to lock the sash or sashes, by preventing the lower sash (or both the lower and upper sashes for a double hung window), from being opened through sliding movement relative to the master window frame. Also, in order to assist in the cleaning of the exterior of these sliding sash windows, it is common for window manufacturers to incorporate a tilt latch device thereon that permits one end of the sliding sash window to be released from the track of the master window frame. This allows the sash window to be pivoted into the room, for easy access to the exterior surface of the glazing that is normally exposed to the exterior environment of the building.

The present invention seeks to provide improvements to such window hardware in the form of an integrated sash lock and tilt latch fastener for single hung or double hung windows.

OBJECTS OF THE INVENTION

It is an object of the invention to provide a sash lock to prevent relative sliding movement of one or both sliding sash windows that are slidable within a master window frame.

It is another object of the invention to provide a tilt latch to permit pivoting of a sliding sash window inwardly into the room in which the window is installed.

It is a further object of the invention to provide a combination sash lock and tilt latch that act cooperatively through the use of a single handle member.

It is another object of the invention to provide a sash lock that may be easily installed upon the meeting rail of the sliding sash window without the use of mechanical fasteners, and may also be easily removed therefrom.

It is also an object of the invention to provide a tilt latch device that may be blindly coupled to a sash lock for cooperative interaction and actuation therefrom.

Further objects and advantages of the invention will become apparent from the following description and claims, and from the accompanying drawing figures.

SUMMARY OF THE INVENTION

An integral sash locking and tilt latching fastener for a sliding sash window includes a lock assembly and a latch assembly. The sash lock assembly is configured to be releasably mounted to the top of the meeting rail of the sash window without screws, and includes a locking cam pivotally mounted to the sash lock housing, and is thereby configured to rotate out from a cavity in the housing to releasably engage a keeper on the master window frame, to inhibit sliding movement of the sash window. The sash lock may also include a pivotable lever arm with a post that is configured to extend beyond the lock housing, and into the hollow of the meeting rail.

The latch may include a biasing means and a latch member that may be slidably received within the side of the meeting rail. The biasing means and latch member may alternatively be received into a latch housing for ease of its installation into the meeting rail. The latch member may include a tongue and a flexible beam extending away from the tongue. The end of the beam distal from the tongue may include a fixed funnel member and a flexible funnel member. The fixed funnel member and the flexible funnel member may be configured to permit the latch assembly to blindly engage the pivotable lever arm of the lock assembly within the meeting rail, when installed therein. The flexible funnel member may deflect during such engagement, so that the post of the pivotal lever arm protruding into the interior hollow of the meeting rail may be received within an opening formed by the fixed funnel member and the flexible funnel member. The biasing member of the latch assembly may be configured to normally bias the latch member so that a portion of the tongue protrudes out from the meeting rail, and simultaneously biases the locking cam of the sash lock towards the latched position.

The locking cam may have a graspable shaft portion that protrudes upwardly, out from an orifice in the sash lock housing, to permit actuation of the device (cam rotation) by a user. Alternatively, the cam may have a separate handle member secured thereto, which may facilitate easy rotation and counter-rotation of the cam.

In addition to being configured to properly engage the key of the keeper to lock the sash to prevent its sliding movement, the locking cam may be configured to selectively drive the pivotable lever arm of the sash lock, and may include three key positions. The locking cam and handle combination may have a first position, in which the sash lock is locked to prevent sliding movement, and the sash latch is latched to prevent pivoting of the sash window. The locking cam and handle combination may have a second position, in which the sash lock is unlocked and the window is free to undergo sliding movement, but the sash latch remains latched to still prevent pivoting of the sash window. The locking cam and handle combination may also have a third position, in which the sash lock is still unlocked and free to undergo sliding movement, but the sash latch is also unlatched, so that the sash window may be pivoted inwardly. Movement of the locking cam and handle combination from the second position to the third position causes the cam to drive the pivotable lever arm to rotate, so that the arm engages the fixed funnel member of the latch assembly, and overcomes the biasing of the latch spring to cause translation of the latch into the retracted position.

The housing of the lock assembly may include one or more hooked legs that are configured to be received within one or more corresponding openings in the top of the meeting rail, for the releasable mounting of the lock assembly thereto, without screws. The lock assembly may be releasably secured in this position by a leaf spring that is fixedly secured to the underneath of the sash lock housing, and which has a portion that protrudes out beyond the sash lock housing to engage in one of the openings in the meeting rail. Removal of the sash lock may be easily accomplished by using a pry tool to deflect the leaf spring from its engagement in the rail opening, to permit appropriate sliding and pivoting of the sash lock assembly to effect removal of its legs from the openings in the meeting rail.

The keeper may be similarly constructed to accomplish its releasable securement to the master window frame, or to the other sash member, which may be slidable (double-hung) or may be fixed (single hung sash window).

BRIEF DESCRIPTION OF THE DRAWINGS

FIG. 17 is a perspective view of the locking cam of the sash lock assembly of FIG. 1A.

FIG. 18 is a second perspective view of the locking cam of the sash lock assembly of FIG. 2.

FIG. 19 is a top view of the locking cam of FIG. 17.

FIG. 20 is a first end view of the locking cam of FIG. 19.

FIG. 21 is a second end view of the locking cam of FIG. 19.

FIG. 22 is a bottom view of the locking cam of FIG. 19.

FIG. 23 is a top view of the locking cam of FIG. 19.

FIG. 24 is a bottom view of the locking cam of FIG. 19.

FIG. 66 is a first perspective view of the keeper to be engaged by the cam of the sash lock assembly of the integrated sash lock/tilt latch fastener of FIG. 1A.

FIG. 67 is a second perspective view of the keeper of FIG. 66.

FIG. 68 is a front view of the keeper of FIG. 66.

FIG. 69 is a first end view of the keeper of FIG. 68.

FIG. 70 is a second end view of the keeper of FIG. 68.

FIG. 71 is a rear view of the keeper of FIG. 68.

FIG. 72 is a top view of the keeper of FIG. 68.

FIG. 73 is a bottom view of the keeper of FIG. 68.

FIG. 99 also illustrates lateral deflection of the flexible funnel member in a second direction, to create a temporary pathway for the post of the pivotal lever arm to be received into an opening in the latch assembly formed by the fixed and flexible funnel members.

FIG. 111 is an end view of the integrated sash lock/tilt latch fastener installed within the sliding sash window frame, as seen in FIG. 110.

FIG. 112 is a perspective view of the integrated sash lock/tilt latch fastener installed within the sliding sash window frame, as seen in FIG. 110.

FIG. 113 is a bottom view of the sash lock assembly of FIG. 110, showing positioning of the cam and the post of the pivotal lever arm when the integrated sash lock/tilt latch fastener is in the unlocked and latched position.

FIG. 114 is the view of FIG. 102, with the integrated sash lock/tilt latch fastener in the unlocked and unlatched position, but shown reduced in size.

FIG. 115 is an end view of the integrated sash lock/tilt latch fastener installed within the sliding sash window frame, as seen in FIG. 114.

FIG. 116 is a perspective view of the integrated sash lock/tilt latch fastener installed within the sliding sash window frame, as seen in FIG. 114.

FIG. 117 is a bottom view of the sash lock assembly of FIG. 114, showing positioning of the cam and the post of the pivotal lever arm when the integrated sash lock/tilt latch fastener is in the unlocked and unlatched position.

FIG. 118 is a reverse perspective view of the sash lock assembly releasably secured to the sliding sash window frame, as seen in FIG. 94A, but with a slender pry tool being inserted through the opening in the sash lock housing and against the engagement spring, to effect removal of the sash lock assembly from the window frame.

FIG. 119 is a cross-sectional view through the arrangement of FIG. 118, but showing the slender pry tool deflecting the sash lock engagement spring out from the corresponding opening in the sliding sash window frame.

FIG. 120 is the cross-sectional view of FIG. 119, but showing the sash lock assembly having been slid to cause disengagement of the sash lock housing legs from the top wall of the meeting rail.

FIG. 121 is the cross-sectional view of FIG. 120, but showing the legs of the sash lock housing having been removed from the openings in the top wall of the meeting rail, and with the slender pry tool being used to subsequently pry the latch assembly out from the window frame.

FIG. 122 is a perspective view showing the slender pry tool being used to pry the latch assembly out from the window frame, as seen in FIG. 121.

Figure 87:
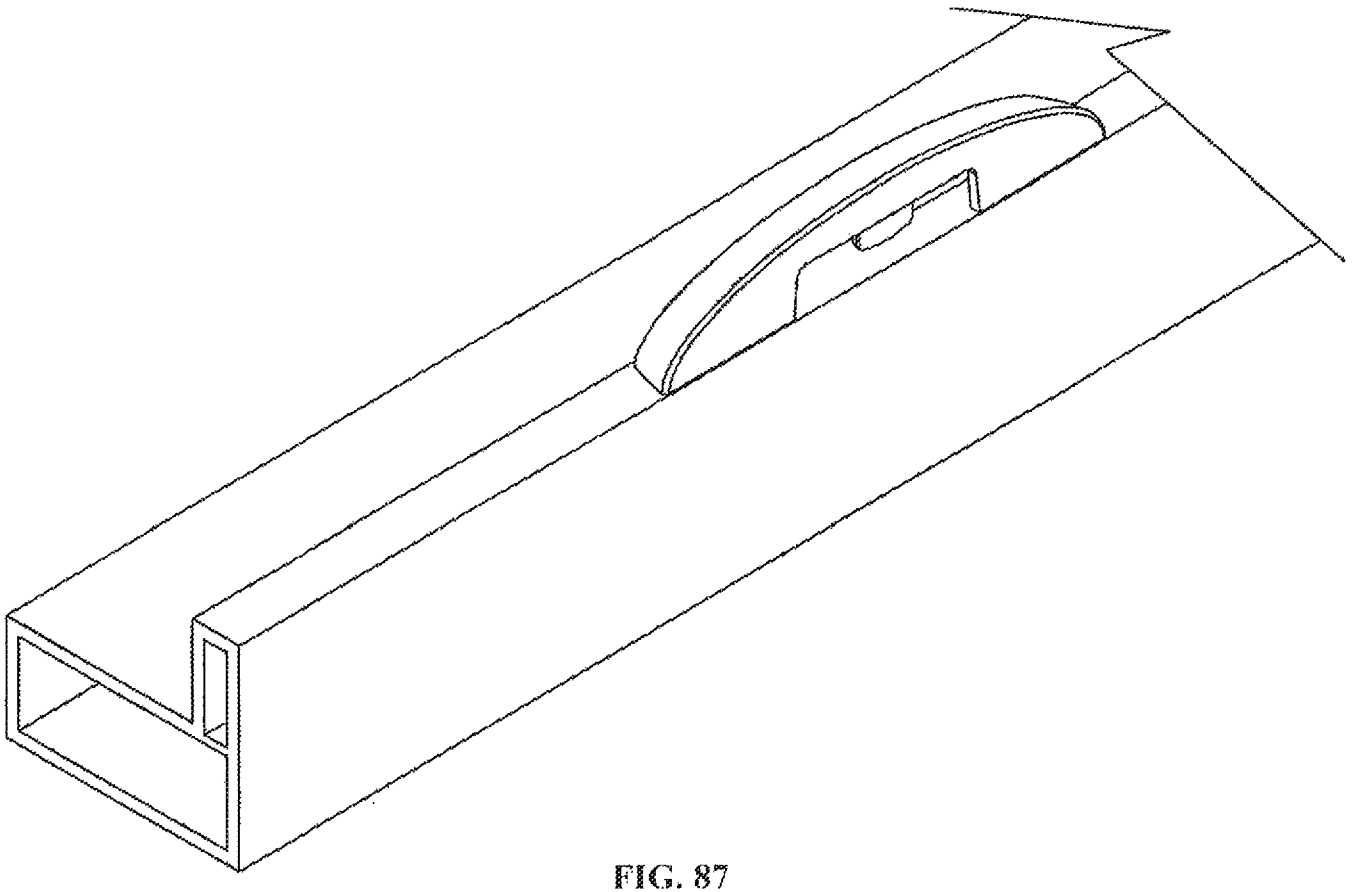
FIG. 87 is a perspective view showing the keeper assembly of FIG. 76 releasably installed upon the window frame of FIG. 80.
Figure 123:
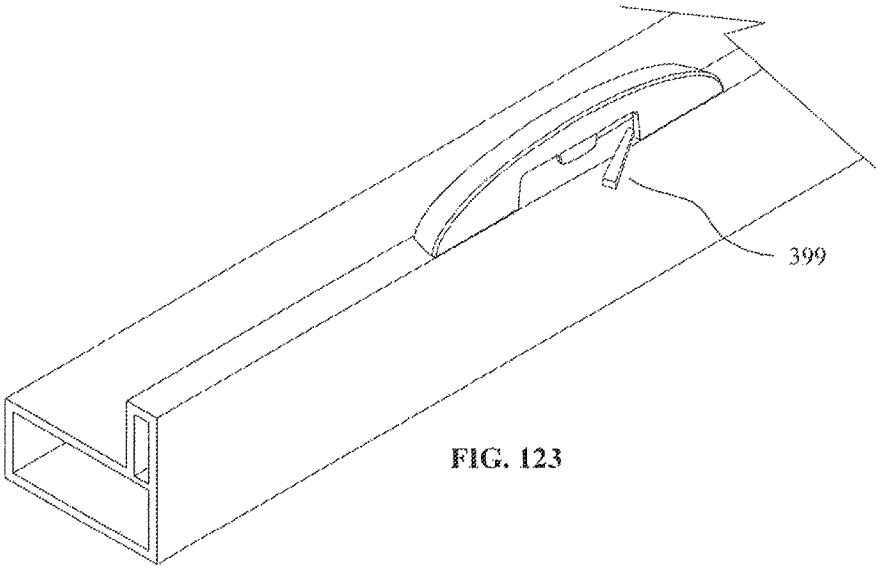

FIG. 123 is the perspective view of the keeper assembly releasably secured to the master window frame, as seen in FIG. 87, but with a slender pry tool being inserted through the opening in the keeper housing and against the keeper engagement spring.

Figure 124:
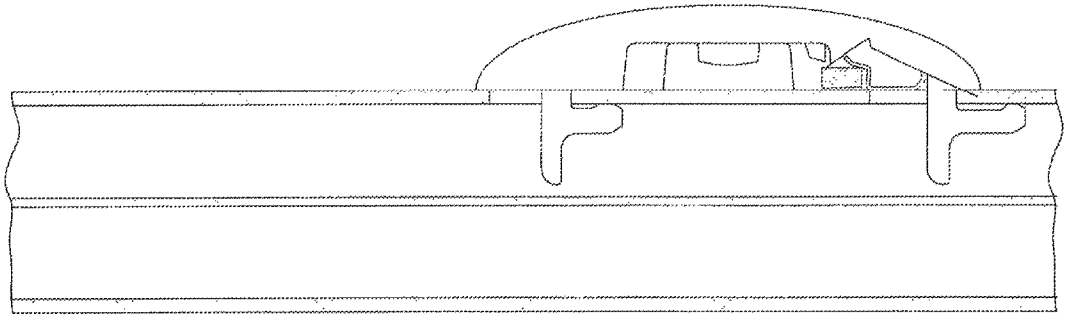

FIG. 124 is a cross-sectional view through the arrangement of FIG. 123, but showing the slender pry tool deflecting the keeper engagement spring out from the corresponding opening in the master window frame.

Figure 125:
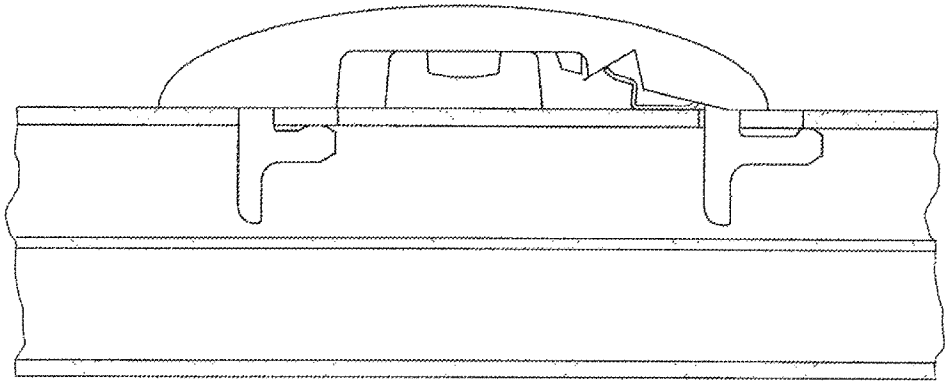

FIG. 125 is the cross-sectional view of FIG. 124, but showing the sash lock assembly having been slid to cause disengagement of the legs of the keeper housing from the top wall of the master frame.

Figure 126:
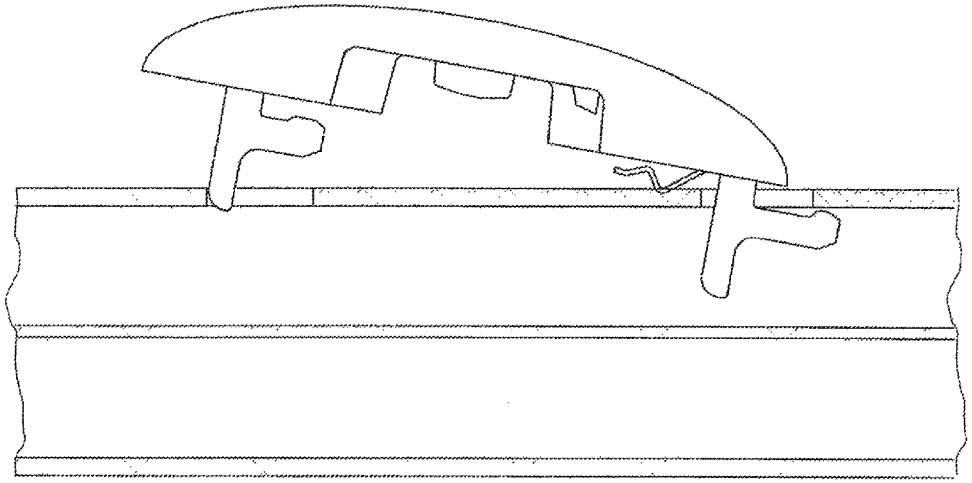

FIG. 126 is the cross-sectional view of FIG. 125, but showing the sash lock assembly being pivoted to cause removal of the legs of the keeper housing from the top wall of the master frame.

Figure 56:
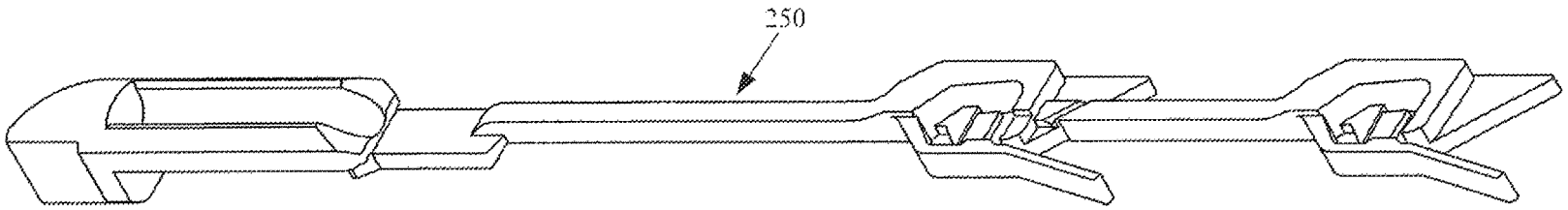
FIG. 56 is a first perspective view of the latch member of the latch assembly of FIG. 1A.
Figure 57:
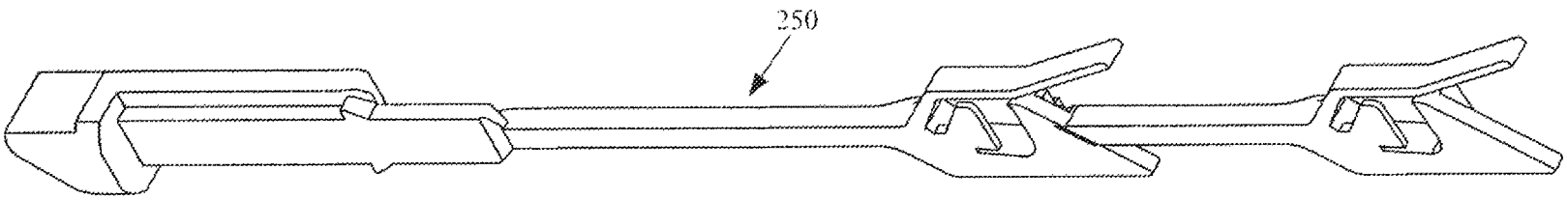
FIG. 57 is a second perspective view of the latch member of the latch assembly of FIG. 1A.
Figure 58:
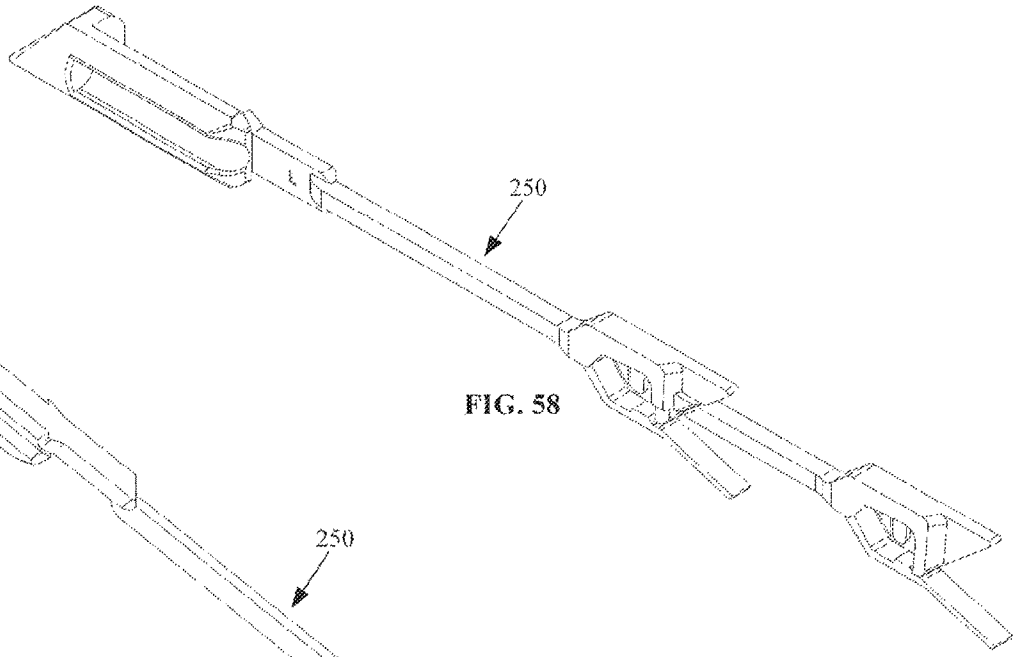
FIG. 58 is a third perspective view of the latch member of the latch assembly of FIG. 1A.
Figure 59:
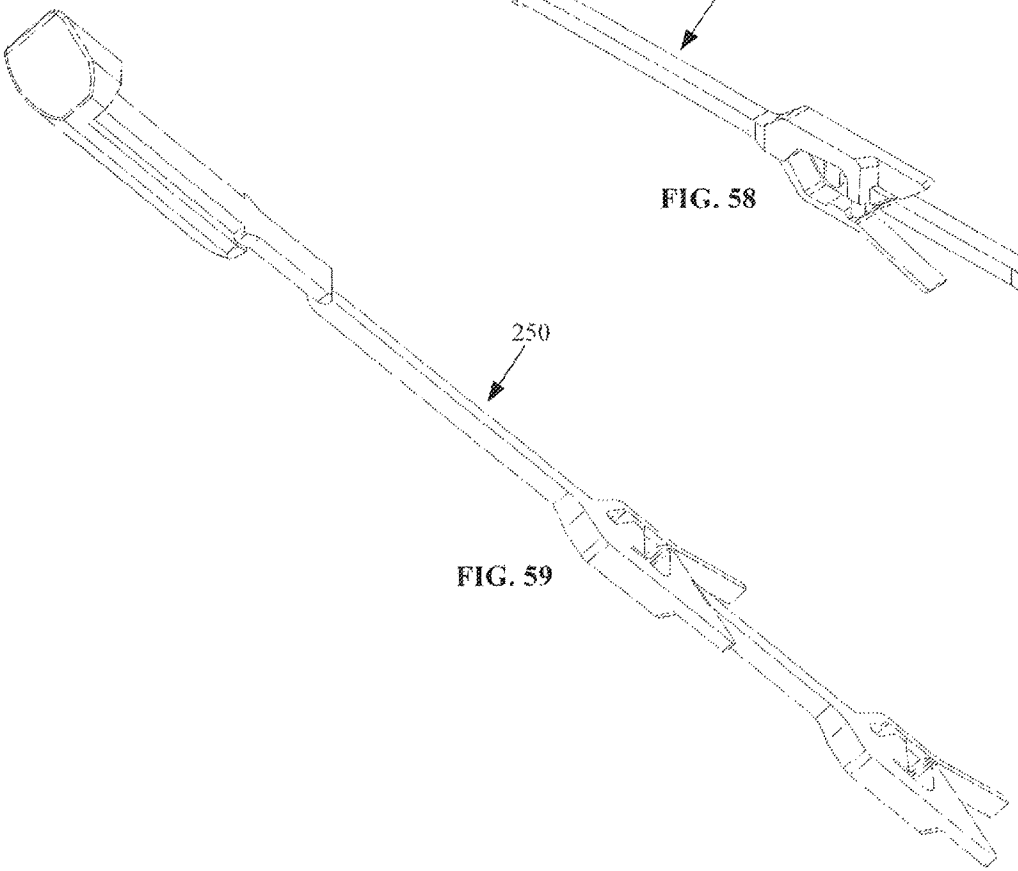
FIG. 59 is a fourth perspective view of the latch member of the latch assembly of FIG. 1A.
Figure 127A:
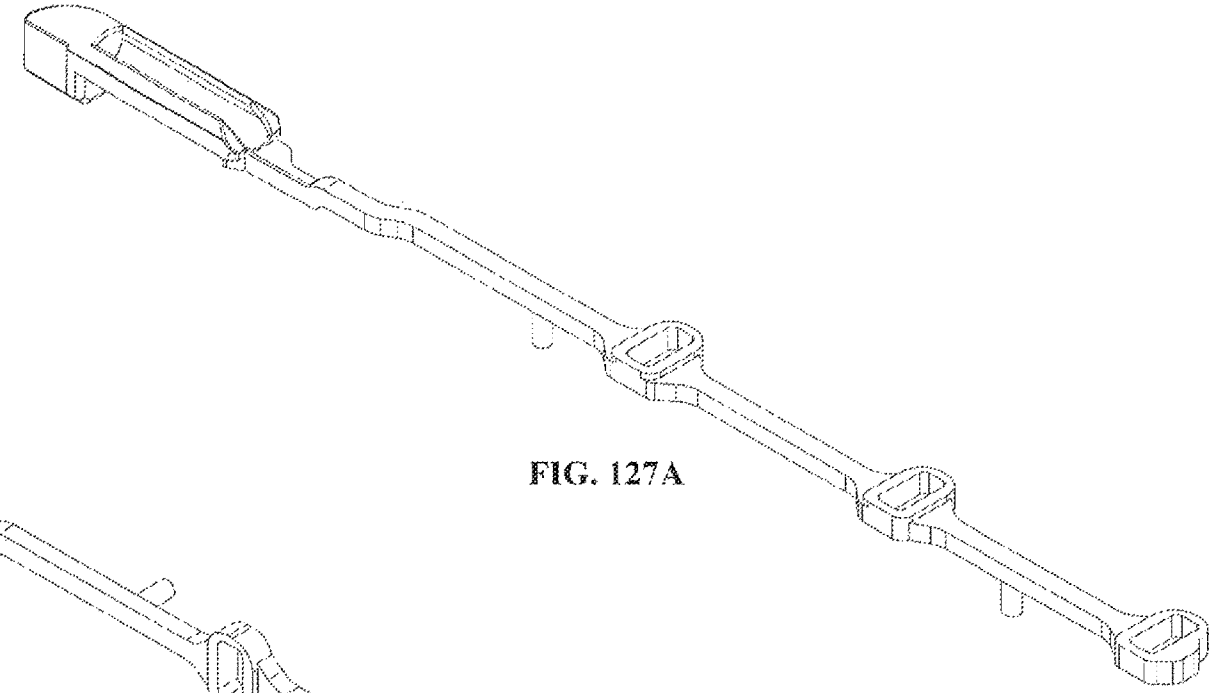

FIG. 127A is a side perspective view of an alternate embodiment of the latch member shown in FIG. 56.

Figure 127B:
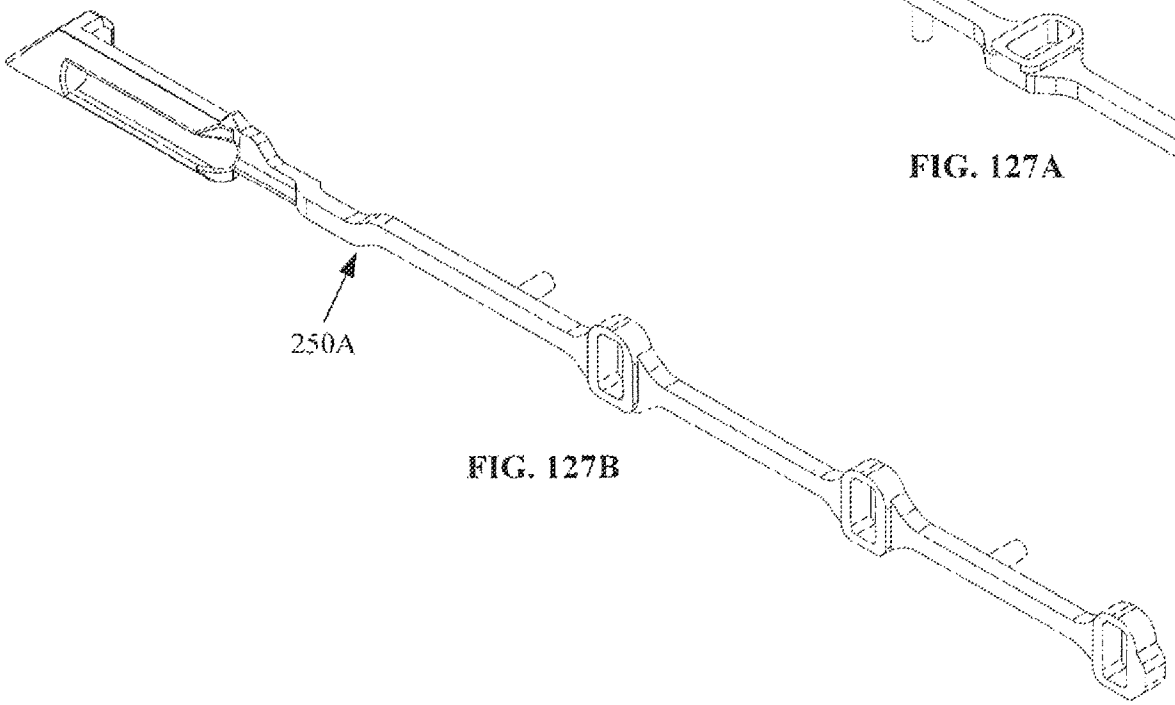

FIG. 127B is a top perspective view of the latch member shown in FIG. 127A.

Figure 63:
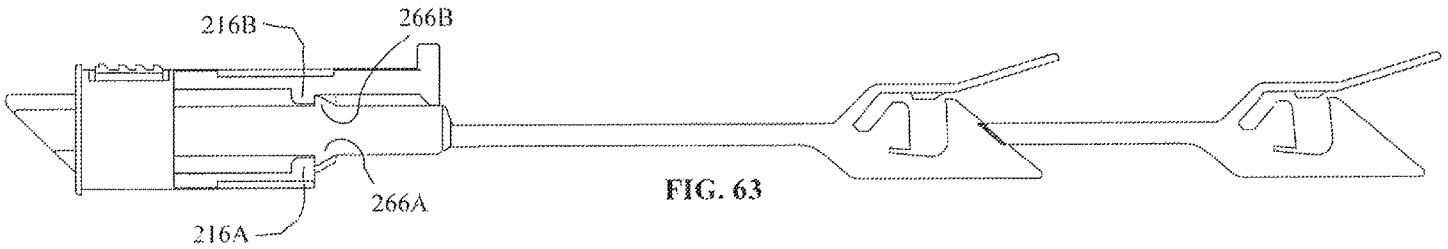
FIG. 63 is a side view of the latch assembly formed by the parts shown in FIG. 62.
Figure 64:
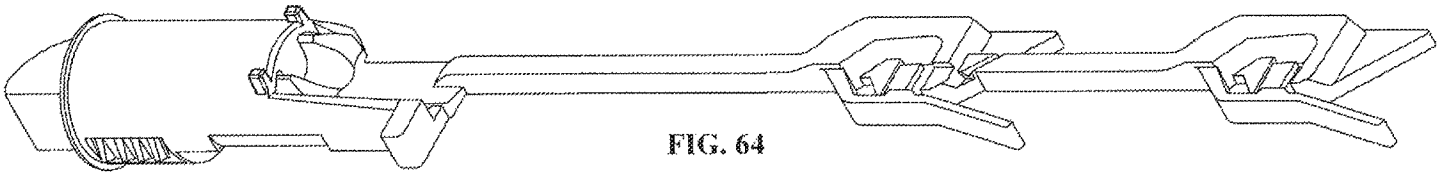
FIG. 64 is a perspective view of the latch assembly of FIG. 63, shown with the tongue biased into the extended position.
Figure 128A:
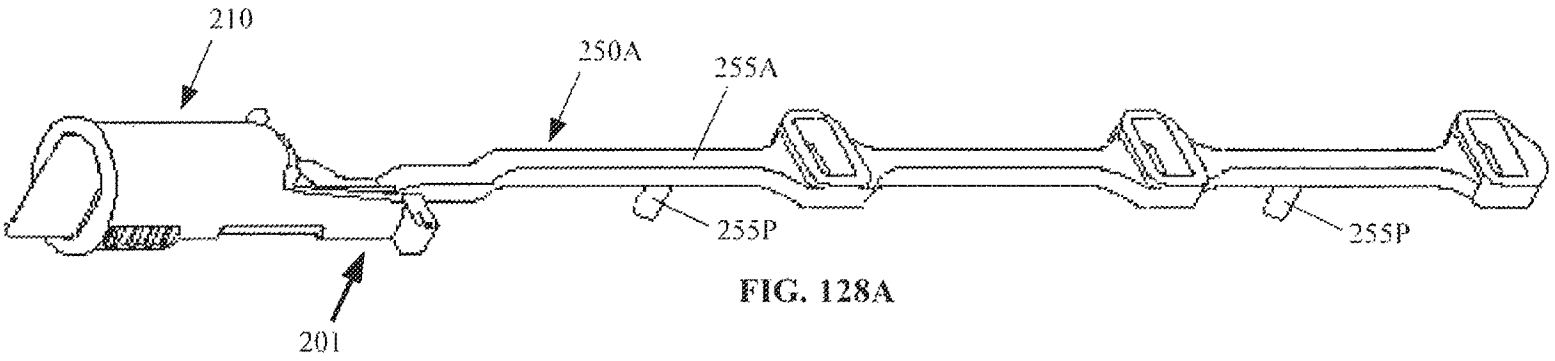

FIG. 128A is a perspective view of an alternate embodiment of the latch assembly of FIG. 63, which use the latch member shown in FIG. 127A.

Figure 128B:
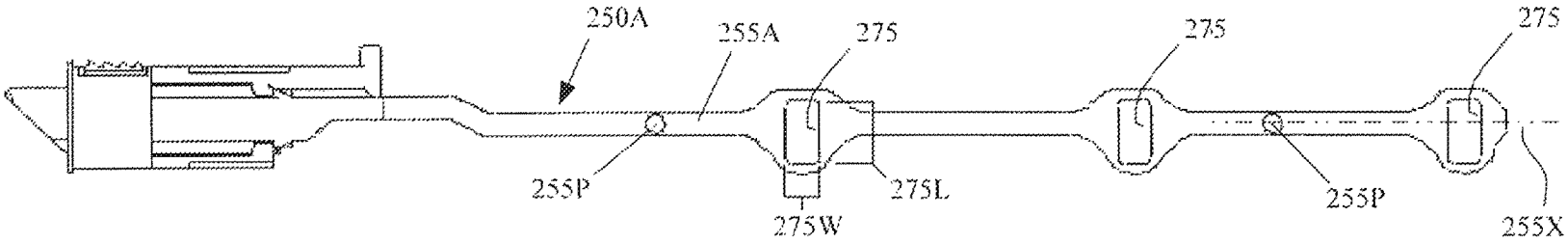

FIG. 128B is a top view of the latch assembly of FIG. 128A.

Figure 39:
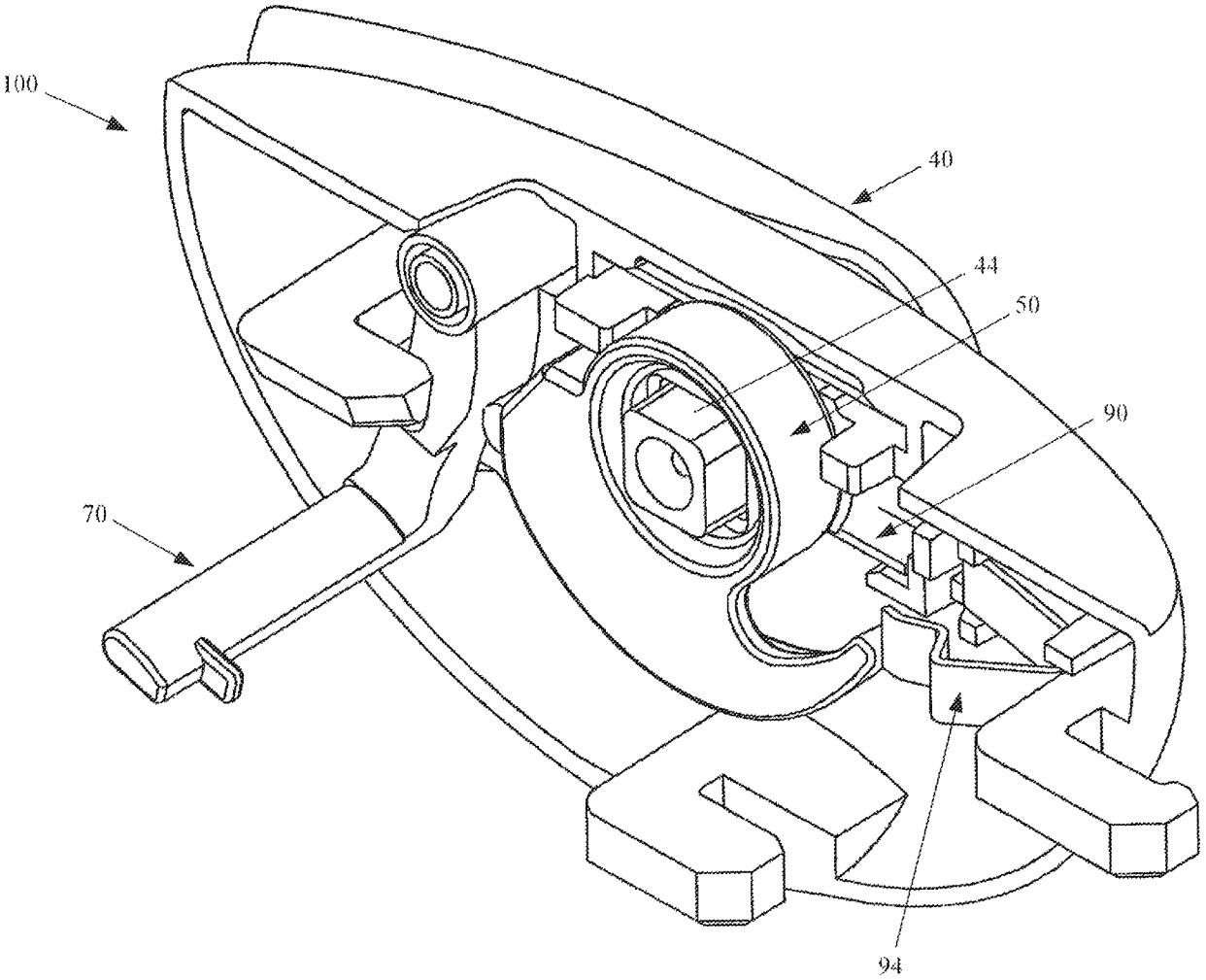
FIG. 39 is a bottom perspective view of the sash lock assembly of FIG. 1A.
Figure 129:
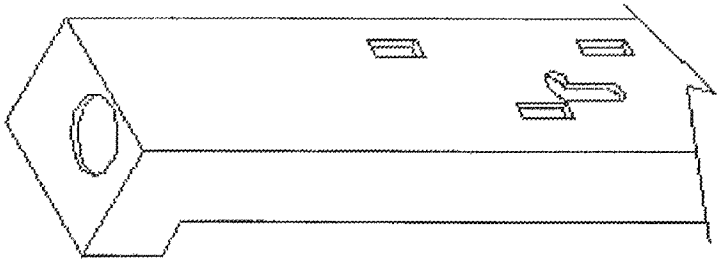

FIG. 129 is a perspective view showing a series of suitable openings in the meeting rail, for use in mounting the lock assembly of FIG. 39 thereon, in cooperation with the latch assembly of FIG. 127A.

Figure 130:
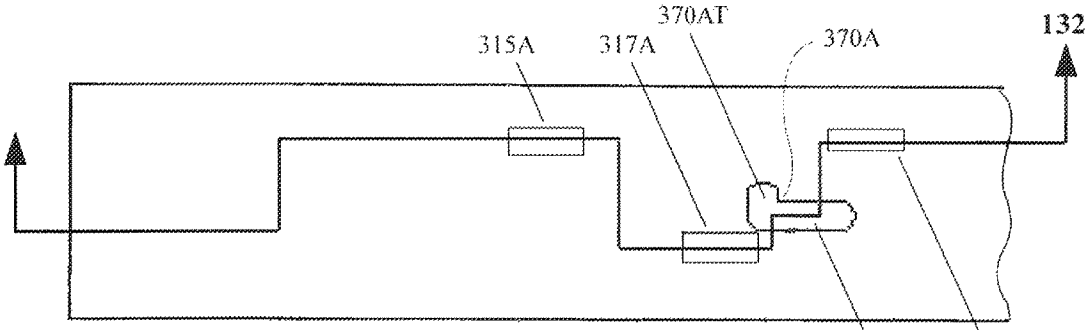

FIG. 130 is a top view of the meeting rail openings shown in FIG. 129.

Figure 131:
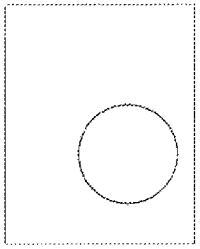

FIG. 131 is an end view of the meeting rail of FIG. 130.

Figure 132:
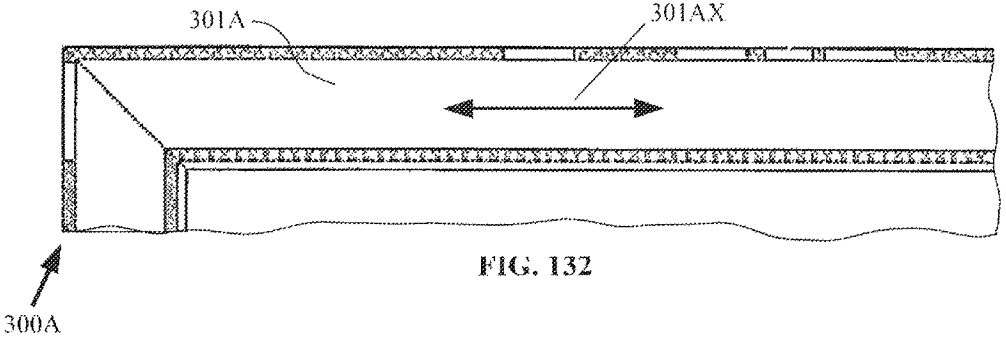

FIG. 132 is a cross-sectional view through the meeting rail openings of FIG. 130.

Figure 133:
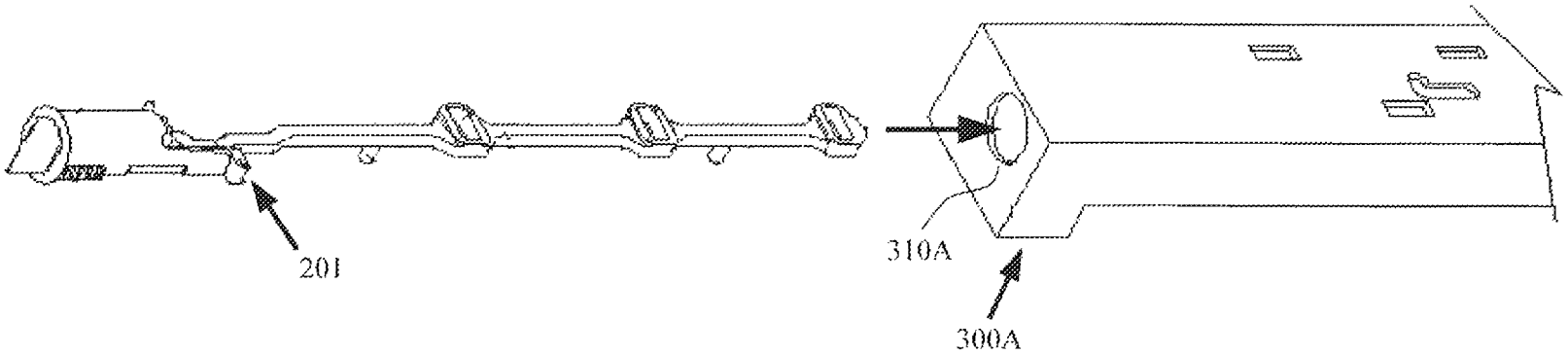

FIG. 133 is a perspective view illustrating the latch assembly of FIG. 127A prior to being receiving through an opening in the side of the sash window frame.

Figure 134:
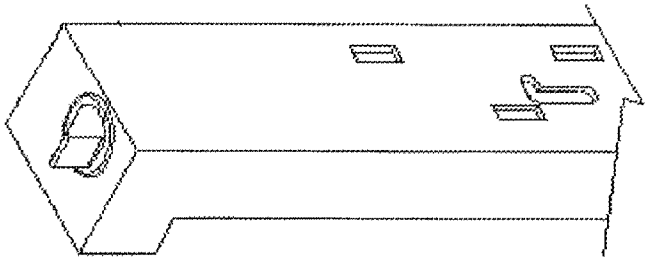

FIG. 134 is a perspective view showing the meeting rail of FIG. 129, after receiving the latch assembly of FIG. 127A therein.

Figure 135:
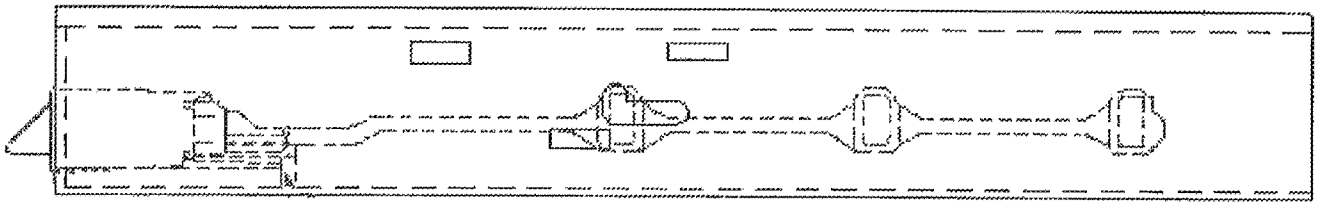

FIG. 135 is a top view of the meeting rail with latch assembly, as seen in FIG. 134.

Figure 136:
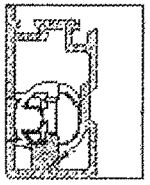

FIG. 136 is an end view of the meeting rail with latch assembly, as seen in FIG. 134.

Figure 137:
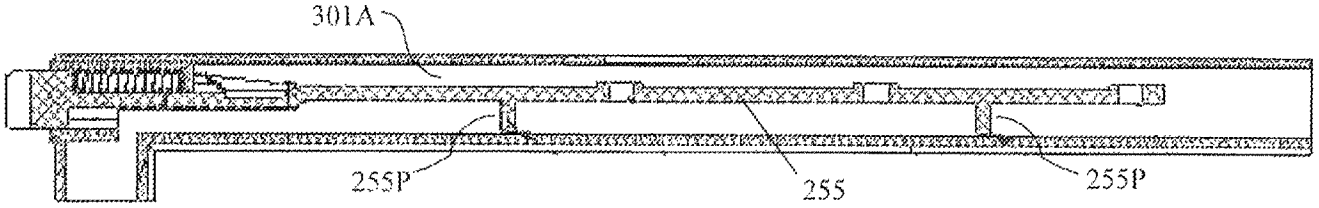

FIG. 137 is a side view of the meeting rail with latch assembly, as seen in FIG. 134.

Figure 138:
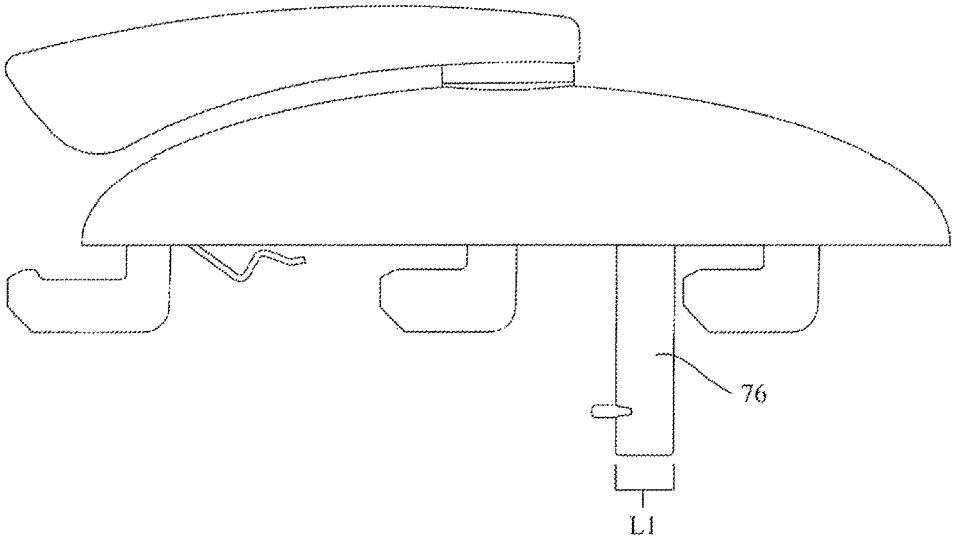

FIG. 138 is an enlarged side view of the lock assembly of FIG. 39.

Figure 139:
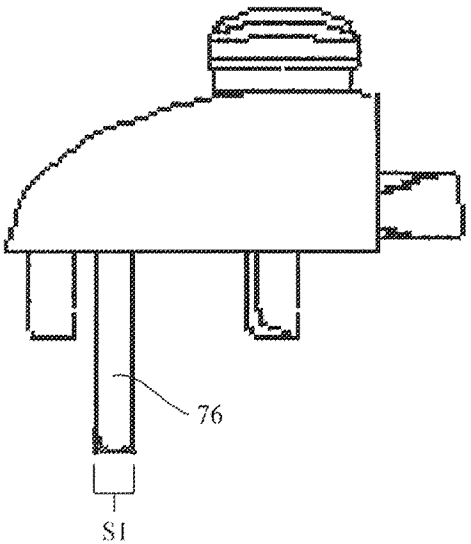

FIG. 139 is an enlarged side view of the lock assembly of FIG. 39.

Figure 140:
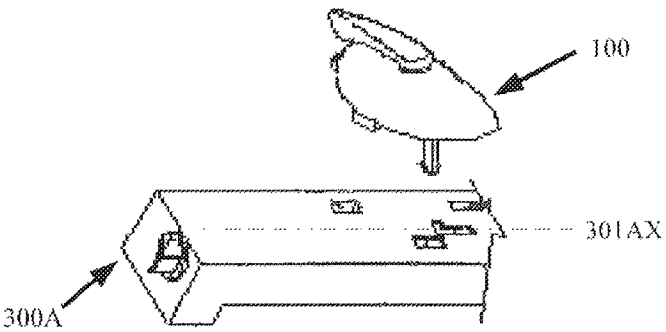

FIG. 140 is the perspective view of the meeting rail of FIG. 134, shown with the lock assembly at an initial position being just prior to it being coupled thereto.

FIG. 141 shows a side view of the meeting rail and lock assembly of FIG. 140, after the post of the lock assembly has been inserted into the corresponding opening in the top of the meeting rail, and through the opening in the beam of the latch member.

FIG. 141A is a top view of the opening in the beam of the latch member of FIG. 141, with the post of the lever arm received there-through.

FIG. 142 is the side view of FIG. 141, after the lock assembly has been pivoted roughly 90 degrees to orient the legs of the lock assembly housing to be aligned with, but laterally displaced from, the openings in the top of the meeting rail.

FIG. 142A is a top view of the opening in the beam of the latch member of FIG. 142, with the post of the lever arm shown rotated roughly 90 degrees with respect to the opening.

Figure 143:
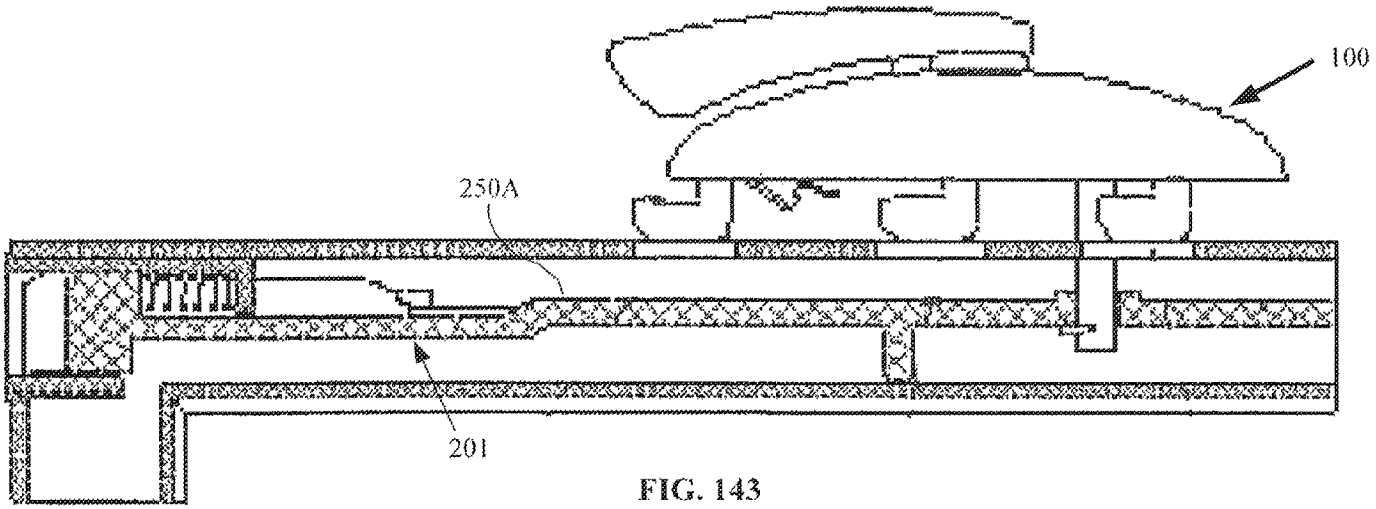

FIG. 143 is the side view of FIG. 142, after the lock assembly has been translated for the legs of the lock assembly housing to be adjacent to the openings in the top of the meeting rail.

Figure 144:
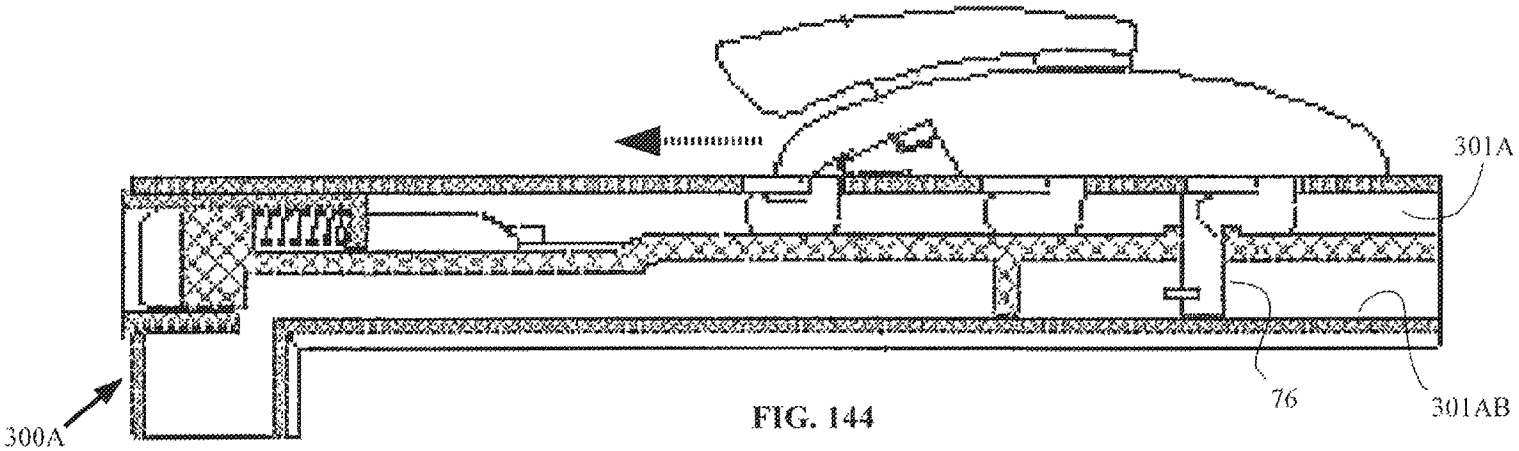

FIG. 144 is the side view of FIG. 143, after the legs of the lock assembly housing have been inserted through the openings in the top of the meeting rail.

Figure 145:
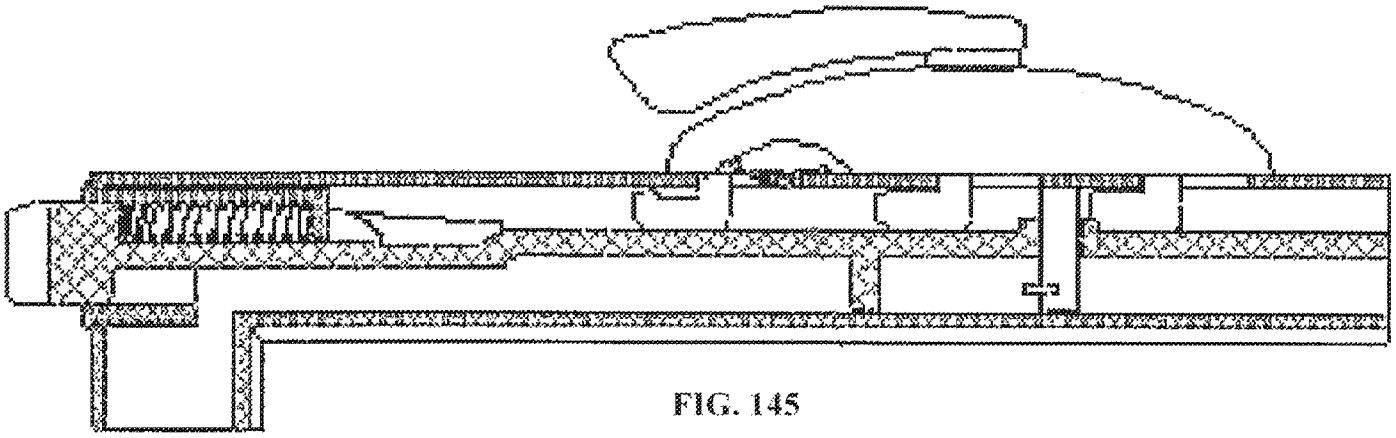

FIG. 145 is the side view of FIG. 144, after the lock assembly has been slid relative to the meeting rail, for the legs of the lock assembly to engage the openings in the top of the meeting rail.

Figure 146:
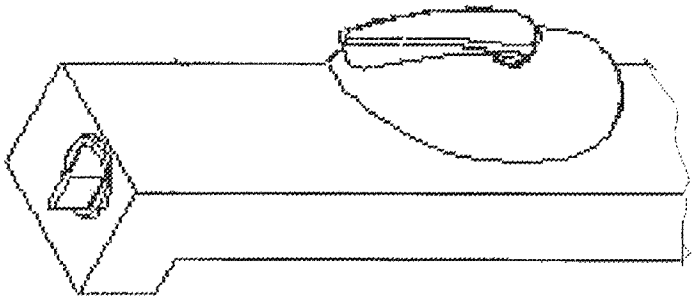

FIG. 146 is the perspective view of FIG. 134 showing the meeting rail of FIG. 129, after receiving the latch assembly of FIG. 127A therein, and after the lock assembly has also been mounted thereto.

DETAILED DESCRIPTION OF THE INVENTION

Figure 1A:
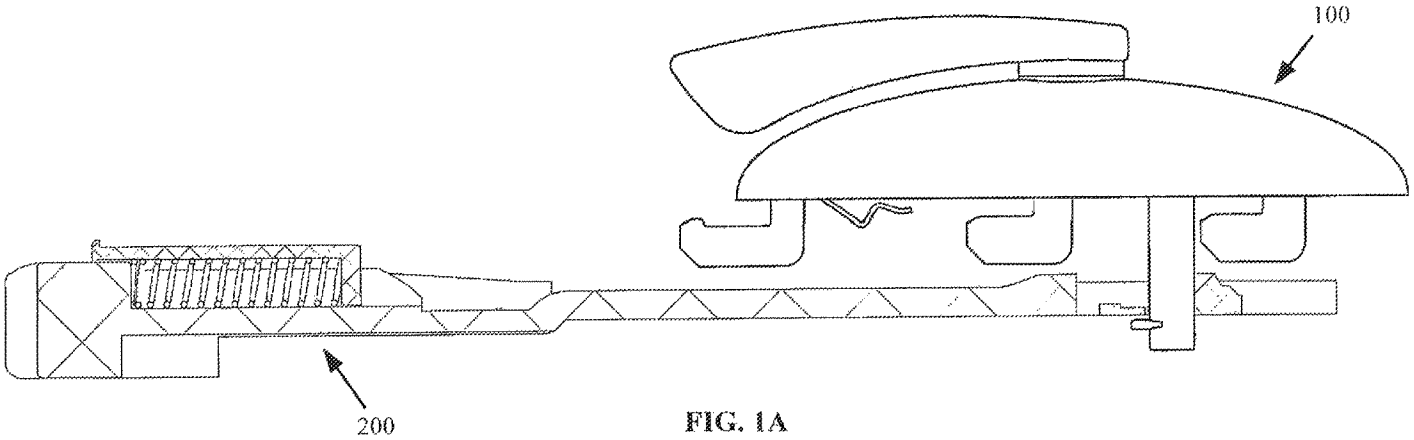
FIG. 1A is a cross-sectional side view of a left-handed version of the integrated sash lock/tilt latch fastener of the present invention.
Figure 1B:
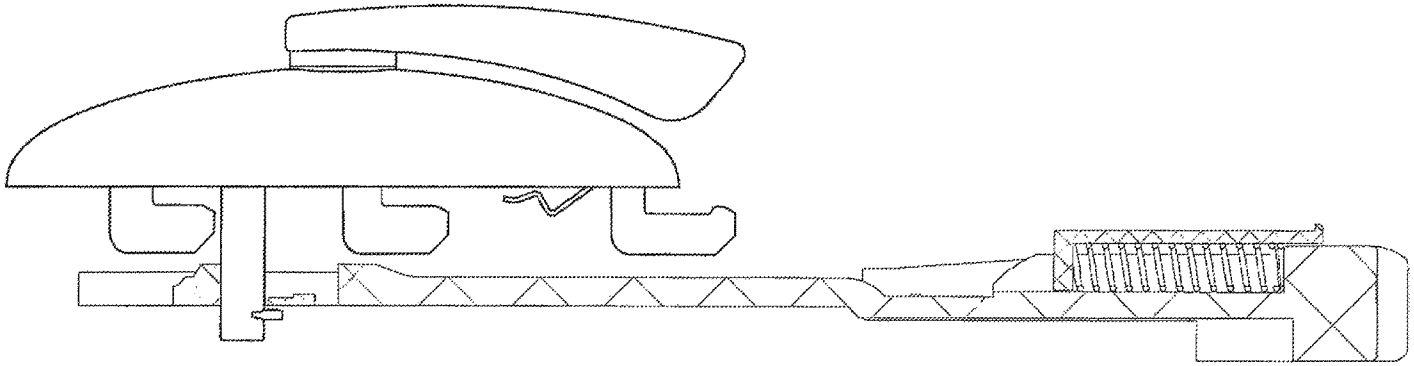
FIG. 1B is a cross-sectional side view of a right-handed version of the integrated sash lock/tilt latch fastener of FIG. 1A.

FIGS. 1A and 1B show a first embodiment of the present invention, in the form of a left-hand and a right-hand integrated sash lock/tilt latch fastener, either of which, or both of which may be used in the construction of a sash window. To simplify the presentation herein, since the right-hand version is a mirrored version of the left-hand fastener, being made up of mirror imaged parts, all discussions throughout this disclosure will be directed only to the left-hand fastener shown in FIG. 1A.

The integrated sash lock/tilt latch fastener of FIG. 1A may include a lock assembly 100, and a latch assembly 200, which may be blindly mated to the lock assembly during installation of each into the meeting rail of the sash window, an installation that may furthermore be accomplished without the use of screws or other mechanical fasteners.

Figure 3A:
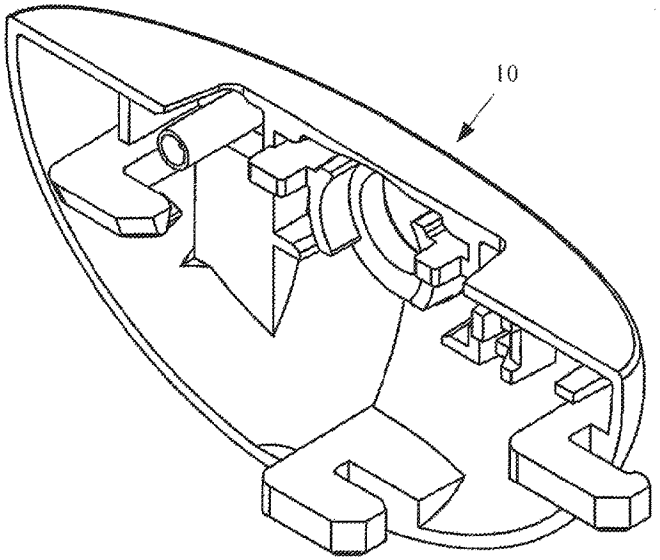
FIG. 3A is a first perspective view of the interior of the housing of the sash lock assembly of FIG. 1A.
Figure 2:
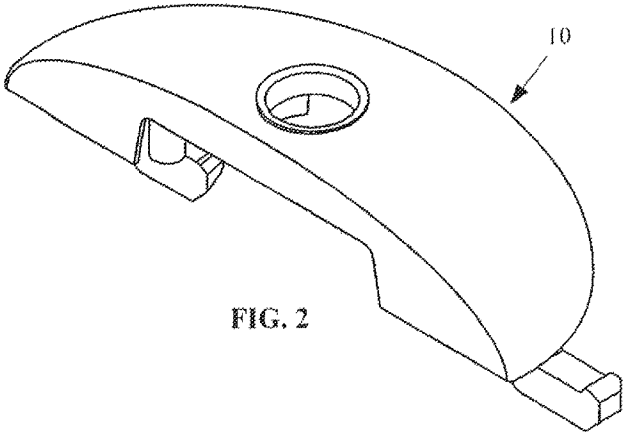
FIG. 2 is a top perspective view of the housing for the sash lock assembly of the integrated sash lock/tilt latch fastener of FIG. 1A.
Figure 3B:
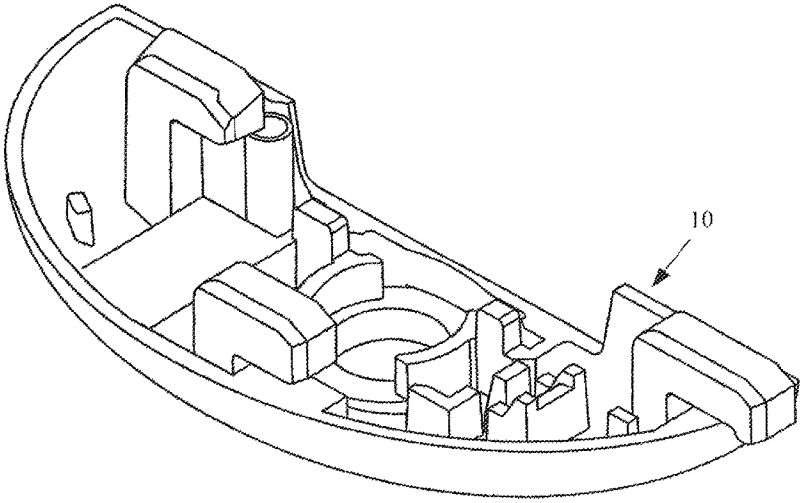
FIG. 3B is a second perspective view of the interior of the housing of the sash lock assembly of FIG. 1A.
Figure 6:
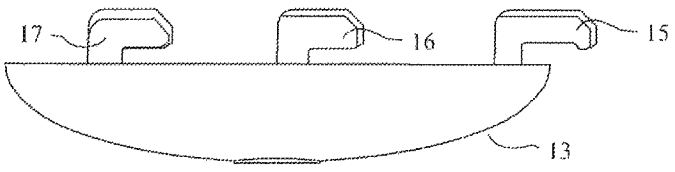
FIG. 6 is a rear view of the sash lock housing of FIG. 4.
Figure 5:
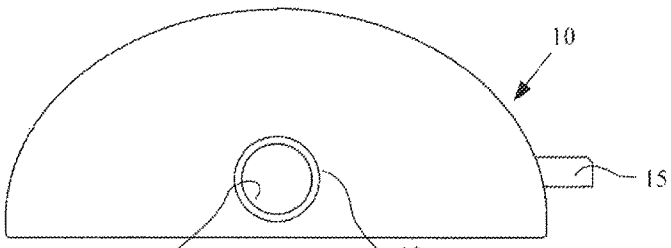
FIG. 5 is a top view of the sash lock housing of FIG. 4.
Figure 9:
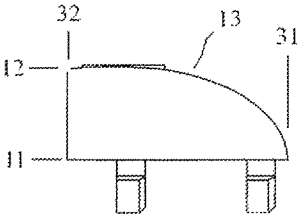
FIG. 9 is a second end view of the sash lock housing of FIG. 4.
Figure 8:
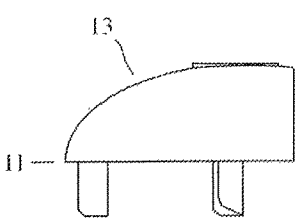
FIG. 8 is a first end view of the sash lock housing of FIG. 4.
Figure 10:
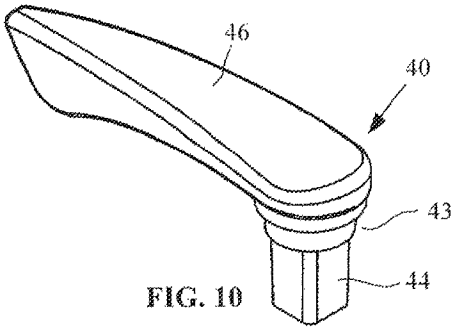
FIG. 10 is a perspective view of the shaft/handle member of the sash lock assembly of FIG. 1A.
Figure 11:
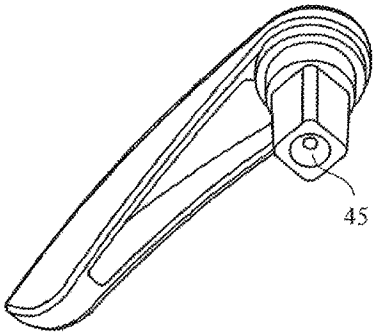
FIG. 11 is a second perspective view of the shaft/handle member of the sash lock assembly of FIG. 1A.
Figure 13:
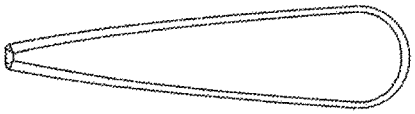
FIG. 13 is a top view of the shaft/handle member of FIG. 12.
Figure 12:
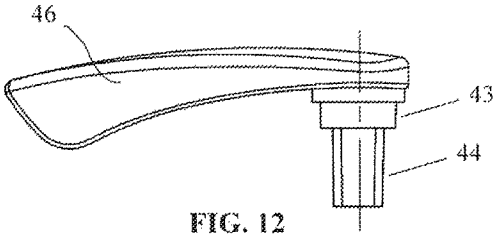
FIG. 12 is a front view of the shaft/handle member of FIG. 10.
Figure 14:
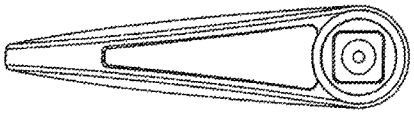
FIG. 14 is a bottom view of the shaft/handle member of FIG. 12.
Figure 15:
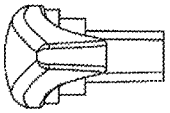
FIG. 15 is a first end view of the shaft/handle member of FIG. 12.
Figure 16:
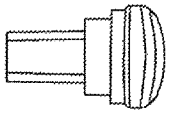
FIG. 16 is a second end view of the shaft/handle member of FIG. 12.
Figure 25:
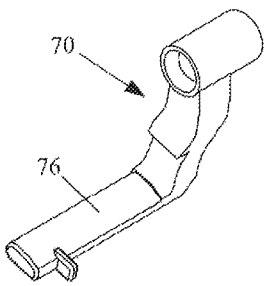
FIG. 25 is a perspective view of the lever arm of the sash lock assembly of FIG. 1A.
Figure 26:
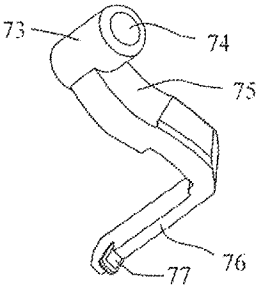
FIG. 26 is a second perspective view of the lever arm of the sash lock assembly of FIG. 1A.
Figure 31:
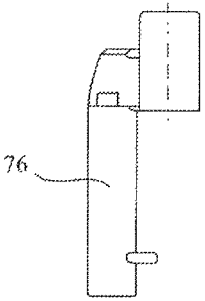
FIG. 31 is a front view of the lever arm of FIG. 27.
Figure 27:
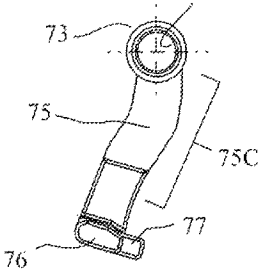
FIG. 27 is a top view of the lever arm of FIG. 25.
Figure 29:
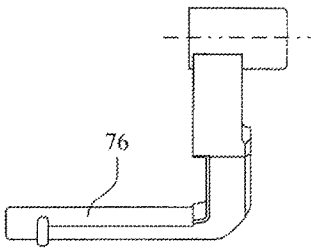
FIG. 29 is a second end view of the lever arm of FIG. 27.
Figure 28:
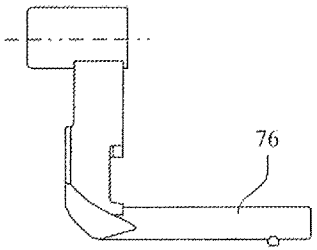
FIG. 28 is a first end view of the lever arm of FIG. 27.
Figure 32:
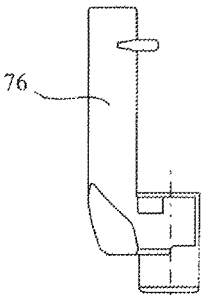
FIG. 32 is a rear view of the lever arm of FIG. 27.
Figure 30:
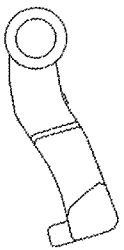
FIG. 30 is a bottom view of the lever arm of FIG. 27.
Figure 37:
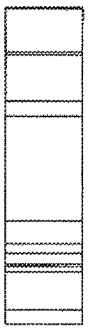
FIG. 37 is an end view of the engagement spring of FIG. 35.
Figure 36:
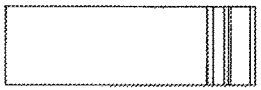
FIG. 36 is a top view of the engagement spring of FIG. 35.
Figure 35:
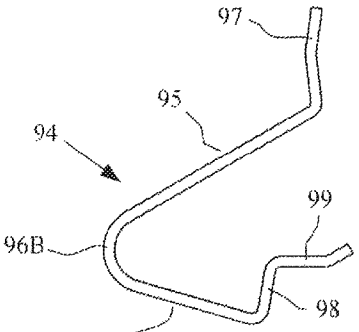
FIG. 35 is a front view of the engagement spring of FIG. 33.
Figure 34:
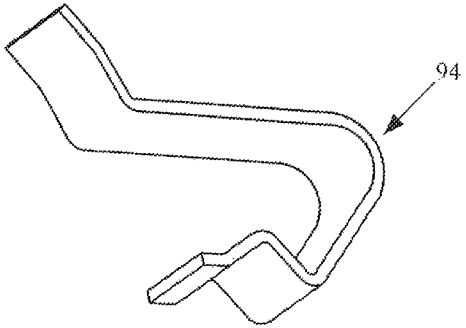
FIG. 34 is a second perspective view of the engagement spring of the sash lock assembly of FIG. 1A.
Figure 33:
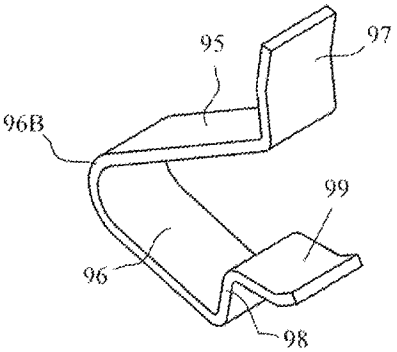
FIG. 33 is a perspective view of the engagement spring of the sash lock assembly of FIG. 1A.

Perspective views of the housing 10 of the sash lock assembly 100 are shown in FIGS. 2, 3A, and 3B, while corresponding orthogonal views are shown in FIGS. 4-9. The housing 10 is not limited to the shape illustrated within FIGS. 4-9, and could take on many different appropriate shapes, including a rectangular shape, an irregular shape, etc. However, the housing 10 may be desirably shaped to have a curved outer surface 13, which may generally appear semi-circular in the top view of FIG. 5, spanning from a first end 21 to second end 22, and may appear to be part elliptical in the end view of FIG. 9. The curvature of surface 13 may terminate at a generally flat bottom surface 11, and may curve upwardly to reach an apex 12 in FIG. 4. The curvature of surface 13 may also transition, as seen in FIG. 9, into a generally flat surface 32, at which a wall 33 may be formed. The housing 10 may be hollowed to form an interior surface 14, and the wall 33 may have an opening 34 into the interior cavity of the housing.

Figure 4:
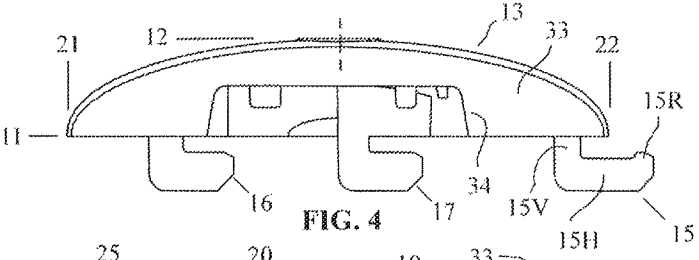
FIG. 4 is a front view of the sash lock housing of FIG. 2.
Figure 7:
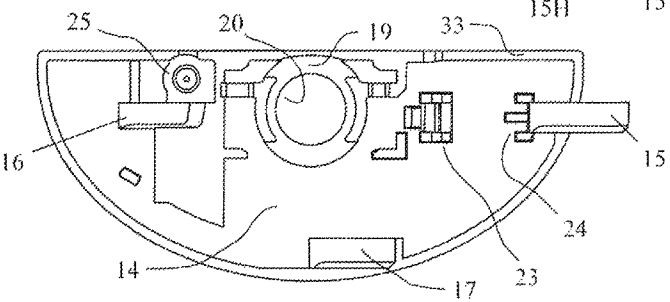
FIG. 7 is a bottom view of the sash lock housing of FIG. 4.

Extending outwardly from the bottom of the housing 10 may be one or more legs that may be used to secure the sash lock assembly 100 to the sash window. In one embodiment of the housing, one leg constructed according to the following description may suffice for releasably securing of the sash lock assembly 100 to the sash window. In the embodiment shown within FIGS. 4-9, three such legs may provide for more stable and secure mating of the sash lock housing 10 to the meeting rail. As seen in FIGS. 4 and 7, first, second, and third legs, 15, 16, and 17, respectively, may each protrude down from the cavity of the housing to extend beyond the extent of flat bottom surface 11. The first and second legs, 15 and 16, may be disposed in closer proximity to wall 33, while the third leg 17 may be disposed to be closer to the center of the semicircular housing base 31. The first leg 15 may be a hook-shaped leg, in that, as seen in FIG. 4, it may not only have a "vertical" portion 15V extending away from the interior surface 14, and a "horizontal" portion 1511 that extends laterally from the end of the vertical portion 15V, but it may also has a return flange 15R that extends from the end of the "horizontal" portion 1511 back towards the interior surface 14. The use of hooked leg 15 and legs 16 and 17 is discussed hereinafter with respect to installation of the sash lock assembly 100.

The housing 10 may have a cylindrical boss 18 extending upwardly from the outer surface 13, and may have a cylindrical boss 19 extending downwardly from the interior surface 14, into the housing cavity. Cylindrical boss 18 and cylindrical boss 19 may be generally coaxial, and may have a through hole 20 positioned therein. The hole 20 may be used for pivotal mounting of a shaft extending from the locking cam, or alternatively, the hole 20 may be used for pivotal mounting of a separate shaft/handle member, to which the locking cam may instead be fixedly secured.

In the embodiment illustrated herein, as seen in FIGS. 10-16, a shaft member 46 may have a cylindrical shaft 43, one end of which may have a keyed protrusion 44 extending therefrom, with an orifice therein. The other end of the shaft 43 may have a graspable handle portion that extends generally orthogonally with respect to the axis of shaft 43. The shaft 43 may be received through the hole 20 in the bosses 18 and 19 of the housing 10. The keyed protrusion 44 may be any suitable cross-sectional shape, and in this example, the keyed protrusion is formed using a rectangular cross-section.

The locking cam 50 illustrated in FIGS. 17-24 may have a cylindrical hub 53, with a keyed opening 54 that is shaped to match the keyed protrusion 44 of the shaft member 46. Extending laterally away from the hub 53 may be a wall 55, and extending away from both the hub 53 and the flat wall 55 may be a curved cam wall 56, that may be used to engage the key of the corresponding keeper, and to draw the sliding sash window in closer proximity to the master window frame (or other sash window for a double-hung arrangement). The curved cam wall 56 may have a curved protrusion 56P protruding laterally therefrom, which may be a semi-cylindrically shaped protrusion. The axis of the radial surface 56$P_R$ of the semi-cylindrical protrusion 56P may be substantially parallel to the axis of the keyed protrusion 44 of the shaft member 46.

Figure 38:
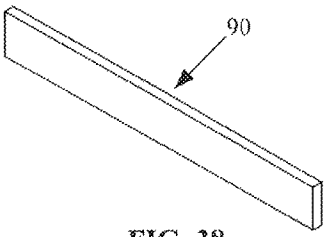
FIG. 38 is a perspective view of the detent spring of the sash lock assembly of FIG. 1A.

Protruding away from the hub 53 may be a cylindrical member 57, which may be generally concentric with the hub. The cylindrical member 57 may have a first flat SA formed thereon, and a second flat 58B formed thereon to be clocked 180 degrees away from the first flat 58A. The flats 58A and 58B may operate as a detent to releasably secure the cam 50, at a sash locked position and at a sash unlocked position, with respect to the leaf spring 90 shown in FIG. 38, discussed hereinafter. A third flat 59A may also be formed in the cylindrical member 57, as sea in FIG. 19, at a position that is clocked roughly 135 degrees from the first flat 58A. The flat 59A may also operate as a detent to releasably secure the cam 50 with respect to the leaf spring 90, at another sash unlocked position, which will be termed herein, with respect to the operation of the sash lock discussed hereinafter, as a first sash unlocked position. The sash unlocked position arising from the flat 58B will be referred to herein as the second sash unlocked position. For symmetry and greater stability of the cam being releasably retained at the first sash unlocked position, a fourth flat 59B may be positioned on the cylindrical member 57 at a position that is docked roughly 180 degrees from the third flat 59A, and may releasably engage a second leaf spring. Note that the flats could be formed on the cylindrical hub 53, instead of on the protruding cylindrical member 57.

Figure 41:
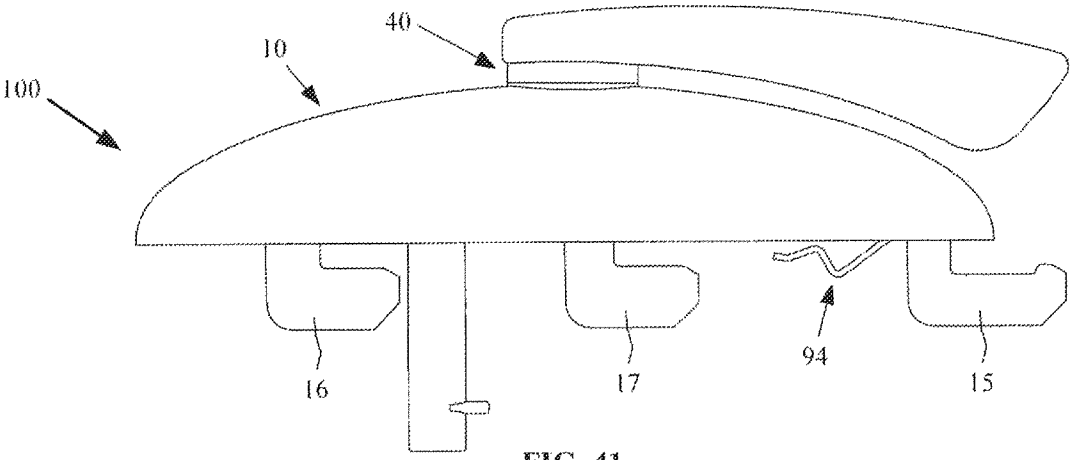
FIG. 41 is a front view of the sash lock assembly of FIG. 40.
Figure 40:
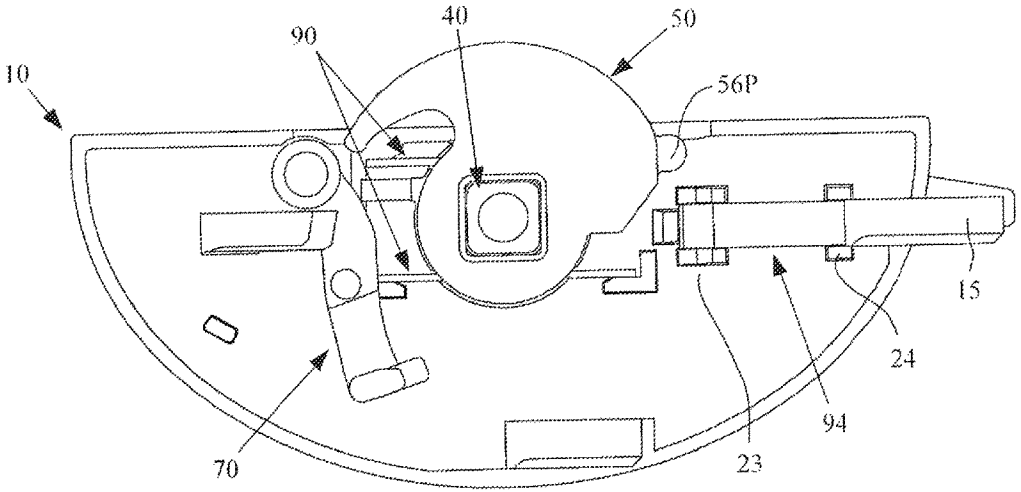
FIG. 40 is a bottom view of the sash lock assembly of FIG. 1A.

Assembly of the locking cam 50 and the shaft/handle member 46 into housing 10 may be seen in FIGS. 39-41. Prior to such assembly, the leaf spring 90, shown in FIG. 38, which may be a generally flat elongated flexible member, may be installed into the housing interior. The ends of leaf spring 90 may be fixedly received within a pair of corresponding recesses in the housing, using a friction fit, or adhesive, or mechanical fasteners, etc. As mentioned above, a second leaf spring 90' may be used, and may similarly be secured within the housing cavity, to be at a distance away from the first leaf spring that is roughly the same as the distance between the pair of flats 58A and 58B, which may be roughly the same as the distance between the pair of flats 59A and 59B. The cylindrical shaft 43 of the shaft/handle member 46 may then be pivotally received in hole 20 of housing 10, and the keyed protrusion 44 of the shaft member 46 may be received upon the keyed opening 54 of locking cam 50, and may be secured thereat using a friction fit, adhesive, mechanical fasteners, or by being welded thereto, of by using any combination of such suitable means of securing two parts together.

To accommodate screwless installation of the sash lock assembly 100 upon the meeting rail of the sliding sash window, an engagement spring 94 may be utilized in addition to the use of the first, second, and third legs (15, 16, and 17) of the sash lock housing. Engagement spring 94, as seen detailed in FIGS. 34-37, may have a first flange 95 and a second flange 96 that are flexibly connected with a bend 96B therebetween. The first flexible flange 95 may have a mounting flange 97 extending therefrom. The second flexible flange 96 may have a double-legged bend formed thereon to be distal from bend 96B, and may be formed by leg 98 being at an angle with respect to flange 96, and by a second leg 99 being at an angle with respect to the first leg 98. The legs 98 and 99 may create a V-shaped notch that may be used for installation of the sash lock assembly 100 upon the meeting rail of the sliding sash window, as discussed hereinafter. The engagement spring 94 may be installed into the housing 10, as seen in FIGS. 40-41, with the mounting flange 97 of the spring being fixedly received within a recess in a protrusion 23 (FIG. 7) that protrudes out from the interior surface 14 of housing. The end of flange 95 of the engagement spring 94 that is proximate to bend 96B may be supported by another protrusion 24 that protrudes out from the interior surface 14 of housing.

Interaction between the sash lock assembly 100, once installed upon the meeting rail of the sliding sash window, with the latch assembly 200, may be through the use of a lever arm 70 that may be pivotally mounted to the housing 10. The lever arm 70 is seen detailed within FIGS. 25-32. Lever arm 70 may include a hub 73, with a generally concentric mourning hole 74 therein. Extending laterally away from the axis of the hub 73 may be an arm 75, which may have a curved surface 75C that is selectively shaped to be driven by the semi-cylindrical protrusion 56P of the locking can 50, as discussed hereinafter. The arm 75 may transition into a post 76 that may be generally orthogonal to the arm 75 and may be generally parallel to the axis of the hub 73. A stop 77 may protrude from e pot 76. The housing 10, as seen in FIG. 7, may have a shaft 25 that protrudes out from the interior surface 14 of the housing. The mounting hole 74 of the hub 73 of the lever arm 70 may be pivotally received upon the shaft 25 of the housing. To pivotally secure the lever arm 70 thereto, the end of the shaft 25 may be bucked like a rivet, to form a manufactured head to prevent the lever arm from slipping off of the post. Alternatively, a screw or other mechanical fastener may be used for pivotally securing the hub 73 of the lever arm 70 to the housing 10.

Figure 42:
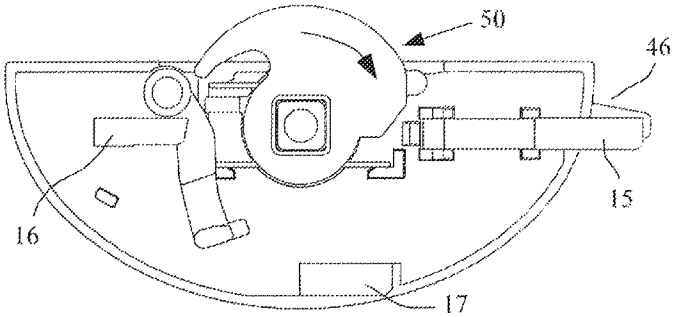
FIG. 42 is the bottom view of the sash lock assembly of FIG. 40, shown in a reduced size, and with the cam/shaft/handle combination shown in the locked and latched position.

The positions that the component parts of the sash lock assembly are capable of occupying is seen in FIGS. 42-45. In FIG. 42, the sash lock is shown in the locked position, with the locking cam being in the extended position where it would engage the key of a keeper to secure the sliding sash window from sliding within the track of the master window frame. Although it may not be seen therein, but may nonetheless be understood from viewing FIGS. 19 and 40, the flat 58A and flat 58B of the cylindrical member 57 on the hub 53 of locking cam 50 may respectively contact and be flush with the leaf springs 90 and 90'. This contact may serve to releasably restrain the locking cam 50 from rotating out of the locked position, without being deliberately moved therefrom.

Figure 43:
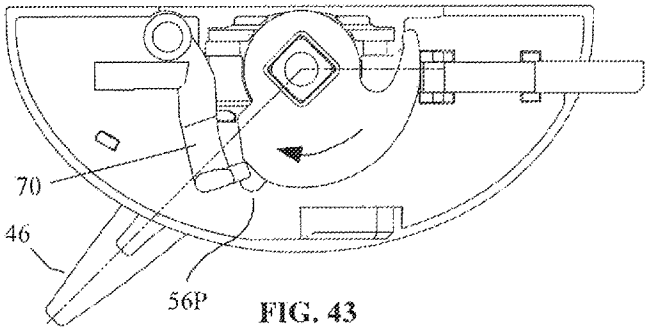
FIG. 43 is the bottom view of FIG. 42, but shown with the cam/handle combination shown in the unlocked and latched position.
Figure 49:
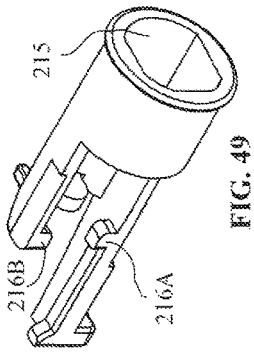
FIG. 49 is a fourth perspective view of the housing of the latch assembly of FIG. 1A.
Figure 48:
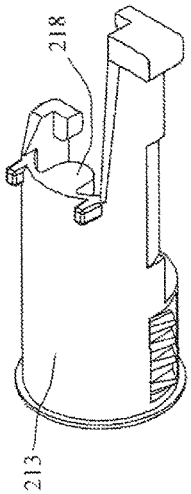
FIG. 48 is a third perspective view of the housing of the latch assembly of FIG. 1A.
Figure 46:
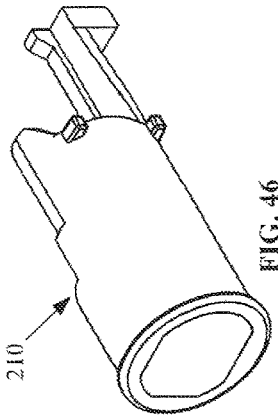
FIG. 46 is a first perspective view of the housing of the latch assembly of FIG. 1A.
Figure 47:
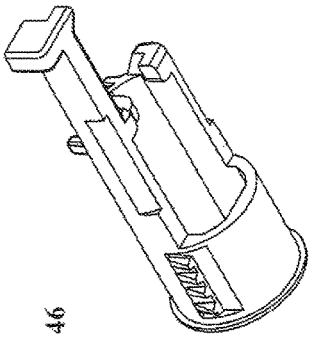
FIG. 47 is a second perspective view of the housing of the latch assembly of FIG. 1A.
Figure 54:
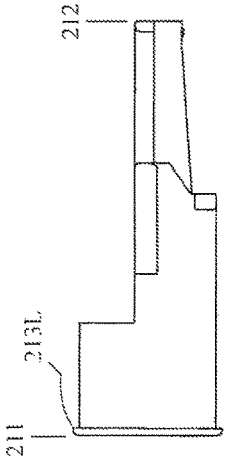
FIG. 54 is a top view of the latch housing of FIG. 50.
Figure 50:
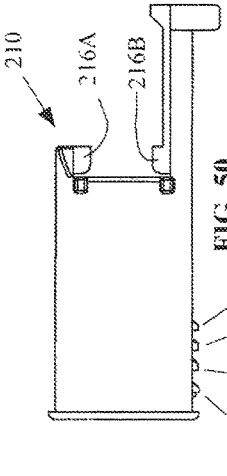
FIG. 50 is a front view of the latch housing of FIG. 46.
Figure 51:
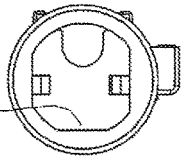
FIG. 51 is a first end view of the latch housing of FIG. 50.
Figure 52:
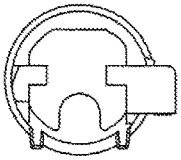
FIG. 52 is a second end view of the latch housing of FIG. 50.
Figure 53:
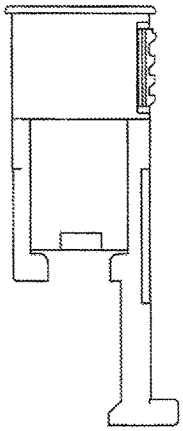
FIG. 53 is a rear view of the latch housing of FIG. 50.
Figure 55:
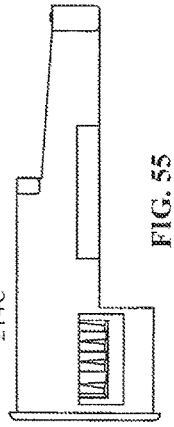
FIG. 55 is a bottom view of the latch housing of FIG. 50.

When the user wishes to unlock the sliding sash window to permit it to slide in the master window frame, the shaft/handle 40 may be rotated, to correspondingly rotate the locking cam, as shown by the arrow in FIG. 42, until reaching the first sash unlocked position (FIG. 43). The locking cam no longer protrudes out from the housing 10 to engage the keeper. Although it may not be seen therein, but may nonetheless be understood from viewing FIGS. 19 and 40, the flat 59A and flat 59B of the cylindrical member 57 on the hub 53 of locking cam 50 may now respectively contact and be flush with the flexible leaf springs 90 and 90' at this first unlocked position of the locking cam 50. (Note, to increase flexibility of the leaf springs 90 and 90', only one end of each spring may be fixedly mounted in the housing, or alternatively, both ends may be slidably mounted therein, to easily permit lateral deflection of the leaf springs, but without permitting them to become loosened or disconnected from proper positioning within the housing adjacent to the locking cam).

This contact may serve to releasably restrain the locking cam 50 from rotating out of the first unlocked position, without being deliberately moved therefrom. Note that since the angle at which the flats 58A/58B were clocked from the flats 59A/59B was approximately 135 degrees, the shaft/handle 40 will need to rotate approximately 135 degrees to actuate the sash lock assembly 100 from the locked position in FIG. 41 to the first unlocked position in FIG. 43. This is shown by the movement of the handle portion 46 of the shaft/handle 40 in both figures. It should also be noted that angular displacements other than 135 degrees are also possible, as long as the rotational movement is sufficient to move the locking cam far enough away from the keeper to permit sliding movement of the sash window, and although it may be desirable, the cam need not even be fully retracted within the housing 10.

When the user wishes to unlatch the sliding sash window to permit one end of it to pivot out from the master window frame and into the room for cleaning of the glazing, the she/handle 40 may be rotated to correspondingly rotate the locking cam, as shown by the arrow in FIG. 43, until reaching the second sash unlocked position (FIG. 44), which is also the unlatched position. At the second unlatched position, the locking cam is even further retracted into the housing 10. Although it may not be seen therein, but may nonetheless be understood from viewing FIGS. 19 and 40, the flat 58A and flat 58B of the cylindrical member 57 on the hub 53 of locking cam 50 may again contact and be flush with the leaf springs, but having now been rotated roughly 180 degrees, they may now respectively contact leaf springs 90' and 90 at this second unlocked position of the locking cam 50.

This contact may serve to releasably restrain the locking cam 50 from rotating out of the second unlocked position, without being deliberately moved therefrom. During this rotation of the locking cam 50 from the first unlocked position to the second unlocked position, being roughly 55 degrees, the semi-cylindrical protrusion 56P of the locking cam 50 contacts the arm 75 of locking the cam, and the continued contact of the protrusion along the curved surface 75C of the arm 75 during the 55 degrees of rotation drives the lever arm 70 to pivot, and to cause unlatching of the latch assembly, as discussed hereinafter.

Figure 44:
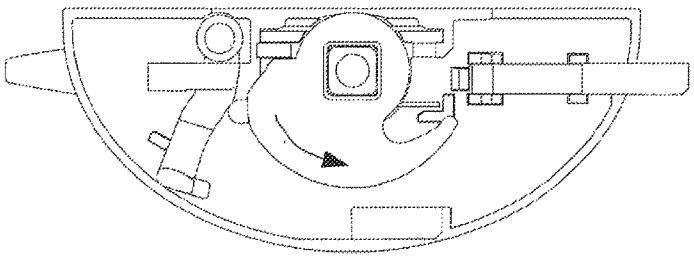
FIG. 44 is the bottom view of FIG. 43, but shown with the cam/shaft/handle combination shown in the sash unlocked and unlatched position.
Figure 45:
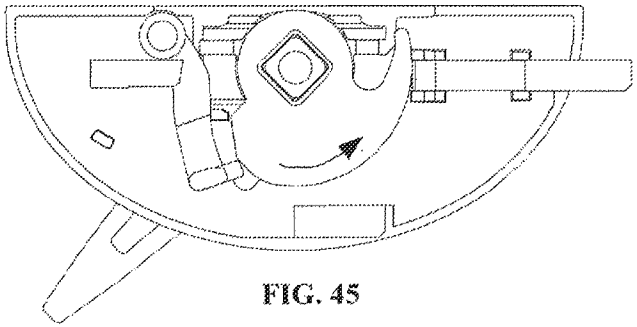
FIG. 45 is the bottom view of FIG. 44, but shown with the cam/shaft/handle combination counter-rotated back into the sash unlocked and latched position.

When the user has pivoted the sash window back into the master window frame, and seeks to latch the window therein, the shaft/handle 40 may be counter-rotated roughly 55 degrees to correspondingly counter-rotate the locking cam, as shown by the arrow in FIG. 44, until reaching the first sash unlocked position (FIG. 45). Thereafter, when the user has slid the window closed, and seeks to lock the lock assembly 100, he/she may further counter-rotate the shaft/handle 40 another 135 degrees to correspondingly counter-rotate the locking cam 50, as shown by the arrow in FIG. 45, until reaching the sash locked position (FIG. 42).

The latch assembly may include a latch member 250 and a biasing means (e.g., spring 291). Perspective views of the latch member 250 are shown in FIGS. 56-59, while corresponding orthogonal views are shown in FIGS. 60A-60F. The latch member 250 may extend from first end 251 to second end 252, and may include a tongue 253 that begins at the first end of the latch member and extends only part way to its second end. The tongue 253 may have a generally flat engagement surface 254E that may engage the track of the master window frame to prevent outward tilting of the sliding sash window, and it may also have an angled surface 254A that tapes toward the engagement surface 254E to create an apex. The angled surface 254A may be used, upon contact with the master window frame, to oppose the biasing of the latch member and temporarily drive it into a retracted position, until the tongue enters the track of the master window frame, and is biased into its extended position to have the engagement surface 254E re-engage the track. The tongue 253 may also have one stop 266A protruding therefrom (FIG. 63) or a pair of stops (266A and 266B).

Figures 60A, 60B, 60C, 60D, 60E, 60F:
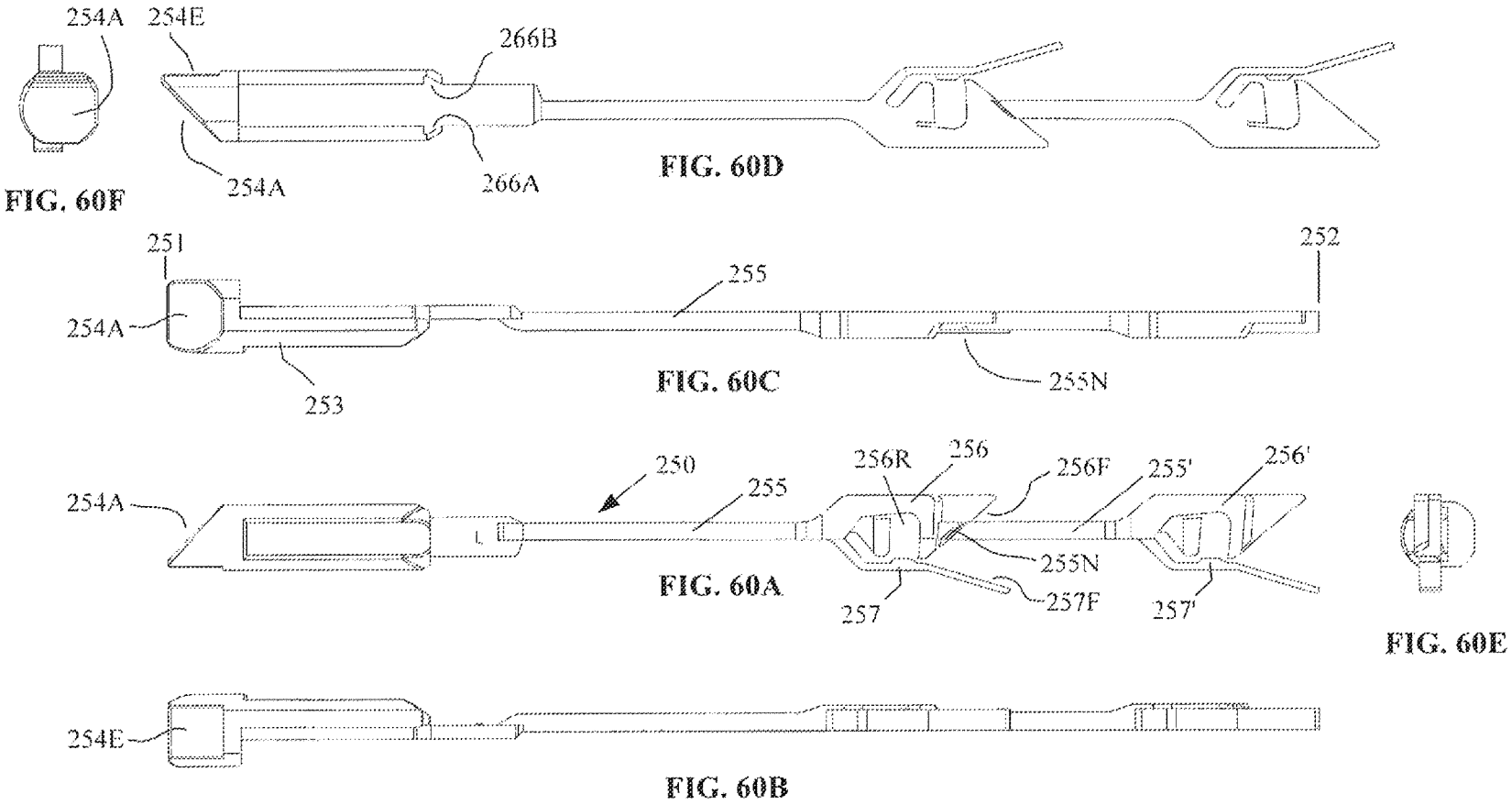
FIG. 60A is a front view of the latch member of FIG. 56, shown with a tongue, and with a dual beam and funnel members.
FIG. 60B is a bottom view of the latch member of FIG. 60A.
FIG. 60C is a top view of the latch member of FIG. 60A.
FIG. 60D is a rear view of the latch member of FIG. 60A.
FIG. 60E is a first end view of the latch member of FIG. 60A.
FIG. 60F is a second end view of the latch member of FIG. 60A.

Extending away from the tongue 253 may be an elongated beam 255 that is flexible, and which may terminate in a fixed funnel member 256 and a flexible funnel member 257. The periphery of the fixed funnel member 256 that is distal to its connection with the beam 255 may be shaped to form an angled funnel surface 256F, which may thereafter transition to form a curved recess 256R. The flexible funnel member may be formed with a periphery that, while the flexible funnel member is undeflected, will be generally disposed across the curved recess 256R of the fixed funnel member 256. The periphery of the flexible funnel member 257 that is distal to its connection with the beam 255 may also be shaped to form an angled funnel extension 257F, whereby the angled funnel surface 256F of the fixed funnel member 256, and the angled funnel surface 257F of the flexible funnel member form a V-shaped funnel arrangement, as seen in FIG. 60A. Although this formation of the latch member (see, e.g., FIG. 61) would be sufficient to enable its installation into the sliding sash window, and its co-action therein with the appropriately installed sash lock assembly 100, the latch member 250 shown in FIG. 60A may additionally include a secondary beam 255' that extends from the fixed funnel member 256 to be substantially in-line with the primary beam 255, and which also correspondingly has thereon a secondary fixed funnel member 256' and a secondary flexible funnel member 257'. This arrangement for latch member 250 may permit its use on two different window sizes.

Figure 61A:
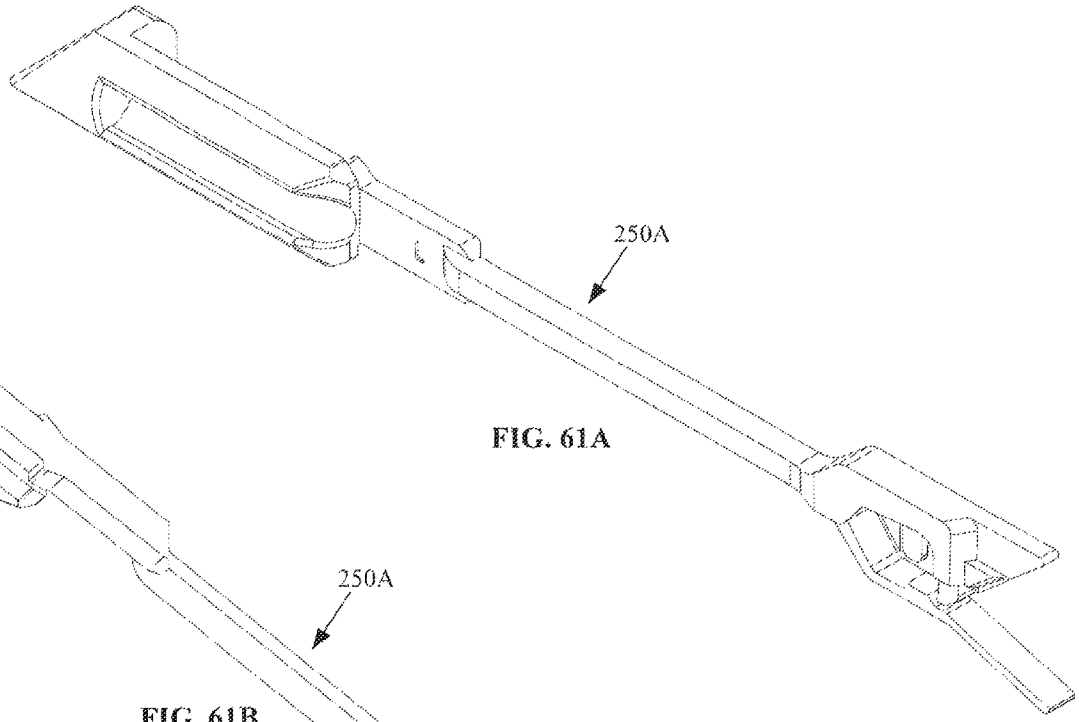
FIG. 61A is a first perspective view of the latch member of FIG. 56, but with one of the two sets of beams and funnel members having been removed therefrom for a length adjustment.
Figure 61B:
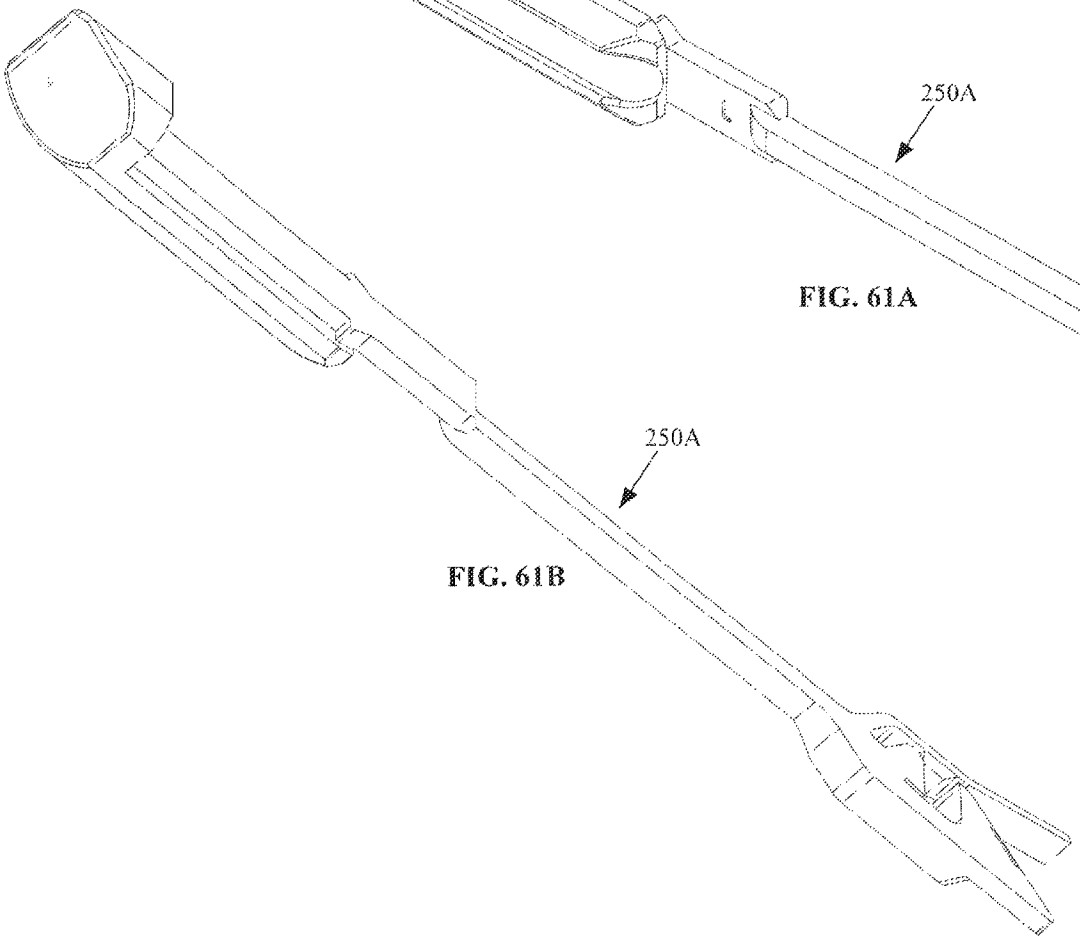
FIG. 61B is a second perspective view of the singular latch member of FIG. 61A.

For example, where the sash lock assembly 100 may desirably be located a greater distance away from the master window frame, in a somewhat larger sized window, the secondary fixed/flexible funnel members 256' and 257' may be utilized. However, the same latch member 250 may also be utilized where the sash lock assembly 100 may desirably be located at a position closer to the master window frame, in a somewhat smaller sized window, because the secondary beam 255' with its corresponding secondary fixed/flexible funnel member (256' and 257') may be severed from the primary fixed funnel member 256. Its ease of removal and severing therefrom may be accommodated by a notch 255N in the secondary beam 255' proximate to the first fixed funnel member, to permit a length modification. The notch may be recessed below the angled funnel surface 256F of the fixed funnel member 256 so that its removal would not affect proper operation of the funnel surface, which is discussed further hereinafter. FIGS. 61A and 61B shows the single latch member 250A with only its primary beam/funnel members, which may be originally formed as such, or may alternatively be formed by altering the dual beam/funnel members of latch member 250 through removal of the secondary members (255', 256', and 257').

The dual latch member 250 or the single latch member 250A may be installed through a suitable opening in the side of the meeting rail of the sliding sash window, and may be properly biased using a spring or other biasing means that may be installed therein as well. However, because of the increased complexity of the manufacturing operations necessary to produce the suitable opening in the meeting rail of the sliding sash window, it may be preferable to instead utilize a separate housing with the latch member. The latch housing member 210 may have a simple exterior surface, the complement of which can be easily formed (e.g., bored) into the rail of the sliding sash window, and permit ease of its installation therein.

Perspective views of the housing 210 of the latch assembly 200 are shown in FIGS. 46-49, while corresponding orthogonal views are shown in FIGS. 50-55. The housing 210 is not limited to the shape illustrated within FIGS. 50-55, and could take on many different appropriate shapes, including an elongated rectangular shape. However, the housing 210 may be desirably shaped to have a cylindrical outer surface 213, which may span from a first end 211 to second end 212. At the first end 211 of the housing 210, the cylindrical outer surface 213 may be formed into a protruding lip 213L. A portion of the cylindrical outer surface 213 may also have a series of successive teeth (214A, 214B, 214C, 214D) be formed thereon, for releasable securing of the housing within the hole that is bored/formed in the window rail. The housing 210 may be hollowed out to form an interior surface 215. Protruding upward from the interior surface 215 may be one stop 216A or a pair of stops (216A and 216B). A shaped wall 218 may protrude down to obstruct a portion of the hollowed out interior between the first end 211 and the second end 212.

The biasing of the latch member 250 relative to the housing 210 may be through the use of a suitably arranged tension spring, or by using a compression spring. For the sake of brevity, the figures herein only depict the embodiment where a compression spring is utilized.

Figure 62:
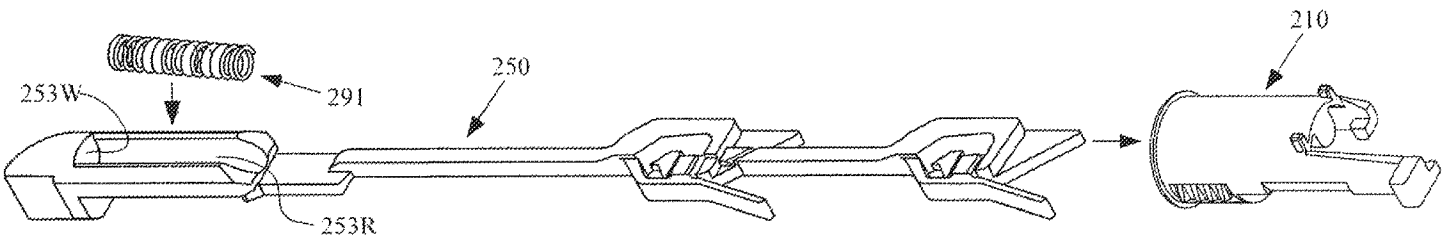
FIG. 62 is an exploded view of the parts of the latch assembly of the integrated sash lock/tilt latch fastener of FIG. 1A, including the latch housing, the latch member with two sets of beams and funnel members, and the biasing spring.
Figure 65:
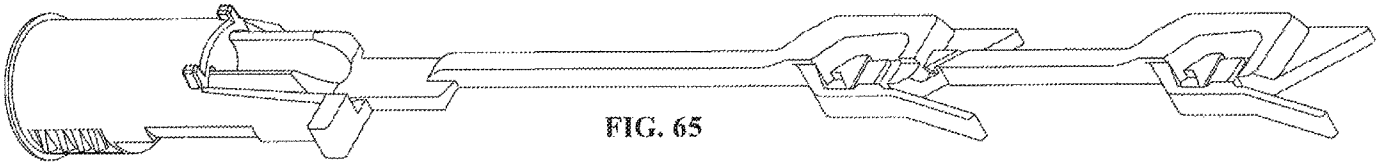
FIG. 65 is a perspective view of the latch assembly of FIG. 64, shown with the tongue in the retracted position.
Figure 74:
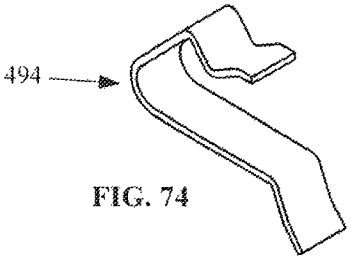
FIG. 74 is a perspective view of the engagement spring of the keeper.
Figure 76:
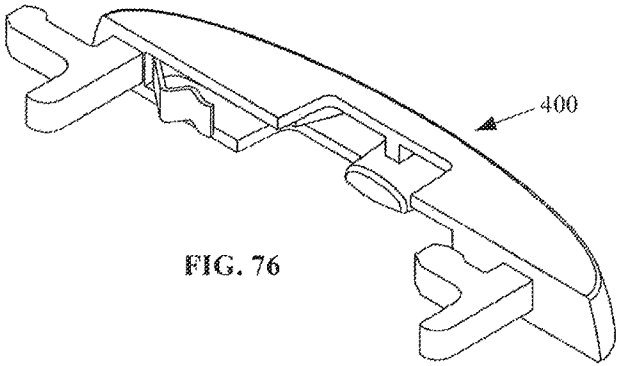
FIG. 76 is a first perspective view of the keeper of FIG. 75 and the engagement spring of FIG. 74, after being assembled together.
Figure 77:
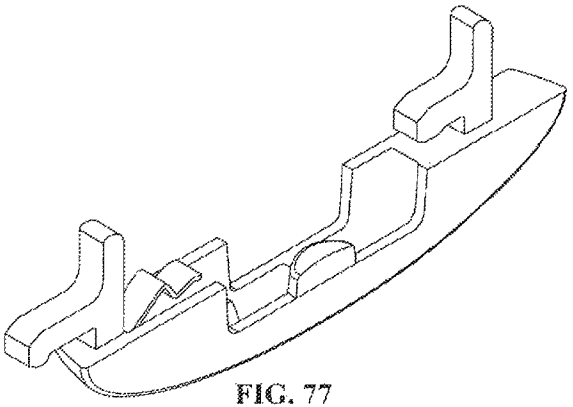
FIG. 77 is a second perspective view of the keeper and engagement spring assembly of FIG. 76.
Figure 75:
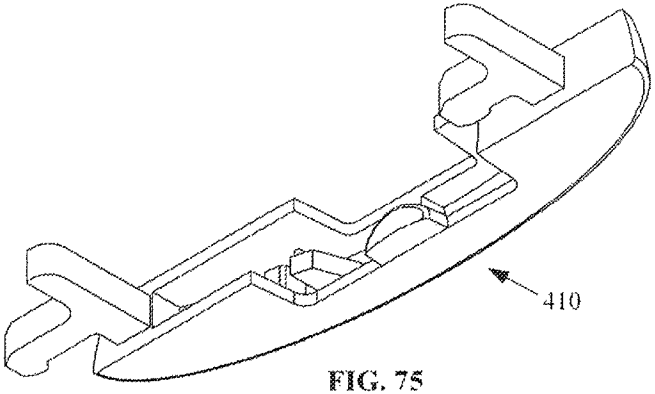
FIG. 75 is a bottom perspective view of the keeper of FIG. 66.
Figure 78:
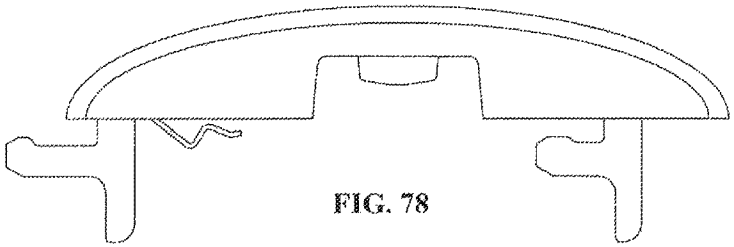
FIG. 78 is a front view of the keeper and engagement spring assembly of FIG. 76.
Figure 79:
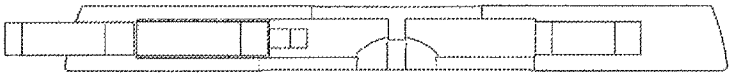
FIG. 79 is a bottom view of the keeper and engagement spring assembly of FIG. 78.
Figure 81:
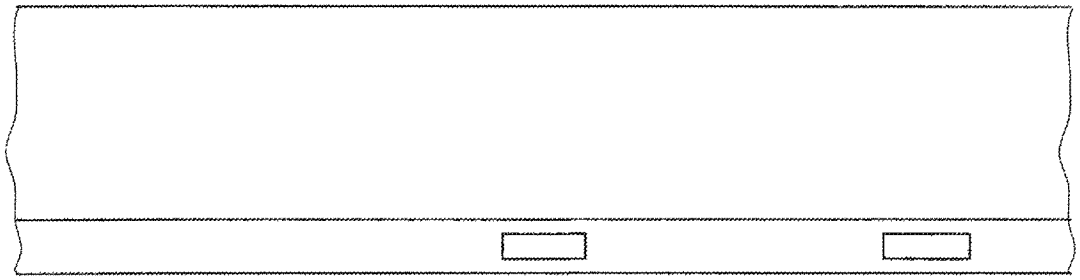
FIG. 81 is a top view of the window frame of FIG. 80.
Figure 82:
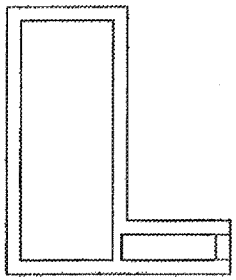
FIG. 82 is an end view of the window frame of FIG. 81.
Figure 83:
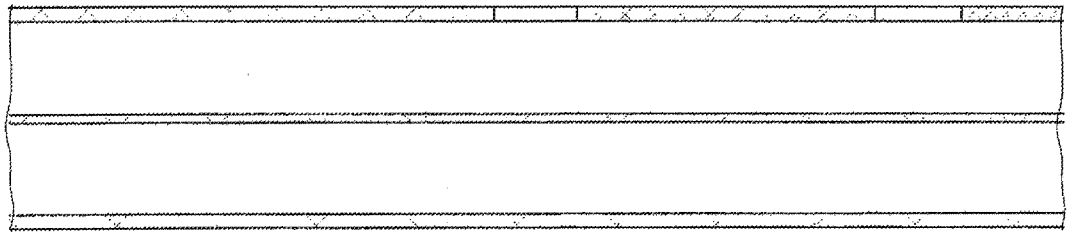
FIG. 83 is a bottom view of the window frame of FIG. 81.
Figure 80:
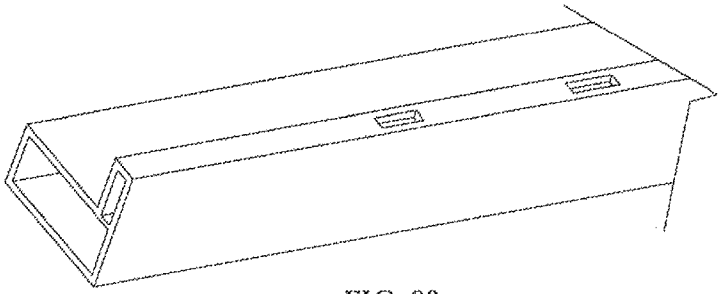
FIG. 80 is a perspective view of the master window frame (or fixed sash member or second sliding sash member) that is configured to releasably receive the keeper and engagement spring assembly of FIG. 76.
Figure 84:
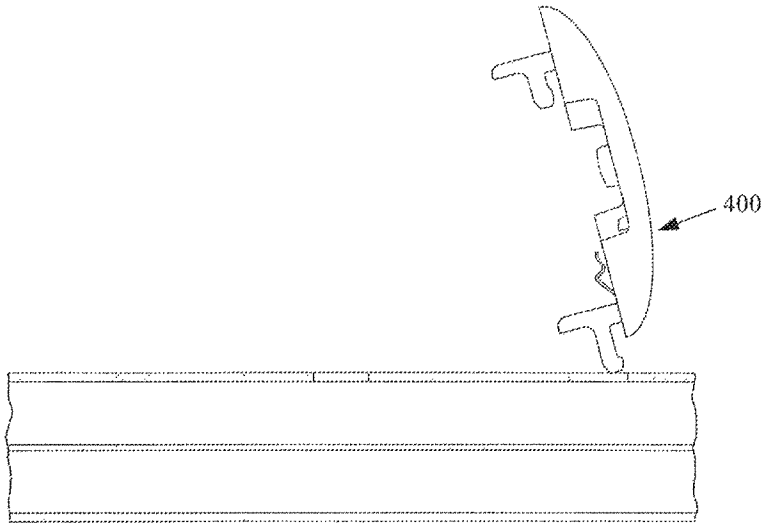
FIG. 84 is a side view illustrating insertion of the first hooked leg of the keeper and engagement spring assembly of FIG. 76, into a first corresponding opening in the window frame of FIG. 80.
Figure 86:
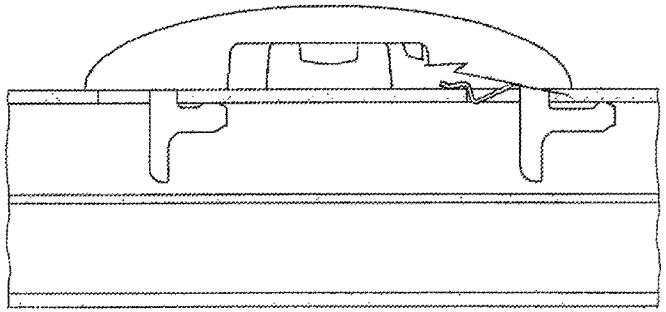
FIG. 86 is the side view of FIG. 85, after sliding of both the first hooked leg and the second hooked leg of the keeper assembly laterally within the corresponding openings in the window frame, and with the engagement spring engaging one of the openings to releasably secure the keeper to the window frame.
Figure 85:
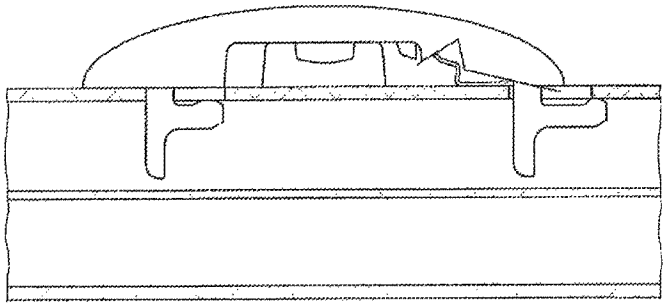
FIG. 85 is the side view of FIG. 85, after insertion of both the first hooked leg and the second leg of the keeper and engagement spring assembly of FIG. 76, into the corresponding openings in the window frame of FIG. 80.

The interior surface 215 of housing 210 may be contoured to receive the latch member 250 therein, in a slidable relation. Assembly of the helical compression spring 291 and the latch member 250 into the housing 210 is illustrated in FIG. 62. The helical spring 291 may be nested in a recess 253R of the tongue 253. One end of the spring may act upon the wall 253W of the tongue 253 (FIG. 62), while the other end of the compression spring may act upon the wall 218 of the housing 210 (FIG. 48), to bias a portion of the tongue, including its apex, to protrude out from the latch housing, as seen in FIG. 63. The extent that biasing by spring 291 may cause the tongue 253 to protrude out from the housing 210 may be limited by the stops 266A and 266B on the tongue contacting the stops 216A and 216B on the housing (FIG. 63). Actuation of the latch member 250 relative to the housing 210 may cause the apex of the tongue to retract within the hollow of the housing, as seen in FIG. 65.

Installation of the sash lock assembly 100 upon the sliding sash window 300 is illustrated within FIGS. 88-94. Sliding sash window 300 may have a horizontal meeting rail 301, a first vertical stile 302, a second stile (not shown) and a bottom rail (not shown), which may form a frame to support the glazing 305 therein. The meeting rail 301 and the stile 302 may each be generally hollow members. For the particular window shown in FIG. 89, the meeting rail 301 is shown to have a transition 301X at a 45 degree angle with the stile 302. Therefore, for the sash window illustrated in FIGS. 88-90, it may be accurate to state that the opening 310 may be formed in the vertical stile 302, rather than in the horizontal rail 301. However, it should be understood that the horizontal meeting rail could instead be configured to extent to the extreme side of the sash window, and that the vertical stile could abut the bottom of the meeting rail, in which case the opening 310 may be described as being in the meeting rail. Throughout this disclosure, the latch assembly is described as being installed in the stile, but that should be understood to mean that it could be either through an opening in the side of the vertical stile or through an opening in the end of the horizontal rail, depending upon how that joint is constructed.

Figure 89:
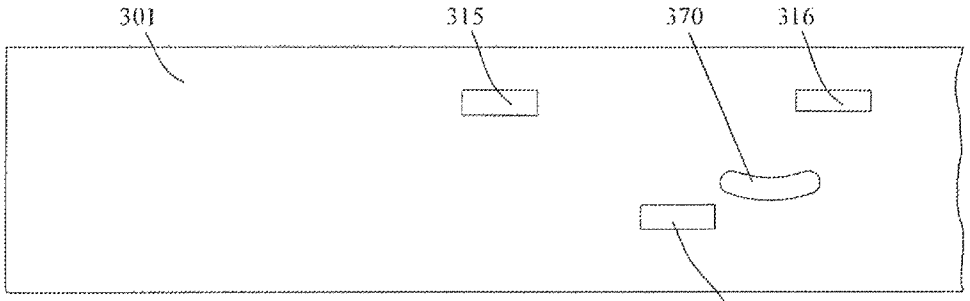
FIG. 89 is a top view of the sliding sash window frame of FIG. 88.
Figure 90:
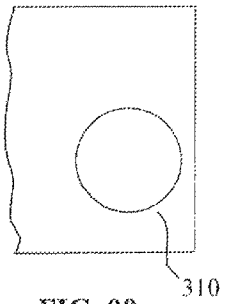
FIG. 90 is an end view of the sliding sash window frame of FIG. 89.
Figure 91:
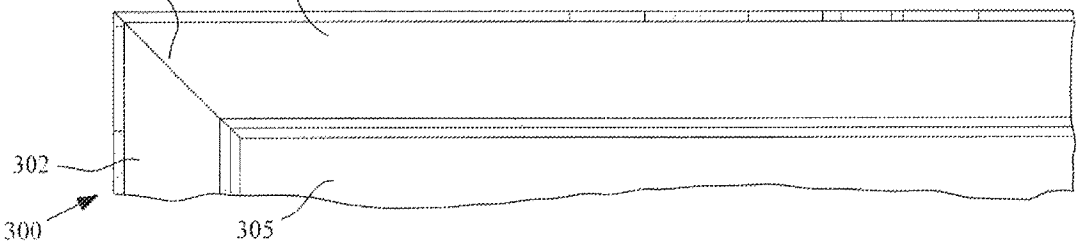
FIG. 91 is a bottom view of the sliding sash window frame of FIG. 89.
Figure 88:
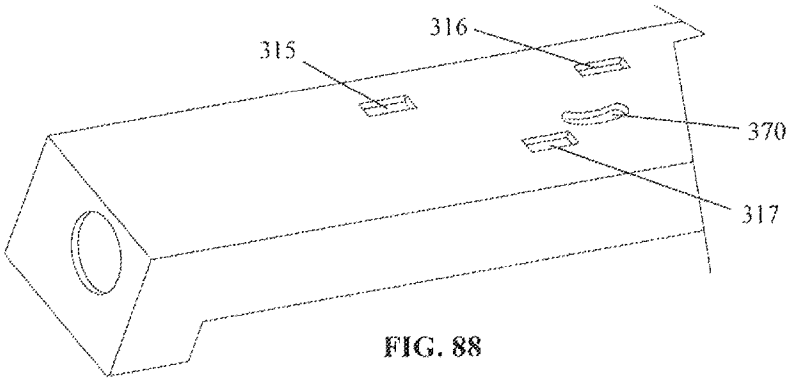
FIG. 88 is a perspective view of the frame of a sliding sash window configured to receive the integrated sash lock/tilt latch fastener of FIG. 1A.
Figure 93:
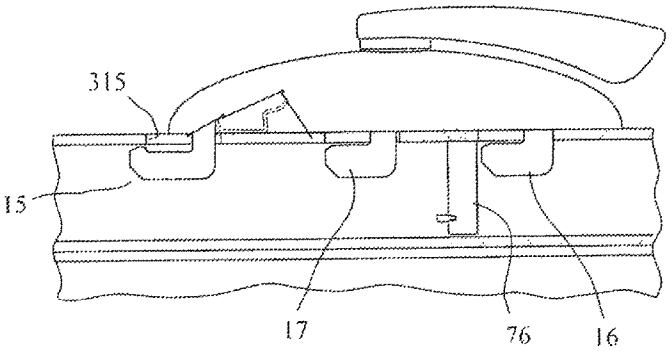
FIG. 93 is the side view of FIG. 92, after insertion of each of the first hooked leg, the second leg, and the third leg of the sash lock assembly into the corresponding openings in the sliding sash window frame.
Figure 92:
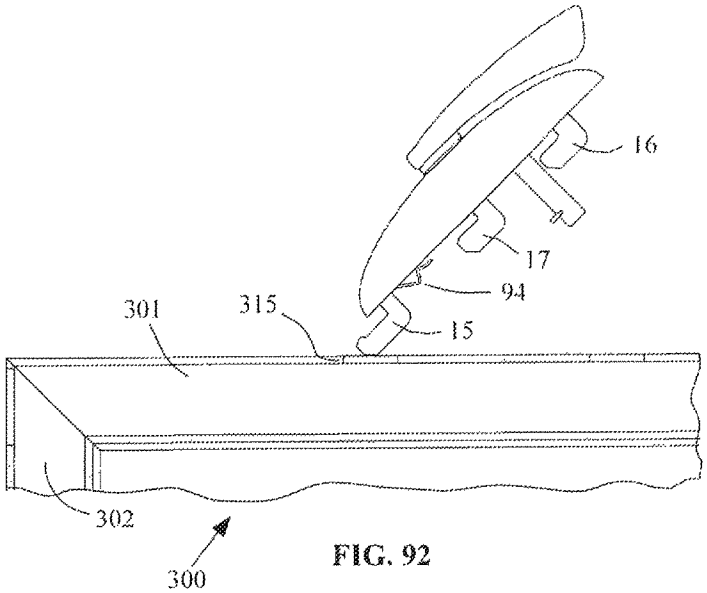
FIG. 92 is a side view illustrating insertion of the first hooked leg of the sash lock assembly of FIG. 39 into a first corresponding opening in the sliding sash window frame of FIG. 88.
Figure 94A:
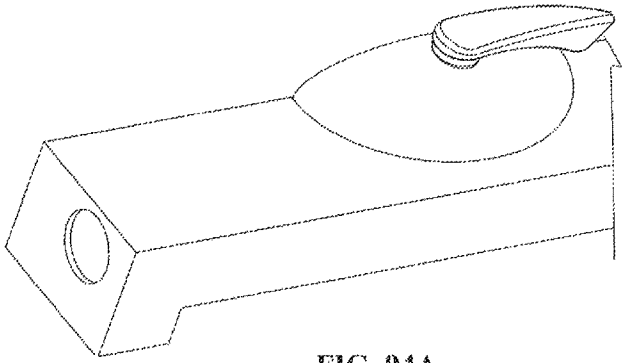
FIG. 94A is a perspective view of the sash lock assembly releasably secured to the sliding sash window frame, as seen in FIG. 94.

As seen in FIG. 89, a first opening 315, a second opening 316, a third opening 317, and a fourth opening 370 may be formed in the top wall of the meeting rail 301. Openings 315, 316, and 317 may be shaped and positioned to suitably correspond to the footprint of legs 15, 16, and 17 of the housing 10 (FIG. 7). In FIGS. 92 and 93, it may be seen that the hooked leg 15 of housing 10 of the sash assembly 100 may be inserted at an angle, so that the hook of the leg enters the opening and may be inserted beyond the extent of the periphery of the opening 315 in the rail, after which the sash lock assembly may be pivoted about the hook of leg 315, so that legs 16 and 17 are each also respectively inserted through the rail openings 316 and 317. As seen in FIG. 93, the opening 315 may be slightly smaller in the length direction than the footprint of housing leg 15, while the length of the openings 316 and 317 may be slightly larger than corresponding footprints of legs 16 and 17. The width for each of the openings 315, 316, and 317 in the rail may all be slightly larger to afford a clearance fit with the width of legs 15, 16, and 17.

During pivoting of the sash lock assembly 100 for insertion of the legs 16 and 17 into rail openings 316 and 317, the post 77 of the lever arm 70 may also be inserted into rail opening 370, which may be arcuate in shape to accommodate the pivotal motion of the lever arm upon the post 25 of the sash lock housing 10.

Also, during pivoting of the sash lock assembly 100 for insertion of the legs 16 and 17 into openings 316 and 317, the engagement spring 94 may become deflected from its static position with respect to the sash lock housing 10, as seen in FIG. 92, as its flange 96 may now be in contact with the top wall of the stile 301 (FIG. 93).

Figure 94:
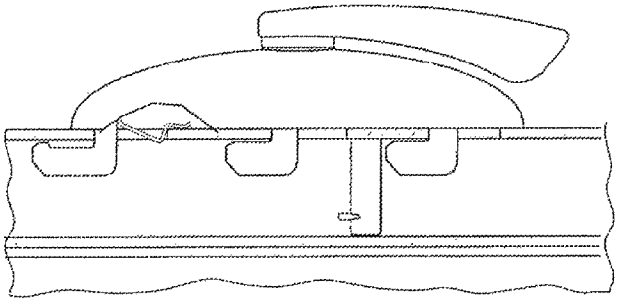
FIG. 94 is the side view of FIG. 93, after sliding of each of the first, second, and third legs of the sash lock assembly laterally within the corresponding openings in the sliding sash window frame, and with the engagement spring engaging one of the openings to releasably secure the sash lock assembly to the sliding sash window frame.

The final step in installing the sash lock assembly 100 upon the rail of the sliding sash window 300 is to slide the lock assembly laterally, so that the engagement spring 94 may begin to move into the rail opening 315, back towards its undeflected position, until the legs 98 and 99 of the engagement spring 94 may engage the edge of the rail opening 315 that is distal from the stile 302, as seen in FIG. 94.

Figure 118:
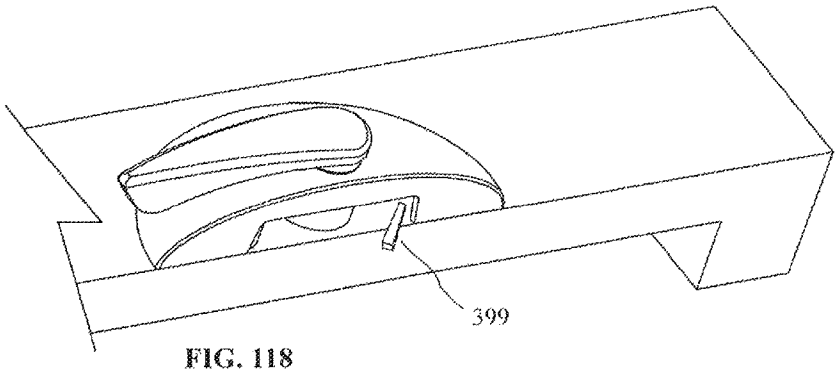
Figure 119:
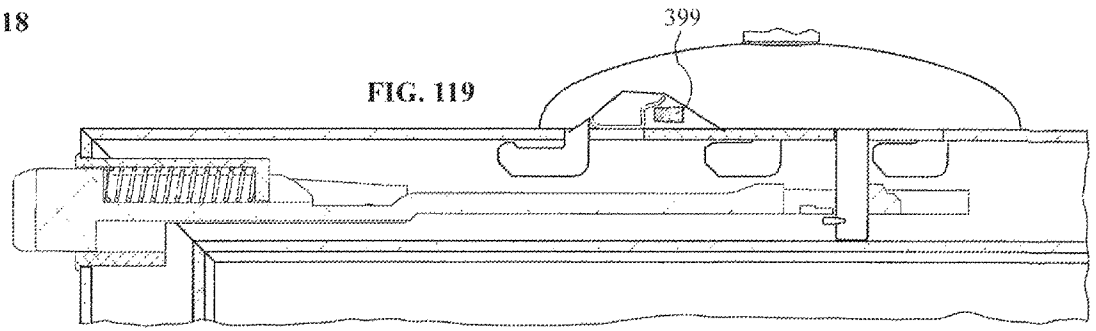
Figure 120:
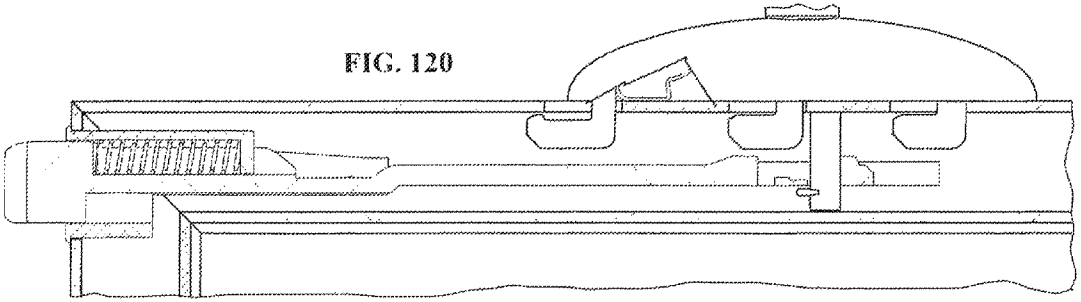
Figure 121:
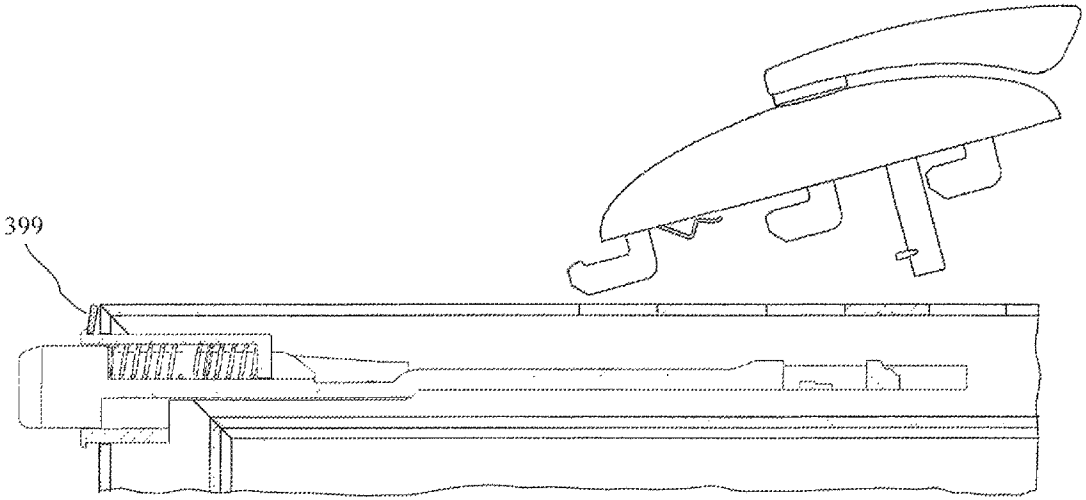
Figure 122:
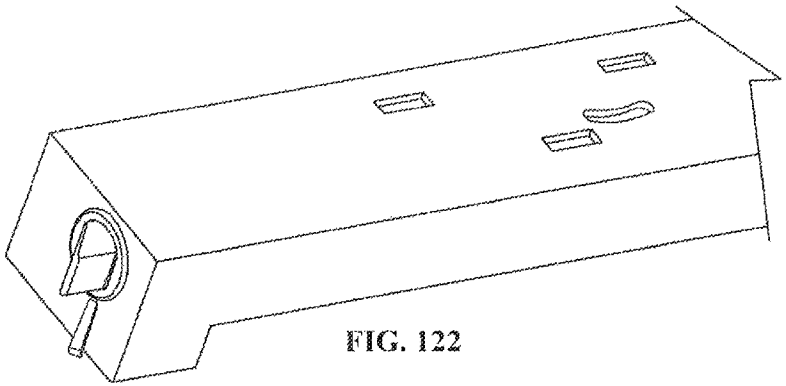

Uninstalling of the lock assembly 100 is shown in FIGS. 118-122, and may be effectuated using a slender and/or a pointed object, such as a thin screw-driver blade, or a knife blade, or a simple pry tool, such as tool 399. As illustrated in FIGS. 118 and 119, the pry tool 399 may be used to remove the sash lock assembly 100 by deflecting the engagement spring 94 back towards the interior of the housing 10 to disengage its legs 98 and 99 from the rail opening 315. Thereafter, removal may be effectuated by sliding the housing away from stile 302, and by pivoting the lock assembly to remove the legs 15, 16, and 17, as well as the post 77 of lever arm 70, from the corresponding openings in the meeting rail 301.

A keeper assembly 400 may be constructed similar to the lock assembly 100, using a housing 410 and an engagement spring 494, as seen in FIGS. 74-77. Keeper assembly 400 may be installed upon the master window frame (or upon the meeting rail of an upper sliding sash window for a double hung window), similar to the installation of the sash lock assembly 100, and is shown in FIGS. 80-87. The keeper assembly 400 may also be uninstalled from the master window frame in a similar process as for the uninstalling of the sash lock assembly 100, and is shown in FIGS. 123-126.

Figure 95:
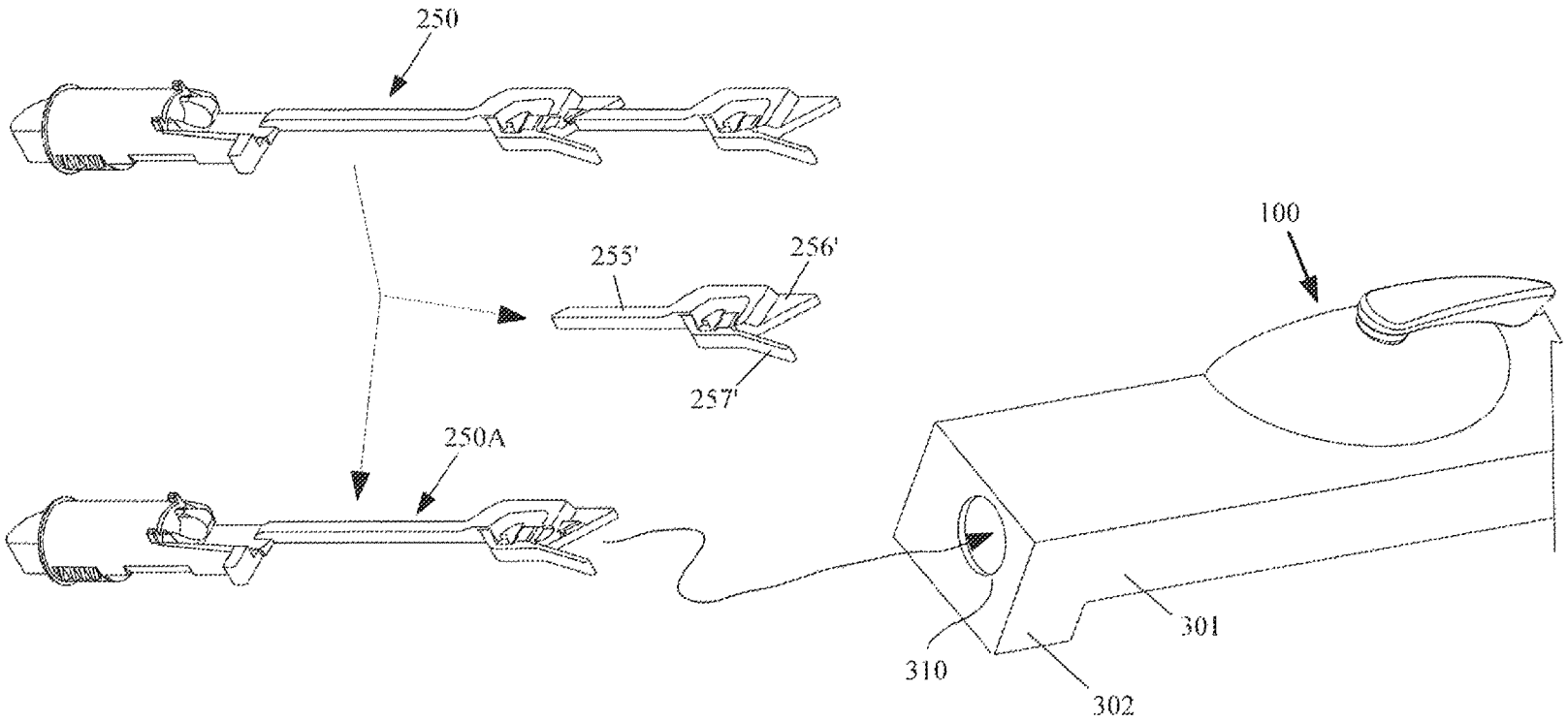
FIG. 95 illustrates size adjustment of the latch member with the dual beam and funnel members of FIG. 56 into the latch member of FIG. 60 with a singular beam and funnel members, just prior to insertion into the sliding sash window frame having the sash lock assembly secured thereon, as seen in FIG. 94.
Figure 96:
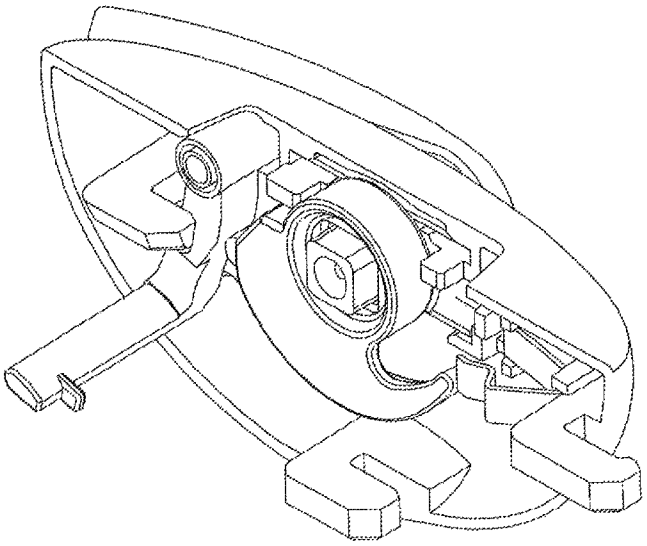
FIG. 96 is the perspective view of the sash lock assembly seen in FIG. 39, but shown reduced in size.
Figure 97:
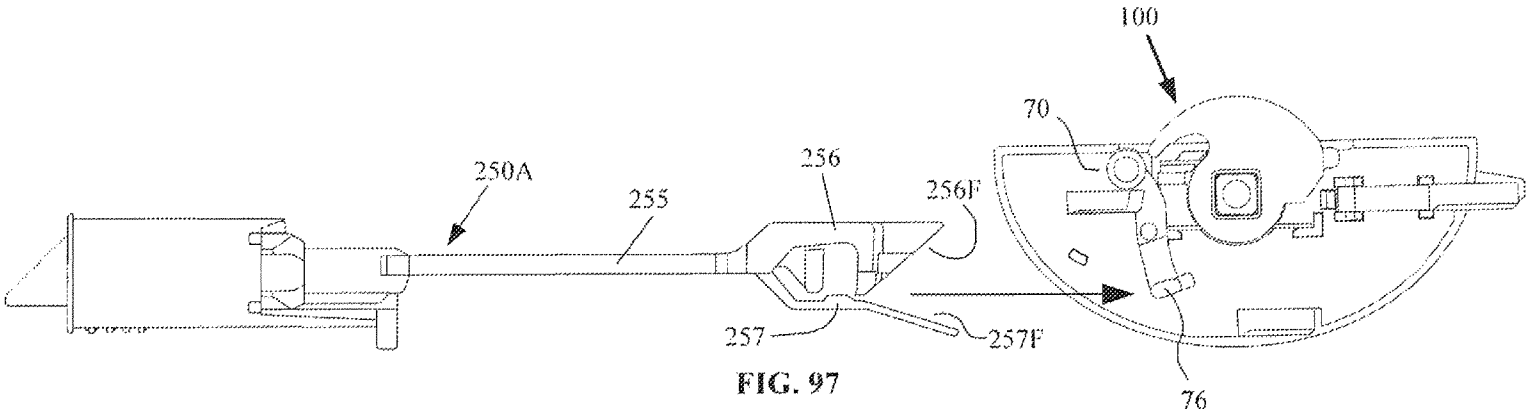
FIG. 97 illustrates the size-adjusted latch assembly just prior to being coupled to the post of the pivotal lever arm of the sash lock assembly.

Installation of the latch assembly 200 is shown initially in FIG. 95, where the latch member 250 may be size adjusted, by removal of the secondary beam 255' and corresponding secondary fixed/flexible funnel member (256' and 257'), to form latch assembly 200A. The latch assembly 200A may be inserted through the opening 310 of the frame of sliding sash window 300. As seen in FIG. 97, the insertion of the latch assembly 200A through the selectively positioned opening 310 in the rail of the sliding sash window will accomplish mating of the beam 255 of the latch assembly with the post 76 of lever arm 70 of the lock assembly 100, using the fixed funnel member 256 and the flexible funnel member 257 of the latch assembly.

Figure 98:
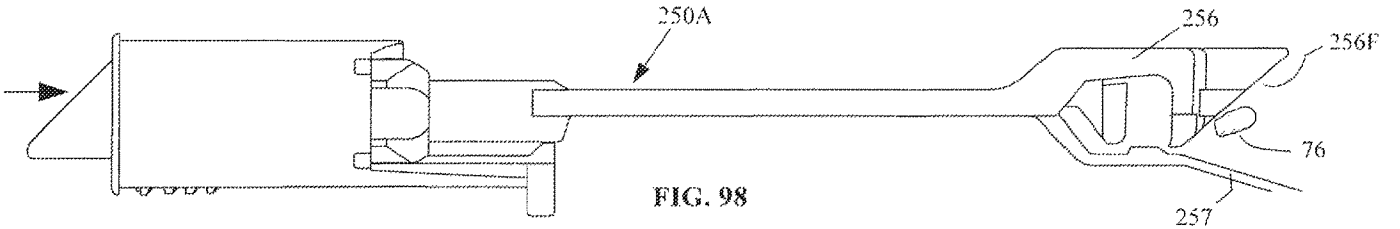
FIG. 98 illustrates initial contact of the fixed funnel member of the latch assembly, with the post of the pivotal lever arm of the sash lock assembly seen in FIG. 97.
Figure 99:
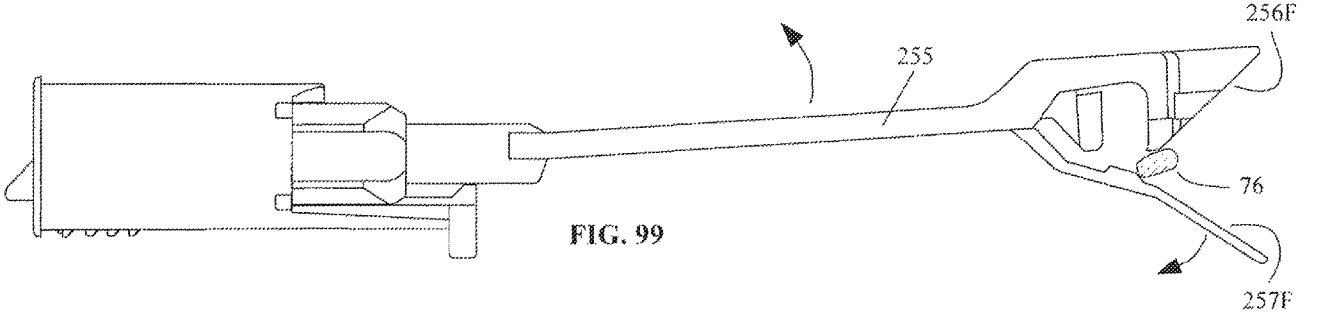
FIG. 99 illustrates movement of the latch tongue towards the retracted position to cause lateral deflection of the beam and fixed funnel member of the latch assembly in a first lateral direction, as a result of sliding contact between the post of the pivotal lever arm of the sash lock assembly with the fixed funnel member.
Figure 100:
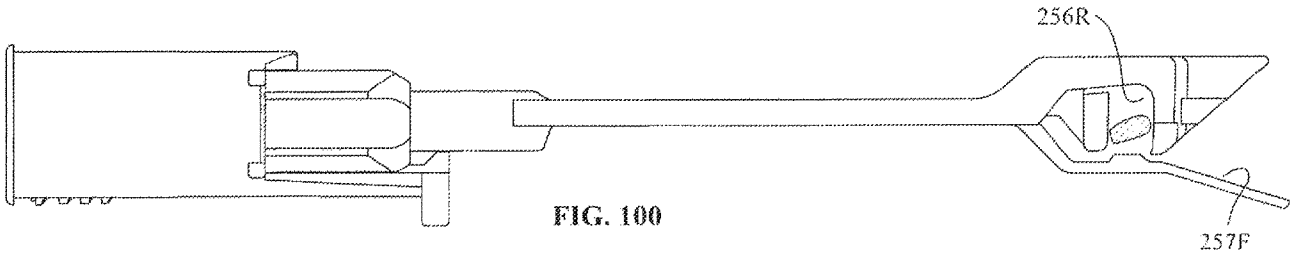
FIG. 100 illustrates the post of the pivotal lever arm fully received into the opening in the latch assembly formed by the fixed and flexible funnel members, and with the tongue still in the retracted position.
Figure 101:
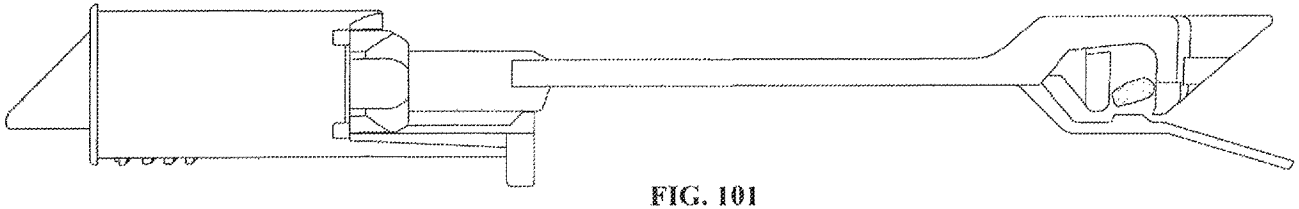
FIG. 101 illustrates the engagement of the post of the pivotal lever arm in the opening in the latch assembly formed by the fixed and flexible funnel members, but with the tongue having been biased into the extended position, thereby biasing the pivotal lever arm toward the latch locked position.
Figure 105:
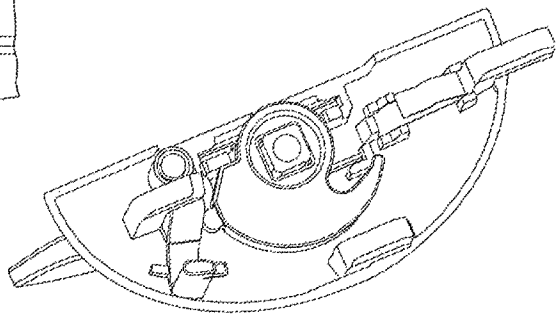
FIG. 105 is a bottom perspective view of the sash lock assembly of FIG. 104, showing positioning of the cam and the post of the pivotal lever arm when the integrated sash lock/tilt latch fastener is in the unlocked and unlatched position.
Figure 103:
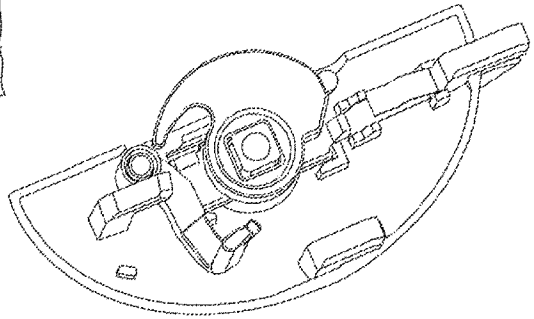
FIG. 103 is a bottom perspective view of the sash lock assembly of FIG. 102, showing positioning of the cam and the post of the pivotal lever arm when the integrated sash lock/tilt latch fastener is in the locked and latched position.

As the latch assembly 250A is advanced through the opening 310 in the rail, as seen in FIG. 98, the fixed funnel member will be positioned so that its angled funnel surface 256F will contact the post 76 of lever arm 70. Continued advancement of the latch assembly 250A through the opening 310 in the rail (note the apex of the tongue 255 withdrawing into the latch housing 210), will result in the beam 255 deflecting in a first direction, as shown by the arrow in FIG. 99, as the post 76 moves farther down the angled funnel surface 256F of the fixed funnel member 256. When the post 76 reaches the angled funnel surface 257F of the flexible funnel member 257, it will cause the flexible funnel member to deform in a second direction being generally opposite to which the beam 255 had been deflected, and will therefore cause separation between the fixed funnel member 256 and the flexible funnel member 257. When the separation is sufficient, the post 76 will pass therebetween, and will enter the curved recess 256R of the fixed flexible member, after which the flexible funnel member will return to its undeflected position in proximity to the fixed flexible member 256, as seen in FIG. 100. Upon removal of the force that had been applied to the tongue 255 to cause capture of the post 76 within the recess curved recess 256R of the fixed funnel member 256, the tongue will be biased outward once again by spring 291, as seen in FIG. 101.

Figure 104:
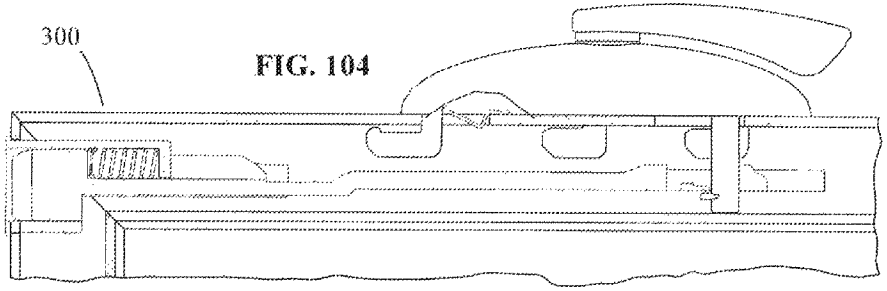
FIG. 104 is the view of FIG. 102, but with the sash lock handle pivoted so that the integrated sash lock/tilt latch fastener is in the unlocked and unlatched position.
Figure 102:
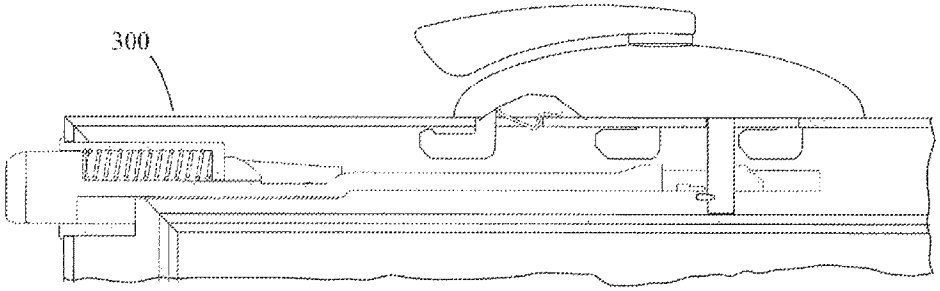
FIG. 102 is a side cross-sectional view through the sliding sash window frame, with the sash lock assembly installed thereon, and with the latch assembly installed into the frame and engaged with the post of the pivotal lever arm of the sash lock. The integrated sash lock/tilt latch fastener is shown in the locked and latched position.
Figure 106:
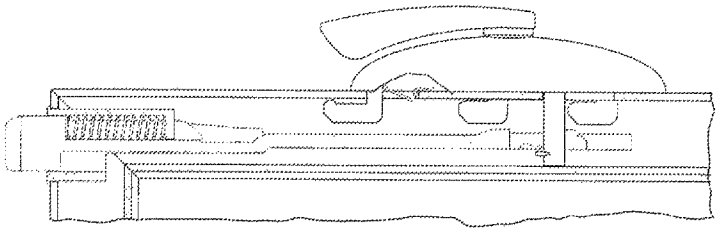
FIG. 106 is the view of FIG. 104 with the integrated sash lock/tilt latch fastener in the locked and latched position, but shown reduced in size.
Figure 107:
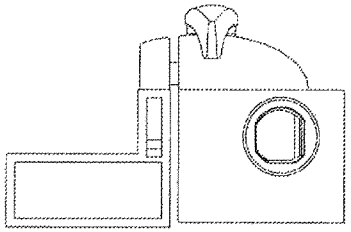
FIG. 107 is an end view of the integrated sash lock/tilt latch fastener installed within the sliding sash window frame, as seen in FIG. 106.
Figure 108:
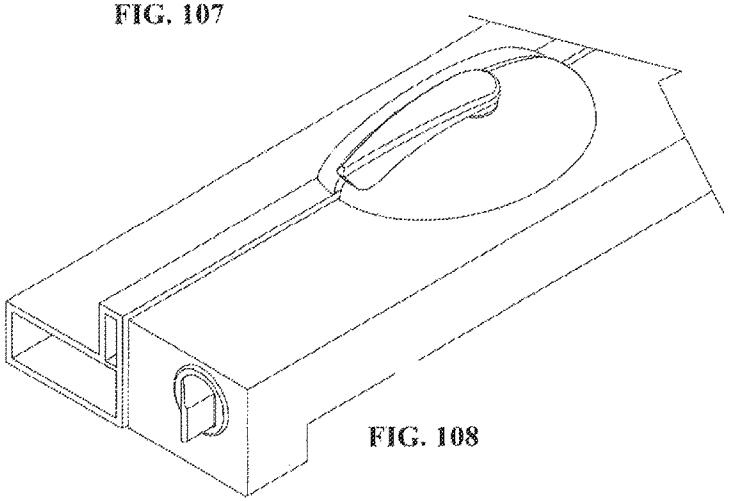
FIG. 108 is a perspective of the integrated sash lock/tilt latch fastener installed within the sliding sash window frame, as seen in FIG. 106.
Figure 109:
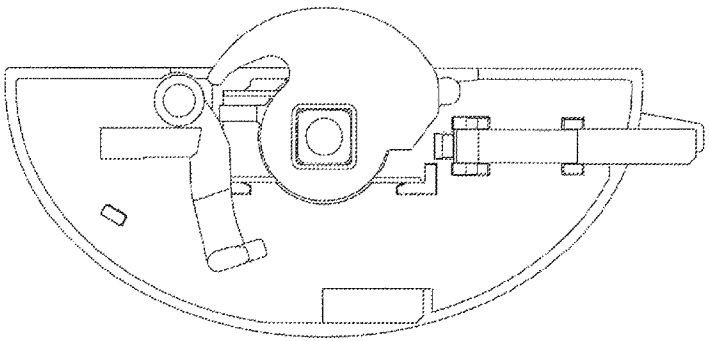
FIG. 109 is a bottom view of the sash lock assembly of FIG. 106, showing positioning of the cam and the post of the pivotal lever arm when the integrated sash lock/tilt latch fastener is in the locked and latched position.
Figure 111:
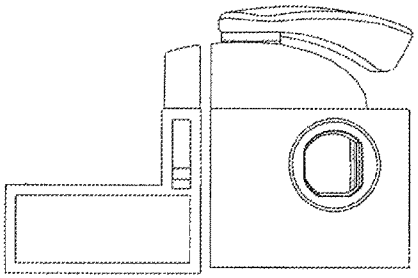
Figure 112:
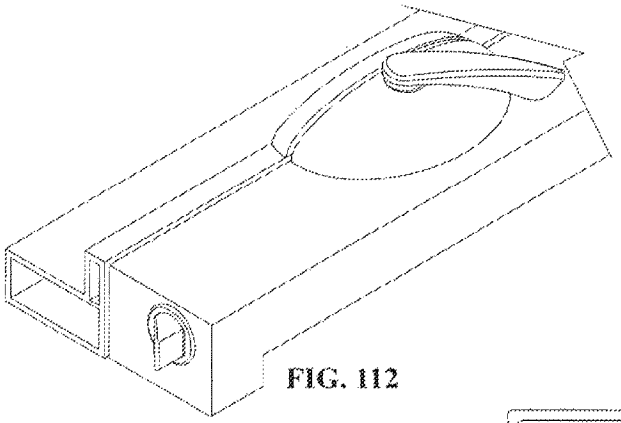
Figure 113:
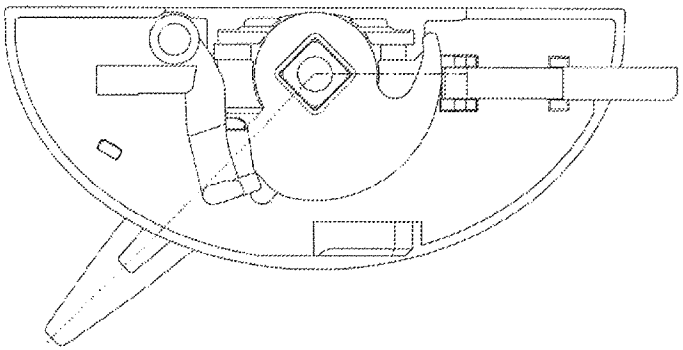
Figure 114:
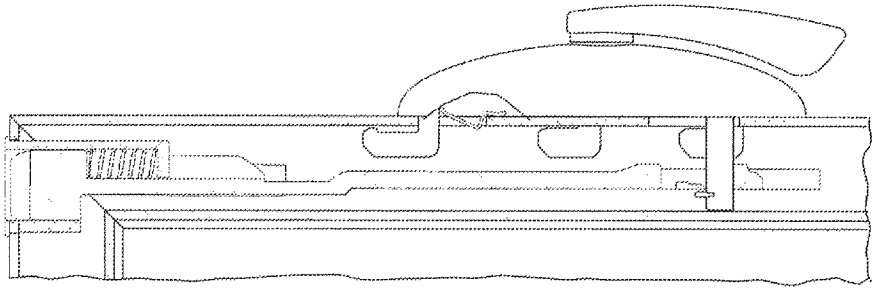
Figure 115:
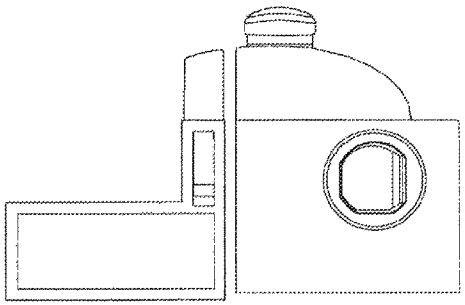
Figure 116:
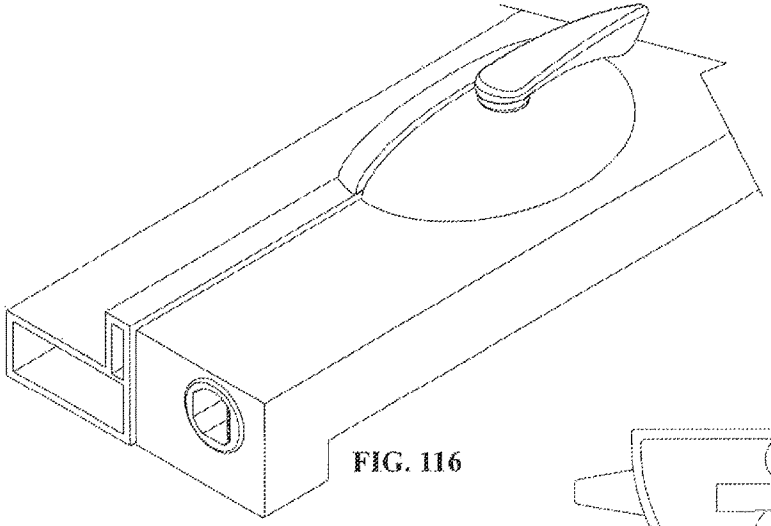
Figure 117:
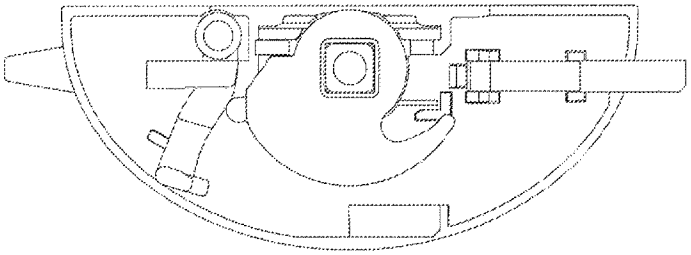

The integrated sash lock/tilt latch fastener, which includes sash lock assembly 100 and latch assembly 200 (FIG. 1A), is shown installed in the sliding sash window 300, and in the locked and latched position within FIG. 102, and in the unlocked and unlatched position within FIG. 104. A series of additional views showing the integrated sash lock/tilt latch fastener installed upon the sliding sash window 300, and in the locked and latched position, are shown within FIGS. 106-108. A series of views showing the integrated sash lock/tilt latch fastener installed upon the sliding sash window 300, and in the unlocked and latched position, are shown within FIGS. 110-112. A series of views showing the integrated sash lock/tilt latch fastener installed upon the sliding sash window 300, and in the unlocked and unlatched position, are shown within FIGS. 114-116.

Figure 110:
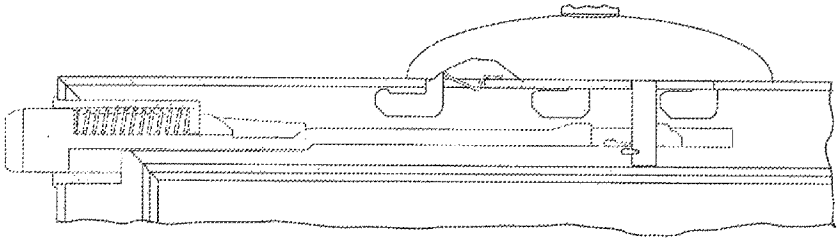
FIG. 110 is the view of FIG. 104, but shown with the handle of the sash lock assembly having been rotated to place the integrated sash lock/tilt latch fastener in the unlocked and latched position.

Improvements to the interconnection between the sash lock assembly 100 and latch assembly 200 for the integrated sash lock/tilt latch fastener shown installed in the sliding sash window 300 of FIG. 110, may be obtained through the replacement of latch assembly 200 with latch assembly 201. Latch assembly 201 is shown in FIGS. 128A and 128B, and may similarly include the use of the housing 210 and a biasing member, which may be helical compression spring 291. However, latch assembly 201 may include a latch member 250A instead of latch member 250.

Latch member 250A may be formed as seen in the perspective view of FIG. 128A and the top view of FIG. 128B. The latch member 250A may be formed to have a tongue similar to latch member 250, however, it may have a beam 255A that is formed differently than beam 255 of latch member 250. The beam 255A may, as seen in FIG. 128B, have one or more openings 275 formed to pass through the beam from the top surface of the beam through the bottom surface, such that when the latch assembly is installed through the side of the sash window frame and the beam 255A is within the hollow meeting rail, the through-opening 275 may be vertically oriented. (It should be noted that the use within this disclosure of the terms "vertical" and "horizontal" are not intended to limit other possible configurations/uses of the combination sash lock/tilt latch embodiments taught herein, particularly because certain modern architectural designs utilize windows that are not oriented with respect to that reference frame, and may instead, for example, be at an angle with respect to a vertical plane. However, those terms are useful in describing the standard sliding/tilting sash window illustrated throughout the exemplary Figures provided herein).

Each of the one or more openings 275 may be particularly shaped and oriented to provide for selective engagement of the post 76 of lever arm 70 of the lock assembly 100 therein. As seen in FIG. 128B, the opening 275 may be an elongated shape, which may, for example, be generally rectangular-shaped, or diamond-shaped, etc., and may correspond to the cross-sectional shape used for the post 76 of lever arm 70.

To be illustrative, the opening 275 in beam 255A in FIG. 128A is shown with a rectangular shape. The elongated opening may be oriented so that the longer direction of the opening is substantially perpendicular to the axis 255X of the beam 255. The rectangular opening 275 may therefore have a length 275L extending substantially normal to the axial direction 255X of the beam, and a width 275W extending substantially parallel to the axial direction of the beam. The internal corners of the rectangular opening 275 may be filleted (i.e., formed with a concave junction). The generally slender beam 255A may thus transition to widen in proximity to the opening(s) 275, and may form peripheral walls to provide sufficient structural integrity for the latch member, as the size of the opening is largely driven by the shape and the required size of the post 76 of lever arm 70 of the lock assembly 100.

The post 76 of lever arm 70 is shown in detail in FIGS. 25-32. The elongated cross-sectional shape used for the post 76 may be a somewhat irregular shape, or it may be a diamond shape or a substantially rectangular shape that may have rounded exterior corners. Other cross-sectional shapes may also be suitably utilized to form the post, such a racetrack shape, a clothoid shape, and an elliptical shape, each of which may be suitable, as they would not tend to adversely affect the beam 255A when received within the opening 275, as discussed hereinafter. A principle feature of the cross-sectional shape to be used for the post 76 may be, as seen in FIGS. 138 and 139, that it be an elongated shape having a long-transverse direction (i.e., L1) and a short-transverse direction (i.e., S1).

This elongated cross-sectional shape of the post 76 may work in concert with the rectangular shaped opening 275, with respect to initial insertion of the post therein, and its subsequent operation relative to the walls of the opening. The post 76 may be received within the opening 275 when the lock assembly 100 is mounted to the top of the meeting rail of the sash window. A suitable series of openings formed in the top of the meeting rail for mounting of the sash lock thereto is shown within FIGS. 129-131, and may similarly include a first opening 315A, a second opening 316A, a third opening 317A, and a fourth opening 370A. The fourth opening 370A may generally be elongated along the axial direction 301AX of the meeting rail 301A (FIG. 132), to accommodate pivotal movement of the lever arm 70 therein, as discussed hereinabove with respect to the lock assembly 100 and meeting rail 301. In addition, the fourth opening 370A may be formed of an elongated axial opening 370AX, and shorter elongated portion 370AT being elongated in a direction that is transverse to the axial direction 301AX of the meeting rail 301A.

While the latch member 201 may be received within the opening 310A of the sliding sash window 300A (FIG. 133) the same as with latch member 200 and window 300, the latch member 201 may operate somewhat differently therein (see e.g., FIGS. 134-137), and the securing of the lock assembly 100 to the meeting rail 301A may also be somewhat different.

Initial positioning of the lock assembly 100 for its mounting to the sash window 300A is seen in FIG. 140, in which the housing of the lock assembly is positioned substantially transverse to the axial direction 301AX of the meeting rail 301A. Such initial positioning may also serve to orient the long transverse direction of the post 76 of lever arm 70 to similarly be perpendicular to the axial direction 301AX of the meeting rail 301A, where it may be generally in-line with the shorter elongated portion 370AT of the elongated fourth opening 370A in the top of the meeting rail 301A.

With the long transverse direction of the post 76 of lever arm 70 being oriented to be in-line with the shorter elongated portion 370AT of the elongated fourth opening 370A, the lock assembly 100 may be dropped "vertically," as seen in FIG. 141, so that the post 76 is first received through the opening elongated portion 370AT of opening 370A, and then through the opening 275 in the beam 255A of the latch member 250A. This may result by the length of the beam 255A and the location of the opening 275 therein being coordinated with the positioning of the openings 315A, 316A, 317A, and 370A in top of the meeting rail 301A, so that the elongated portion 370AT of opening 370A in the meeting rail 301A is directly above the corresponding elongated opening 275 in the beam 255A of the latch member 201.

With the post 76 of lever arm 70 received through the opening 275 in the beam 255A of the latch member 250A, as seen in FIG. 141, the latch assembly may be rotated roughly 90 degrees, as seen in FIG. 142. The joining of the transverse elongated portion 370AT of the opening 370A in the meeting rail with the axial portion 370AX may be sufficient to permit rotation of the elongated cross-section of the post 76 of lever arm 70 therein. In addition, the length 275L of the rectangular opening 275 in the beam 255 may be slightly oversized in comparison to the combination of the elongated cross-sectional shape of the post 76 and the protrusion 77 protruding therefrom, as seen in FIG. 141A. The rounded corners of the rectangular cross-section for the post 76 (or the alternative use of the racetrack shape, the clothoid shape, or the elliptical shape) may each be advantageous, as they would not tend to gouge or scrape the beam when initially rotated within the opening 275, or thereafter when the lock assembly is actuated and the post is driven by the cam to actuate the beam and tongue of the latch member 250A.

After the lock assembly 100 has been rotated relative to the meeting rail, as seen in FIG. 142, the extent of the elongated cross-sectional shape of the post 76 may tend to occupy substantially the entire width 275W of the opening 275 in the beam 255, as seen in FIG. 142A. In addition, the protrusion 77 protruding from one side of the post 76 is now disposed beneath the bottom surface 255B of the beam 255, and the post of lock assembly 100 may now be captive with respect to the latch member 201.

As seen in FIG. 142, the first, second, and third legs, 15, 16, and 17, of the housing of the lock assembly 100 are aligned with the first, second, and third openings (315A, 316A, and 317A) in the top of the meeting rail 301A (i.e., the axial direction of the legs is aligned with the axial direction of the openings), but are laterally displaced therefrom. Therefore, the lock assembly 100 may be translated away from the stile of the window frame, as indicated by the arrow in FIG. 142, so that the legs (15, 16, and 17) of the housing are moved to become adjacent to the openings (315A, 316A, and 317A), as seen in FIG. 143. Note that in translating the lock assembly 100, the post 76 that is captive within the opening 245 of the beam 255 of the latch assembly 250A causes the latch member 250A to also translate, and the tongue to be retracted.

The lock assembly 100 may then be advanced toward the meeting rail, so that the legs (15, 16, and 17) are received through the openings (315A, 316A, and 317A), as seen in FIG. 144. The lock assembly 100 may then be reverse-translated, as indicated by the arrow in FIG. 144, so that the legs (15, 16, and 17) of the housing are moved within the openings (315A, 316A, and 317A) to become engaged with the top wall of the meeting rail, as seen in FIG. 143. The engagement spring 94, as discussed hereinabove, may move into the rail opening 315A, back towards its undeflected position, until the legs 98 and 99 of the engagement spring 94 may engage the edge of the rail opening to secure the lock assembly to the sash window frame, as seen in FIGS. 145 and 146.

Other features of the latch member 250A may enable improved operation of the integrated sash lock and tilt latch, and coupling of the lock assembly to the latch member. The length of the post 76 may be, selected so that the end of the post of the lever arm 70 is then in very close proximity to, or contacting, the bottom wall 301AB of the meeting rail 301A (FIG. 144), which may thriller preclude the separation of the beam from the post, even in the absence of the use of the protrusion 67 on the post 66 of the lever arm 70 of the lock assembly 100. As seen at least in FIG. 144, the end of the post 66 of the lever arm 70 may be in such close proximity to the bottom wall 301AB of the meeting rail 301A that it may be separated therefrom by a distance that may be significantly less that the thickness of the adjacent meeting rail bottom wall. Moreover, the beam 255 of the latch member 250A may be formed to include at least one vertical post 255P that, may protrude down from the bottom surface of the beam. The post 255P, which may be cylindrical, may be formed of a selective length so as to contact the bottom wall 301AB of the meeting rail 301A to provide support for the beam 255 to be at a substantially horizontal position, which may be a substantially central position within the hollow meeting rail of the sash window. This may further serve to prevent disengagement of the post 76 of the lever arm 70 from the opening 275, in addition to locating the end of the post 76 in proximity to the bottom of the meeting rail, and it may also serve to provide support to the beam 255 to facilitate the initial insertion of the post 76 though the opening 275 in the beam.

The latch member 250A, as seen in FIG. 128B, may also be formed to have multiple openings 275 along the length of the beam 255, which may permit the same latch assembly to be universally suited for use on windows of various different sizes, where the openings 315A, 316A, 317A, and 370A in top of the meeting rail 301A may be positioned at a different distance from the stile for each different window size. The cross-section of the beam 255 between the openings 275 may be reduced in thickness to preclude excessive use of plastic or other material needed to form the part, while multiple posts 255P may be used to provide support for the beam. As seen in FIG. 137, two posts 255P may be used to support the length of beam where three openings 275 are utilized.

The examples and descriptions provided merely illustrate a preferred embodiment of the present invention. Those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the preferred embodiment without departing from the spirit of this invention.

We claim:

1. A combination locking and tilt latching fastener, for use on a frame of a sash window adapted to slide and tilt with respect to a master window frame, said fastener comprising:

a lock assembly adapted to mount to a first wall portion of a hollow meeting rail of the frame of the sash window, said lock assembly comprising: a housing; an arm comprising: a first portion pivotally mounted to said housing, and a second portion; wherein an entirety of said second portion of said arm extends orthogonally with respect to said first arm portion and linearly into the hollow meeting rail in a transverse direction being directly from the first wall portion toward a second wall portion; and a cam pivotally mounted to said housing;

a latch assembly adapted to be received through an opening in a side of the frame of the sash window, said latch assembly comprising a biasing means and a latch member, said latch member comprising a first end formed into a tongue portion, said biasing means biasing said latch member for said tongue portion to normally protrude out from the opening in the side of the frame of the sash window; said latch member comprising a beam extending away from said, tongue portion, said beam comprising at least one through-opening from a first side of said beam through a second side of said beam, said beam comprising at least one post of a selective length that protrudes from said second side of said beam, being adapted to contact the second wall portion of the hollow meeting rail to support said beam at a substantially central position within the hollow meeting rail;

wherein said arm of said lock assembly is selectively received through said at least one through-opening in said beam;

wherein said arm comprises a length adapted for a distal end thereof to be separated from the second wall portion of the hollow meeting rail by a distance being less than a thickness of the second wall portion of the hollow meeting rail in said transverse direction; and wherein a first cam position for said cam is adapted to engage a keeper on the master window frame to lock the sash window, a second can position is adapted to disengage said cam from the keeper to permit the sash window to slide, and said cam in a third cam position actuates said arm to drive said beam of said latch assembly to oppose said biasing, to retract said tongue portion to permit the sash window to tilt.

2. The combination locking and tilt latching fastener according to claim 1, wherein said at least one through-opening comprises a rectangular-shaped opening with a length of said rectangular-shaped opening extending substantially normal to an axial direction of said beam, and with a width of said rectangular-shaped opening mending substantially parallel to said axial direction of said beam.

3. The combination locking and tilt latching fastener according to claim 2, wherein said arm of said lock assembly is formed with an elongated cross-sectional shape having a long-transverse direction and a short-transverse direction;

wherein when said latch assembly is received through the opening in the side of the frame of the sash window and said lock assembly is mounted to the first wall portion of the hollow meeting rail, said arm of said lock assembly is selectively received through said at least one through-opening for said long-transverse direction of said arm of said lock assembly to be oriented substantially parallel to said width of said rectangular-shaped through-opening, and wherein said elongated cross-sectional shape of said arm in said long-transverse direction spans substantially an entirety of said width of said at least one rectangular-shaped through-opening in said beam.

4. The combination locking and tilt latching fastener according to claim 3 wherein said elongated cross-sectional shape comprises a cross-sectional shape from the group of cross-sectional shapes consisting of: a racetrack shape, a clothoid shape, an elliptical shape, and a substantially rectangular shape.

5. The combination locking and tilt latching fastener according to claim 3, wherein said at least one through-opening comprises a plurality of through-openings in said beam of said latch member accommodate said mounting of said lock assembly to one of a corresponding plurality of mounting positions upon the first wall portion of the hollow meeting rail for a corresponding plurality of different sized sash windows.

6. The combination locking and tilt latching fastener according to claim 5, wherein said plurality of through-openings through said beam comprises three through-openings spaced along a length of said beam; and wherein said at least one post comprises two posts spaced apart along said length of said beam.

7. The combination locking and tilt latching fastener according to claim 6, wherein said pivotal mounting of said arm is non-coaxial with said pivotal mounting of said cam; and wherein said lock assembly further comprises a leaf spring, and said cam comprises a cylindrical hub with one or more flats formed thereon; and wherein said leaf spring and said one or more fiats releasably limit pivotal travel of said cam at said first cam position, and at said second cam position.

8. The combination locking and tilt latching fastener according to claim 6, further comprising detent means for releasably limiting pivotal travel of said cam at said first cam position, and at said second cam position.

9. The combination locking and tilt latching fastener according to claim 8, further comprising a latch housing, wherein said latch housing receives said latch member and said biasing means therein, and an outer surface of said latch housing comprising a plurality of teeth.

10. The combination locking and tilt latching fastener according to claim 9, wherein said lock assembly is adapted to releasably mount to the hollow meeting rail of the frame of the sash window, with said housing of said lock assembly comprising one or more legs, said one or more legs adapted to releasably engage one or more corresponding openings in the hollow meeting rail.

11. The combination locking and tilt latching fastener according to claim 10, said lock assembly comprising a spring adapted to secure said one or more legs in said releasable engagement.

12. The combination locking and tilt latching fastener according to claim 1, wherein said length of said arm is adapted for said distal end thereof to contact the second wall portion of the hollow meeting rail.

13. A combination locking and tilt latching fastener, for use on a frame of a sash window adapted to slide and tilt with respect to a master window frame, said fastener comprising:

a lock assembly adapted to mount to a first wall portion of a hollow meeting rail of the frame of the sash window, said lock assembly comprising: a housing; an arm comprising: a first portion pivotally mounted to said housing, and a second portion; wherein an entirety of said second portion of said arm extends linearly into the hollow meeting rail of the sash window in a transverse direction being directly from the first wall portion toward a second wall portion; and a cam pivotally mounted to said housing;

a latch assembly adapted to be received through an opening in a side of the frame of the sash window, said latch assembly comprising a biasing means and a latch member, said latch member comprising a first end formed into a tongue, said biasing means biasing said latch member for said tongue to normally protrude out from the opening, in the side of the frame of the sash window; said latch member comprising a beam extending away from said tongue, said beam comprising an opening through said beam, said beam comprising a post of a selective length that protrudes away from a side of said beam, being adapted to contact the second wall portion of the hollow meeting rail of the frame of the sash window to support said beam at a substantially central position within the hollow meeting rail of the sash window;

wherein said arm of said lock assembly is selectively received through said opening in said beam; and wherein said arm comprises a length adapted for a distal end thereof to be separated from the second wall portion of the hollow meeting rail by a distance being less than a thickness of the second wall portion of the hollow meeting rail in said transverse direction.

14. The combination locking and tilt latching fastener according to claim 13, wherein said opening through said beam comprises a rectangular-shaped opening with a length of said rectangular-shaped opening extending substantially normal to an axial direction of said beam, and with a width of said rectangular-shaped opening extending substantially parallel to said axial direction of said beam.

15. The combination locking and tilt latching fastener according to claim 14, wherein said arm of said lock assembly is formed with an elongated cross-sectional shape having a long-transverse direction and a short-transverse direction, wherein when said latch assembly is received through the opening in the side of the frame of the sash window and said lock assembly is mounted to the first wall portion of the hollow meeting rail, said arm of said lock assembly is adapted to be selectively received through said opening in said beam for said long-transverse, direction of said arm to thereby be oriented substantially parallel to said width of said rectangular-shaped opening; and wherein said elongated cross-sectional shape of said arm in said long-transverse direction spans substantially an entirety of said width, of said rectangular-shaped opening in said beam.

16. The combination locking and tilt latching fastener according to claim 15 wherein said elongated cross-sectional shape comprises a cross-sectional shape from the group of cross-sectional shapes consisting of a racetrack shape, a clothoid shape, an elliptical shape, and a substantially rectangular shape.

17. The combination locking and tilt latching fastener according to claim 16, further comprising at least a second opening and a third opening in said beam to form a plurality of openings spaced along a length of said beam and at least a second post; and wherein said post and said second post are spaced apart along said length of said beam.

18. The combination locking and tilt latching fastener according to claim 13, said lock assembly further comprising a leaf spring, and said cam comprising a cylindrical hub with one or more flats formed thereon; and wherein said leaf spring and said one or more flats releasably limit pivotal travel of said cam at a first cam position where said lock assembly is locked, and at a second cam position where said lock assembly is unlocked.

19. The combination locking and tilt latching, fastener according to claim 13, further comprising detent means for releasably limiting pivotal travel of said cam at a first cam position, and at a second cam position.

20. The combination locking and tilt latching fastener according to claim 13, further comprising a latch housing, wherein said latch housing receives said latch member and said biasing means therein, and an outer surface of said latch housing comprising a plurality of teeth.

21. The combination locking and tilt latching fastener according to claim 13, wherein said lock assembly is adapted to releasably mount to the frame of the sash window, with said housing of said lock assembly comprising one or more legs, said one or more legs adapted to releasably engage one or more corresponding openings in the hollow meeting rail of the frame of the sash window, and said lock assembly comprising a spring adapted to secure said one or more legs in said releasable engagement.

22. The combination locking and tilt latching fastener according to claim 13, wherein said length of said arm is adapted for said distal end thereof to be in contact with the second wall portion of the hollow meeting rail.

23. A combination locking and tilt latching fastener, for use on a frame of a sash window adapted to slide and tilt with respect to a master window frame, said fastener comprising:

a lock assembly comprising: a housing adapted to mount to a first wall portion of a hollow meeting rail of the frame of the sash window; an arm comprising: a first portion pivotally mounted to said housing, and a second portion; wherein an entirety of said second, portion of said arm extends linearly into the hollow meeting rail in a transverse direction being directly from the first wall portion toward a second wall portion; and a cam pivotally mounted to said housing;

a latch assembly adapted to be received through an opening in a side of the frame of the sash window, and comprising a biasing means and a latch member, said biasing means biasing said latch member for a portion thereof to normally protrude out from the opening in the side of the frame of the sash window; said latch member comprising a through-opening, and a post that protrudes a selective length away from a first side of said latch member, being adapted to contact a second wall portion of the hollow meeting, rail to support said latch member at a substantially central position within the hollow meeting rail;

wherein said arm of said lock assembly is selectively received through said through-opening of said latch member;

wherein said arm comprises a length adapted for a distal end thereof to be separated from the second wall portion of the hollow meeting rail by a distance being less than a thickness of the second wall portion of the hollow meeting rail in said transverse direction.

24. The combination locking and tilt latching fastener according to claim 23, wherein said length of said arm is adapted to position said distal end thereof in contact with the second wall portion of the hollow meeting rail.

25. The combination locking and tilt latching fastener according, to claim 23, wherein said lock assembly is adapted to releasably mount to the hollow meeting rail of the frame of the sash window, with said housing of said lock assembly comprising one or more legs, said one or more legs adapted to releasably engage one or more corresponding openings in the hollow meeting rail of the frame of the sash window, for said releasable mounting of said lock assembly thereto; and said lock assembly comprising a spring adapted to secure said one or more legs in said releasable engagement.

26. The combination locking and tilt latching, fastener according to claim 23, wherein said through-opening in said latch member comprises a rectangular-shaped opening with a length of said rectangular-shaped opening extending substantially normal to an axial direction of said latch member, and with a width of said rectangular-shaped opening extending substantially parallel to said axial direction of said latch member; and wherein said arm of said lock assembly is formed with an elongated cross-sectional shape having a long-transverse direction and a short-transverse direction;

wherein when said latch assembly is received through the opening in the side of the frame of the sash window and said lock assembly is mounted to the first wall portion of the hollow meeting rail, said arm of said lock assembly is selectively received through said through-opening for said long-transverse direction of said arm to be oriented substantially parallel to said width of said rectangular-shaped opening, and wherein said elongated cross-sectional shape of said arm in said tong-transverse direction spans substantially an entirety of said width of said rectangular-shaped opening in said latch member.

* * * * *